US007325913B2

(12) United States Patent
Sasaki et al.

(10) Patent No.: US 7,325,913 B2
(45) Date of Patent: Feb. 5, 2008

(54) INK CARTRIDGE

(75) Inventors: Toyonori Sasaki, Anjo (JP); Shingo Hattori, Tsushima (JP); Tomohiro Kanbe, Bisai (JP); Atsuhiro Takagi, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 371 days.

(21) Appl. No.: 11/024,903

(22) Filed: Dec. 30, 2004

(65) Prior Publication Data

US 2005/0151812 A1 Jul. 14, 2005

Related U.S. Application Data

(63) Continuation-in-part of application No. 10/991,852, filed on Nov. 19, 2004.

(30) Foreign Application Priority Data

| | | |
|---|---|---|
| Nov. 25, 2003 | (JP) | 2003-394323 |
| Nov. 25, 2003 | (JP) | 2003-394324 |
| Dec. 8, 2003 | (JP) | 2003-409077 |
| Dec. 8, 2003 | (JP) | 2003-409640 |
| Feb. 9, 2004 | (JP) | 2004-031712 |
| Feb. 10, 2004 | (JP) | 2004-032872 |
| Feb. 20, 2004 | (JP) | 2004-043978 |
| Feb. 24, 2004 | (JP) | 2004-047768 |
| Feb. 27, 2004 | (JP) | 2004-053164 |
| Mar. 4, 2004 | (JP) | 2004-060456 |

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 5,506,611 A 4/1996 Ujita et al.

(Continued)

FOREIGN PATENT DOCUMENTS

| | | |
|---|---|---|
| EP | 1 000 753 A1 | 5/2000 |
| EP | 1 043 161 A2 | 10/2000 |
| EP | 1 147 903 A1 | 10/2001 |

(Continued)

OTHER PUBLICATIONS

Brother LC01 Cartridge, On Sale in the U.S. Before Dec. 30, 2003.

(Continued)

*Primary Examiner*—Anh T. N. Vo
(74) *Attorney, Agent, or Firm*—Oliff & Berridge, PLC

(57) ABSTRACT

An ink cartridge, includes an ink chamber capable of storing ink, an opening in a bottom surface of the ink cartridge, through which the ink may be supplied from the ink chamber to an image forming device, a first side wall, a second side wall opposite from the first side wall, a front wall, and a back wall opposite the front wall, wherein a first distance between the first side wall and the second side wall is greater than a second distance between the front wall and the back wall, at least one of the front wall or the back wall includes a recess, which protrudes inwardly with respect to adjacent regions of the at least one of the front wall or the back wall, a third distance from the bottom surface to the top of the recess is more than about 4.5 mm, and a fourth distance from the adjacent regions of the at least one of the front wall or the back ball and an end of the recess is less than about 3 mm.

35 Claims, 32 Drawing Sheets

U.S. PATENT DOCUMENTS

| | | | | |
|---|---|---|---|---|
| 5,815,183 | A * | 9/1998 | Sasaki | 347/86 |
| 6,062,667 | A | 5/2000 | Matsui et al. | |
| 6,241,348 | B1 | 6/2001 | Haigo | |
| 6,312,084 | B1 | 11/2001 | Ujita et al. | |
| 6,474,802 | B1 * | 11/2002 | Lui | 347/86 |
| 6,511,168 | B2 | 1/2003 | Higuma | |
| 6,595,711 | B2 * | 7/2003 | Hill | 400/470 |
| 6,786,581 | B1 | 9/2004 | Shinada et al. | |
| 6,846,062 | B2 | 1/2005 | Harada et al. | |
| 2001/0048456 | A1 | 12/2001 | Higuma | |
| 2002/0060725 | A1 | 5/2002 | Shinada et al. | |
| 2003/0001920 | A1 | 1/2003 | Harada et al. | |
| 2003/0016265 | A1 | 1/2003 | Harada et al. | |
| 2004/0233260 | A1 | 11/2004 | Shinada et al. | |

FOREIGN PATENT DOCUMENTS

| | | |
|---|---|---|
| JP | A 3-197052 | 8/1991 |
| JP | A 9-20018 | 1/1997 |
| JP | A 11-58775 | 3/1999 |
| JP | A-2001-1536 | 1/2001 |
| JP | A 2001-113723 | 4/2001 |
| JP | A-2002-1988 | 1/2002 |

OTHER PUBLICATIONS

Brother LC02 Cartridge, On Sale in the U.S. Before Dec. 30, 2003.
Brother LC21 Cartridge, On Sale in the U.S. Before Dec. 30, 2003.
Brother LC25 Cartridge, On Sale in the U.S. Before Dec. 30, 2003.

* cited by examiner

INK CARTRIDGE

This application is a Continuation-in-Part of application Ser. No. 10/991,852, filed Nov. 19, 2004. The entire disclosure of the prior application is hereby incorporated by reference herein in its entirety.

BACKGROUND OF THE INVENTION

1. Field of Invention

This invention relates to an ink cartridge and an inkjet recording apparatus equipped with the ink cartridge.

2. Description of Related Art

An ink cartridge is typically loaded into an inkjet recording apparatus by mounting the ink cartridge into the inkjet recording apparatus. A rubber stopper is attached to the ink cartridge and prevents air, ink or any other material from entering or exiting the ink cartridges. The inkjet recording apparatus includes a hollow needle with an acuminate tip. When the ink cartridge is pushed and loaded into the inkjet recording apparatus, the hollow needle penetrates the stopper plug by which an inside of the ink cartridge is in communication with the hollow needle in order to supply ink to the inkjet recording apparatus. However, the acuminate tip of the hollow needle is formed with the acuminate tip projecting toward the user. It is thus necessary to secure a safety measure in order to prevent a user from touching the tip.

In Japanese Unexamined Patent Application Publication H3-197052, for example, an inkjet recording apparatus is equipped with a protection device that protects the user from the hollow needle when the hollow needle is exposed. The protection device has a protection plate installed between the hollow needle and a side in which the ink cartridge is inserted in order to cover the hollow needle. When the ink cartridge is loaded, a lock of the protection plate when in a shielding position is released and the hollow needle is exposed. Furthermore, the hollow needle penetrates the stopper plug and the ink cartridge is thus loaded in the inkjet recording apparatus. Furthermore, when the ink cartridge is removed, the protection plate is placed in the shielding position by a twisted coil spring and held at that position by a lock component. Thus, the protection plate shields the user from touching the hollow needle.

As disclosed in Japanese Unexamined Patent Application No. 2001-113723, there also exists ink cartridges that prevent ink from leaking from the cartridges when the cartridges are removed from inkjet recording devices. Such ink cartridges are provided with an ink chamber that stores ink, an ink supply port that externally supplies ink stored in the ink chamber, and an ink guidance chamber formed between the ink chamber and the ink supply port.

The ink guidance chamber houses a valve unit, and a cylindrical packing is inserted into the ink supply port. The valve unit is urged by a compression spring in a direction elastically contacting the cylindrical packing in order to obstruct the ink flow path, and the valve unit prevents ink from leaking from the ink chamber side. The ink cartridge is structured such that, when attached to an inkjet recording device, an ink supply needle penetrates the cylindrical packing and opposes the urging force of the compression spring to press the valve unit toward the ink chamber. An ink flow path is thereby formed in order to supply ink.

SUMMARY OF THE INVENTION

The present invention also allows, among other things, various dimensions that permit the secure installation of the ink cartridge in an image forming device.

In exemplary embodiments, an ink cartridge includes an ink chamber capable of storing ink, an opening in a bottom surface of the ink cartridge, through which the ink may be supplied from the ink chamber to an image forming device, a first side wall, a second side wall opposite from the first side wall, a front wall, and a back wall opposite the front wall, wherein a first distance between the first side wall and the second side wall is greater than a second distance between the front wall and the back wall, at least one of the front wall or the back wall includes a recess, which protrudes inwardly with respect to adjacent regions of the at least one of the front wall or the back wall, a third distance from the bottom surface to the top of the recess is more than about 4.5 mm, and a fourth distance from the adjacent regions of the at least one of the front wall or the back ball and an end of the recess is less than about 3 mm.

In exemplary embodiments, an ink cartridge includes an ink chamber capable of storing ink, an opening in a bottom surface of the ink cartridge, through which the ink may be supplied from the ink chamber to an image forming device, an upper surface opposite from the bottom surface, a first side wall, a second side wall opposite from the first side wall, a front wall, and a back wall opposite the front wall, wherein a first distance between the first side wall and the second side wall is greater than a second distance between the front wall and the back wall, a bottom portion of the first side wall includes a recess, which protrudes inwardly with respect to an upper portion of the first side wall, a third distance from the recess to the second side wall is less than about 39.5 mm, the front wall includes a first bottom edge and the back wall includes a second bottom edge, a fourth distance from the first bottom edge to the second bottom edge is less than about 19.5 mm, and a fifth distance from the upper surface to the bottom surface is less than about 48 mm.

In exemplary embodiments, an ink cartridge includes an ink chamber capable of storing ink, an opening in a bottom surface of the ink cartridge, through which the ink may be supplied from the ink chamber to an image forming device, an upper surface opposite from the bottom surface, a first side wall, a second side wall opposite from the first side wall, a front wall, and a back wall opposite the front wall, wherein a first distance between the first side wall and the second side wall is greater than a second distance between the front wall and the back wall, a bottom portion of the first side wall includes a recess, which protrudes inwardly with respect to an upper portion of the first side wall, a third distance from the recess to the second side wall is less than about 39.5 mm, the front wall includes a first bottom edge and the back wall includes a second bottom edge, a fourth distance from the first bottom edge to the second bottom edge is less than about 28.5 mm, and a fifth distance from the upper surface to the bottom surface is less than about 48 mm.

In exemplary embodiments, an ink cartridge includes an ink chamber capable of storing ink, an opening in a bottom surface of the ink cartridge, through which the ink may be supplied from the ink chamber to an image forming device, a first side wall, a second side wall opposite from the first side wall, a front wall, and a back wall opposite the front wall, wherein the first side wall includes a protruding region, which protrudes outwardly with respect to adjacent regions of the first side wall, the protruding region has a first edge and a second edge, the first edge being closer to the front wall than to the back wall and the second edge being closer a back wall than to the first wall, and a first distance from the first edge to the second edge is less than about 4.5 mm.

In exemplary embodiments, an ink cartridge includes an ink chamber capable of storing ink, an opening in a bottom surface of the ink cartridge, through which the ink may be supplied from the ink chamber to an image forming device, and a blocking member that is positioned between the bottom surface and the ink chamber, the blocking member blocking communication between the ink chamber and an outside of the ink cartridge, the blocking member being capable of allowing the communication between the ink chamber and the outside of the ink chamber when an extract component of the image forming device is moved into the ink cartridge from the opening, wherein a first distance from the bottom surface and a bottom of the blocking member is less than about 4.5 mm.

BRIEF DESCRIPTION OF THE DRAWINGS

Various exemplary embodiments of the invention will be described in detail with reference to the following figures, wherein:

FIG. 8A is a plan view, FIG. 8B is a side view, FIG. 8C is a sectional view taken along a line of FIG. 8A, FIG. 8D is a sectional view taken along a line II-II of FIG. 8A and FIG. 8E a bottom view;

FIG. 9A is a plan view and FIG. 9B is a side view;

FIG. 11A depicts a state prior to installation and FIG. 11B depicts a state after installation;

FIG. 12A is a plan view, FIG. 12B is a sectional view and FIG. 12C is a bottom view;

FIG. 14A is a front view, FIG. 14B is a side view, FIG. 14C is a bottom view, and FIGS. 14D-14I illustrate various dimensions of the ink cartridge shown in FIGS. 14A-14C;

DETAILED DESCRIPTION OF PREFERRED EMBODIMENTS

Figure 1:
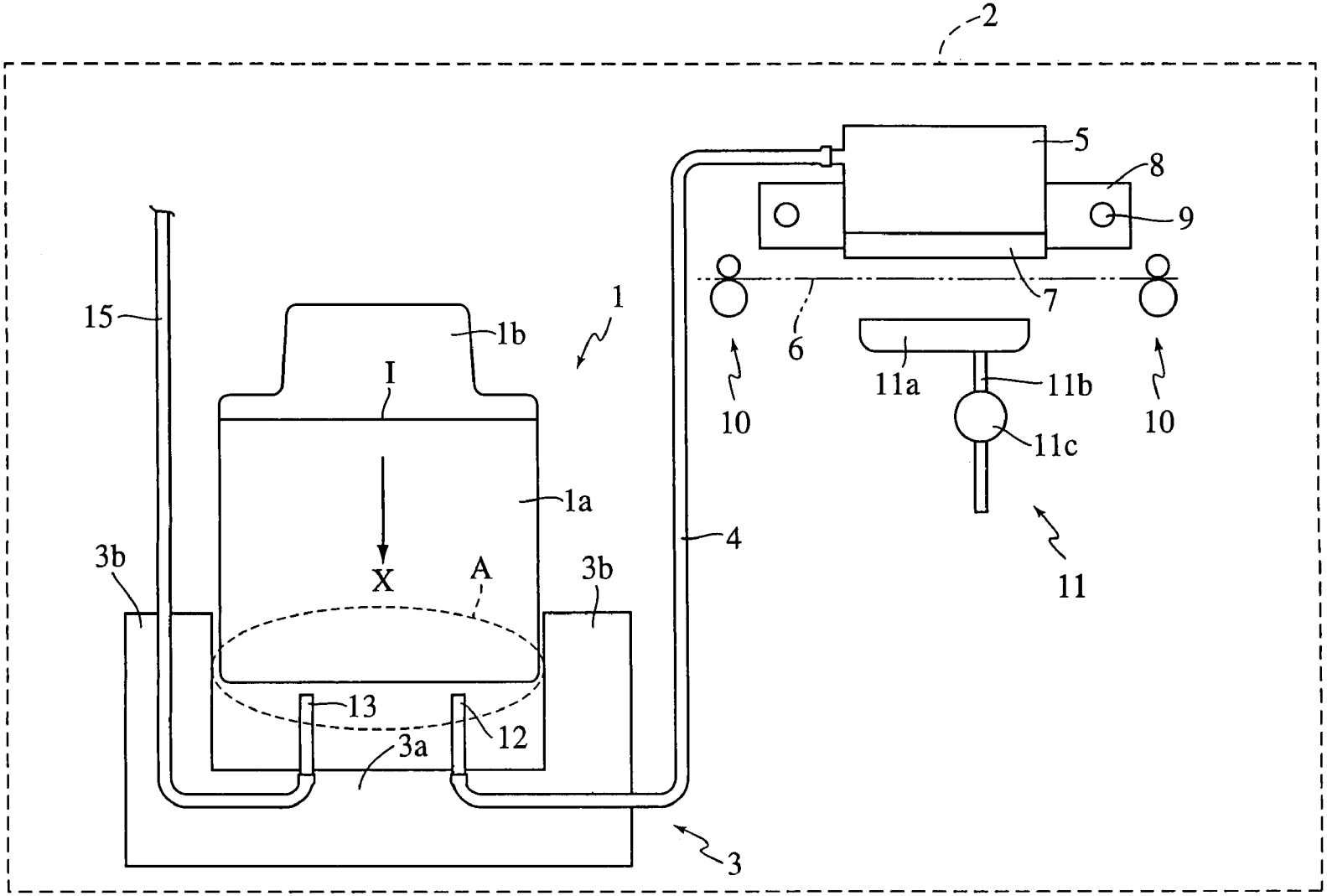
FIG. 1 is a schematic diagram of an exemplary ink cartridge according to the present invention and an exemplary inkjet recording apparatus according to the present invention on which the ink cartridge is mounted.

FIG. 1 is a schematic view showing an ink cartridge 1 according to an embodiment of this invention and an inkjet recording apparatus 2 to which the ink cartridge 1 mounts.

The ink cartridge 1 is formed so as to be detachable with respect to the inkjet recording apparatus 2 that is provided with a recording head 7 which ejects ink I. The ink cartridge 1 stores the ink I to be supplied to the recording head 7. One of a plurality of ink colors, such as cyan, magenta, yellow, black, or the like, is filled in the ink cartridge 1 as ink I, and a plurality of ink cartridges 1 that are filled with different ink colors are mounted to the inkjet recording apparatus 2. Color printing is thus made possible.

The inkjet recording apparatus 2 is provided with a mounting part 3 which detachably mounts the ink cartridge 1, a tank 5 which stores the ink I supplied from the ink cartridge 1 via an ink supply tube 4, the recording head 7 which emits the ink I stored in the tank 5 to recording sheet 6, a carriage 8 in which the tank 5 and the recording head 7 are mounted and which is movable in two linear directions, a carriage shaft 9 which is a guide by which the carriage 8 moves in the two linear directions, a transport mechanism 10 which transports the recording sheet 6, and a purge device 11.

The mounting part 3 is composed of a base part 3*a* that is sandwiched by a guide part 3*b* which is set on both sides of the base part 3*a*. A hollow ink extracting tube 12 extracts the ink I stored in the ink cartridge 1 and a hollow outside air intake tube 13 introduces outside air to the ink cartridge 1. The ink extracting tube 12 and the air intake tube 13 are examples of extract components.

The ink supply tube 4 is connected with one end side of the ink extracting tube 12, and the ink extracting tube 12 is connected to the tank 5 via the ink supply tube 4. The outside air intake tube 15 is connected to one end side of the air intake tube 13, and the outside air intake tube 13 is connected to outside air via the outside air intake tube 15.

The ink cartridge 1 is mounted from a direction (arrow X direction) perpendicular to the mounting part 3. At this time, the ink extracting tube 12 and the air intake tube 13 contact a valve member 32 (see FIG. 2) of the respective valve devices 18,19 which is provided inside of the ink cartridge 1, push the respective valve members 32 up toward an ink chamber 16, and communicate with the inside of ink chamber 16.

A plurality of nozzle holes are provided in the recording head 7 on a surface to be opposite the recording sheet 6. By driving an actuator composed of piezoelectric elements, the ink I stored in the tank 5 is emitted from the nozzle holes to the recording sheet 6. Furthermore, if a recording operation is actually performed, recording is performed onto the recording sheet 6 as the carriage 8, which mounts the recording head 7, moves back and forth.

Furthermore, the recording head 7 is arranged above the mounting part 3. A negative pressure (back pressure) is thus given to the ink I within the nozzle holes due to the pressure head difference between the ink cartridge 1 mounted in the mounting part 3 and the nozzle holes.

A purge device 11 is outside the recording area and arranged so as to face the recording head 7. The purge device 11 is provided with a purge cap 11*a* which covers a nozzle hole formation surface of the recording head 7, a waste ink tube 11*b* which communicates with the purge cap 11*a*, and a pump 11*c* which intakes ink from the nozzle holes via the waste ink tube 11*b*.

When the purge processing is performed, the cartridge 8 is moved to a purge processing executing position, and the nozzle hole formation surface of the recording head 7 is covered by the purge cap 11*a*. In this state, by driving the pump 11*c*, poor ink that includes bubbles, dust or the like remaining inside the recording head 7 is vacuumed. The poor ink is then stored in an undepicted waste ink tank via the waste ink tube 11*b*. The recording operation and the purge process are controlled under a central processing unit (CPU) (not shown) mounted on the inkjet recording apparatus 2.

The ink cartridge 1 includes a container wall 1*a* in which the upper/lower end surfaces are open, and a lid 1*b* which is fixed in order to cover and seal the opening on the top surface of the container wall 1*a*. Furthermore, the container wall 1*a* and the lid 1*b* are formed of a resin material. The ink I to be supplied to the recording head 7 is stored in the ink chamber 16 formed inside the ink cartridge 1 (see FIG. 2).

Figure 2:
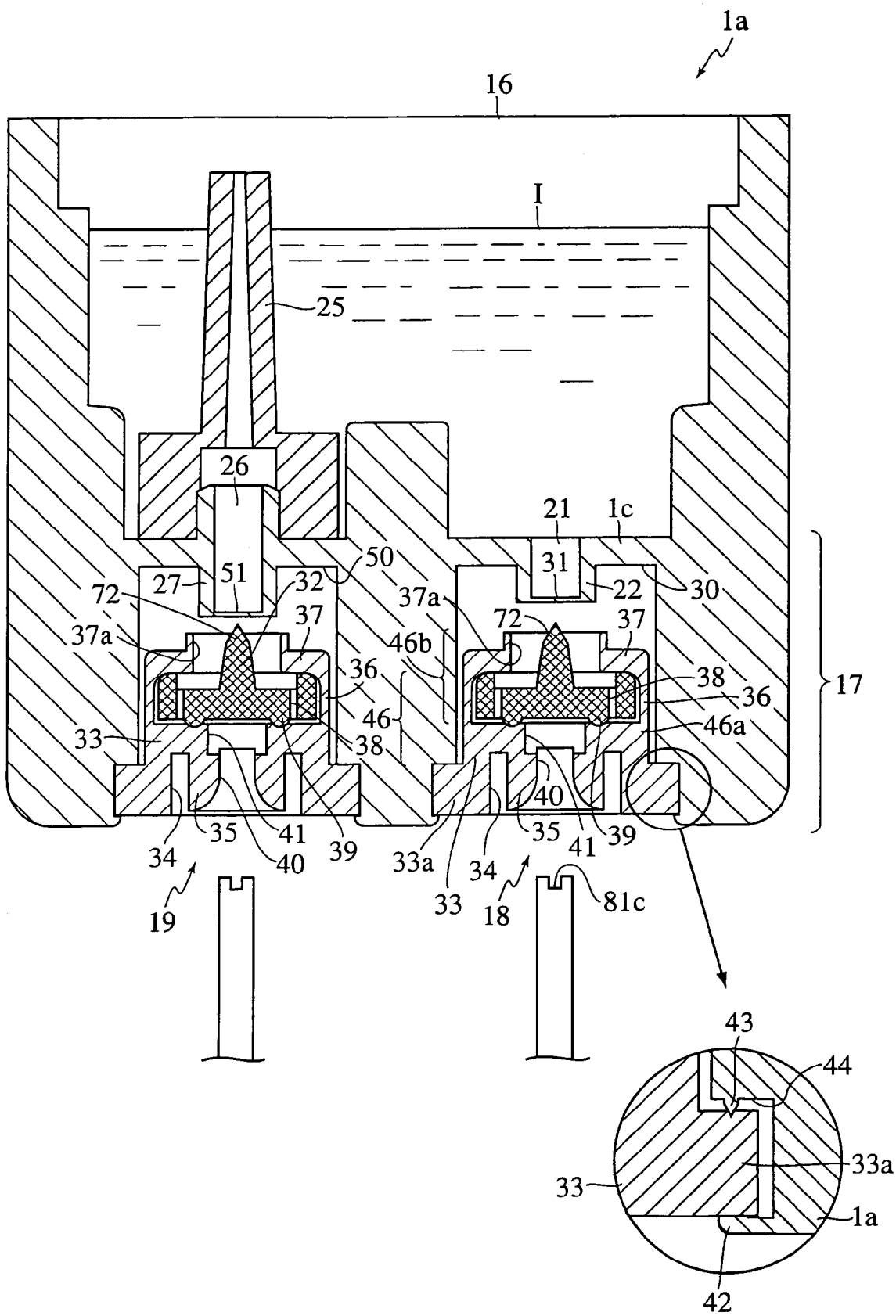
FIG. 2 is a sectional diagram showing the structure of an exemplary ink cartridge according to the present invention before the ink cartridge is loaded into an inkjet recording apparatus.
Figure 3:
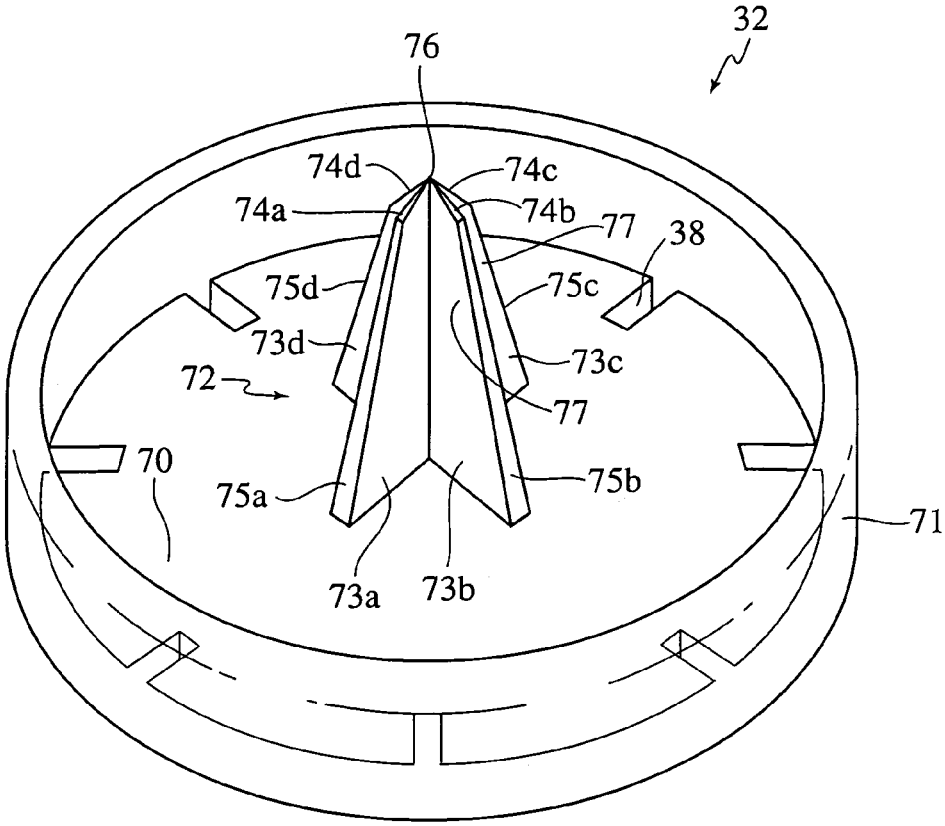
FIG. 3 is an oblique perspective view of an exemplary valve member according to the present invention.

Next, the structure of the ink cartridge 1, in particular part A of FIG. 1, which is installed in the inkjet recording apparatus 2 is explained with reference to FIGS. 2 and 3. FIG. 2 is a sectional diagram showing the structure of the ink cartridge before the ink cartridge is loaded into the inkjet recording apparatus and FIG. 3 is an oblique perspective view that illustrates the enlarged valve member.

As shown in FIG. 2, a partition wall 1*c* divides the inside of the ink cartridge 1 into two spaces and is formed integrally with the container wall 1*a*. Within these two spaces, the space between the partition wall 1*c* and the top opening covered by the lid 1*b* (i.e., the top half) is formed as the ink chamber 16 which stores ink, and the space between the partition wall 1*c* and the lower opening (i.e., the bottom half) is formed as a second chamber 17.

An ink supply port 21 for communicating with the ink chamber 16 and the second chamber 17 is formed in the partition wall 1*c*. A thin film member 31, which can be broken when the ink supply port 21 is closed, is formed of a resin material integrated with the container wall 1*a* at the lower end portion of a cylindrical wall 22 which extends from the partition wall 1*c* and surrounds the ink supply port 21. Furthermore, an air intake opening 26 for communicating with the ink chamber 16 and the second chamber 17 is formed in the partition wall 1*c*, and a thin film member 51 which can be broken when the air intake opening 26 is closed is formed of a resin material integrated to the container wall 1*a* at the lower end portion of a cylindrical wall 24 which depends from the partition wall 1*c* and surrounds the air intake opening 26. Thus, when the ink cartridge 1 is transported, the ink chamber 16 is sealed by the thin film members 31,51, and it is possible to prevent the ink within the ink chamber 16 from leaking to the second chamber 17 via the ink supply port 21 and the air intake opening 26.

Furthermore, a barrel member 25 is arranged so as to protrude into the ink chamber 16 from the air intake opening 26. Outside air is introduced to the upper part of the ink chamber 16 via the air intake opening 26 and the barrel member 25.

On the partition wall 1*c*, a barrel-shaped body 30 as an example of a communication chamber, which extends toward the opening of the second chamber 17, is connected and formed so as to protrude into the second chamber 17 from the partition wall 1*c* and surround the cylindrical wall 22. In addition, on the partition wall 1*c*, a second barrel-shaped body 50 as an example of a communication chamber, which extends toward the opening of the second chamber 17, is connected and formed so as to protrude into the second chamber 17 from the partition wall 1*c* and surround the cylindrical wall 24.

To make the space between a later-described pointed part 72 and the film member 51 smaller than the space between the pointed part 72 and the film member 31, the cylindrical walls 22 and 24 are formed such that the amount that the cylindrical wall 24 extends from the partition wall 1*c* is larger than the amount that the cylindrical wall 22 extends from the partition wall 1*c*.

The valve device 18 is fixed inside the barrel-shaped body 30 and the valve device 19 is fixed inside the second barrel-shaped body 50. The valve devices 18,19 can selectively communicate between the inside and the outside of the ink chamber 16 and cut off communication between the inside and the outside of the ink chamber 16.

Here, the valve device 18 is explained. The valve device 19, which is fixed to the second barrel-shaped body 50, has the same shape as the valve device 18. As such, only a detailed explanation of the valve device 18 will be provided.

The valve device 18 is provided with a support member 46 which is integrally manufactured by a rubber elastic member and the valve member 32 composed of a resin material. The support member 46 has a substantially cylindrical shape and is integrally molded and includes a valve seat part 46*a* in the intermediate part in the axial direction, an urging part 46*b* that is closer to the ink chamber 16 than the valve seat part 46*a*, a cylindrical part 35 which extends from the valve seat part 46*a* toward a side opposite the urging part 46*b*, and an outer circumferential wall 33 which extends parallel to, and is spaced from, the outer circumference of the cylindrical part 35. In other words, the valve seat part 46*a* and the urging part 46*b* are integrally formed as a one-piece member. The valve member 32 is housed within the urging part 46*b*, and is urged by the urging part 46*b* toward the valve seat part 46*a*.

The valve device 18 has a positioning part 33*a* which protrudes from the outer circumferential wall 33 to an outer circumferential external direction towards the barrel-shaped body 30. The barrel-shaped body 30 is formed so that a part of the barrel-shaped body 30 has a smaller external diameter than that of the positioning part 33*a*. A step-shape is thus formed in the barrel-shaped body 30 that contacts the positioning part 33*a*.

As shown in the enlarged diagram in FIG. 2 in which the fixed parts of the valve device 18 and the barrel-shaped body 30 are enlarged, the barrel-shaped body 30 has a surface 44 with the diameter becoming larger in tiers outwardly in order to contain the positioning part 33*a*. A projection 43 is formed on the surface 44 and is above the positioning part 33*a*. A holding wall 42 is also provided and projects inwardly around the opening of the barrel-shaped body 30 of the container wall 1*a*. When the valve device 18 is inserted into the barrel-shaped body 30, the holding wall 42 holds and presses the positioning part 33*a* into the projection 43 while being deformed and bent by heat. The combination of the holding wall 42 and the projection 43 thus fixes and seals the valve device 18 relative to the barrel-shaped body 30. By doing so, ink is prevented from flowing out from the space formed between the external wall of the valve device 18 and the inner wall of the barrel-shaped body 30.

The valve seat part 46*a* has an opening 41 which goes through the center in the axial direction. When the ink cartridge 1 is mounted to the inkjet recording apparatus 2, the cylindrical part 35 seals the ink extracting tube 25 inserted therein. The cylindrical part 35 is provided with an introducing path 40 in which the ink extracting tube 12, which is protruding from the inkjet recording apparatus 2, is inserted. The cylindrical part 35, as an example of an inner peripheral wall, is integrally connected with the valve seat part 46*a* in a state in which the introducing path 40 is connected to the opening 41. The valve member 32 contacting the valve seat part 46*a* is exposed to the outside through the opening 41 and the introducing path 40, and faces the ink extracting tube 12 inserted therein. The introducing path 40 is formed smaller than the outer diameter of the ink extracting tube 12 so as to closely fit to the inserted ink extracting tube 12. The opening 41 is formed larger than the outer diameter of the ink extracting tube 12. An end of the introducing path 40, from which the ink extracting tube 12 is inserted, is formed in a tapered shape in which the diameter increases towards the outside.

The cylindrical part 35 and the outer circumferential wall 33, as an example of an outer peripheral wall, are separated by a predetermined distance by a ring-shaped groove 34. The cylindrical part 35 is made elastically deformable in a plane perpendicular to the direction of the center axis of the introducing path 40 with respect to the outer circumferential wall 33. As a result, it is easy to expand the cylindrical part 35 in accordance (in the Y direction in FIG. 5) with the insertion of the ink extracting tube 12 into the introducing path 40, such that the fit between the introducing path 40 and the ink extracting tube 12 is improved. Leakage of the ink is thereby prevented. In addition, even if the ink extracting tube 12 is inserted diagonally or offset to the introducing path 40, the ink extracting tube 12 can be inserted to the introducing path 40 due to the deformation of the cylindrical part 35. Furthermore, in accordance with the insertion of the ink extracting tube 12 to the introducing path 40, the inner wall part of the introducing path 40 is slightly pushed toward the valve member 32 and thus elastically deforms. However, such deformation is absorbed in the space in the opening 41 having a large diameter, and thus, the valve member 32 is not pushed.

Furthermore, the cylindrical part 35 is formed with a length that cannot reach the lower edge of the outer circumferential wall 33. In other words, the edge of the ink extract tube 12 is inserted. Thus, the remaining ink in the cylindrical part 35 does not soil the surface of a flat surface when the valve device 18 is placed on that flat surface.

The urging part 46*b* is formed by a side wall part 36 which stands out in a cylindrical shape on the ink chamber 16 side from the outer circumference of the valve seat part 46*a* and a projection part 37 which extends from the side wall part 36 and extends inward so as to contact the ink chamber 16 side of the valve member 32. The urging part 46*b* is also provided with an opening 37*a* in the center of the projection part 37. The urging part 46*b* urges the valve member 32 based on the elasticity of the side wall part 36 and the projection part 37. In a normal state before the ink cartridge 1 is mounted to the inkjet recording apparatus 2, the valve member 32 contacts the valve seat part 46*a*. When the ink cartridge 1 is mounted to the ink jet recording apparatus 2, the ink extracting tube 12 enters the introducing path 40 and pushes the valve member 32 up toward the ink chamber 16 so that the side wall part 36 is extended, the projection part 37 is inclined, and a gap for an ink flow path is formed between the valve member 32 and the valve seat part 46*a*.

The radial thickness t1 (see FIG. 5A) of the side wall part 36 (perpendicular to the axial direction mentioned above) is formed thinner than the thickness t2 (see FIG. 5A) of the valve seat part 46*a* in the intruding direction of the ink extracting tube 12 to the introducing path 40 and the radial thickness of the outer circumferential wall 33. For this reason, if the valve member 32 is pushed up by the ink extracting tube 12, the urging part 46*b* allows for a larger elastic deformation as compared to the valve seat part 46*a* and the outer circumferential wall 33, which forms a clearance between the valve member 32 and the valve seat part 46*a*.

The valve member 32 in FIG. 3 is explained next. The valve member 32 is provided with a bottom part 70 which contacts the valve seat part 46*a* of the support member 46, a valve side wall part 71 which extends in a cylindrical shape toward the ink chamber 16 from the outer circumference of the bottom part 70, and a pointed part 72, which projects toward the ink chamber 16 in the substantially center part of the bottom part 70, and on which the tip end on the ink chamber 16 side is formed in a pointed shape (e.g., an acuminate shape). The pointed part 72 projects closer to the ink chamber 16 than the valve side wall part 71 extends.

The bottom part 70 has a projecting component 39 (see FIG. 2) which projects toward the valve seat part 46*a* and is formed circularly on a surface edge set up against the valve seat part 46*a*. The projecting component 39 is also located inside the valve side wall part 71 and outside the introducing path 40. While the valve member 32 is contained in the support member 46, the valve side wall part 71 closely contacts the lower surface of the projection part 37 of the urging part 46*b* and is pressed. Due to such pressing, the projecting component 39 deforms the valve seat part 46*a* elastically and closely contacts the upper surface of the valve seat part 46*a*.

In the bottom part 70, circumferentially inward with respect to the valve side wall part 71 and circumferentially outward with respect to the opening 41, a plurality of communication paths 38 are formed which communicate with the ink chamber 16 side of the valve member 32 and the valve seat part of the valve member 32. In this example, eight communication paths 38 are formed, however, the number is not specifically limited and any number can be formed.

The pointed part 72 consists of four plate components 73*a*-73*d* which are positioned in the approximate center of the bottom part 70 and are combined in the form of an approximate cross. The plate components 73*a*-73*d* form grooves 77 extending in parallel and along the axial line between the plate components 73*a*-73*d* located next to each other. Each of the plate components 73*a*-73*d* are, in the direction to the bottom part 70 from the tip 76, equipped with first slope units 74*a*-74*d* which slope at a first angle (for example, approximately "45 degrees" in this example) against the central axial line extending in the same direction and second slope units 75*a*-75*d*, next to the first slope units 74*a*-74*d*, which have a second angle (for example, approximately "10 degrees" in this example), which is more acute compared to the first angle, in the direction to the bottom part 70 from the first slope units 74*a*-74*d*.

The pointed part 72 projects through the opening 37*a* of the projection part 37 and is positioned opposite the film member 31 with the tip 76 spaced at an interval from the film member 31. When the ink cartridge 1 is mounted to the inkjet recording apparatus 2, as the ink extracting tube 12 pushes up the bottom part 70 of the valve member 32, the thin film member 31 breaks, and an ink flow path is formed which goes through the ink supply port 21, the opening 37*a*, the communication paths 38, and the ink extracting tube 12.

When the ink cartridge 1 is detached from the inkjet recording apparatus 2, the bottom part 70 and the valve seat part 46*a* are connected by an urging force of the urging part 46*b*, and the ink flow path is cut off.

Furthermore, when the ink cartridge 1 is mounted to the inkjet recording apparatus 2, an air intake tube 13, which is arranged by being protruded from the inkjet recording apparatus 2, is inserted into the valve device 19. In the same manner as the above-mentioned ink supply, an outside air flow path is formed which goes through the air intake opening 26, the opening 37*a*, the communication paths 38, and the air intake tube 13. At approximately the same time, when the ink cartridge 1 is detached from the inkjet recording apparatus 2, an outside air flow path is cut off by the urging force of the urging part 46*b*.

Figure 4:
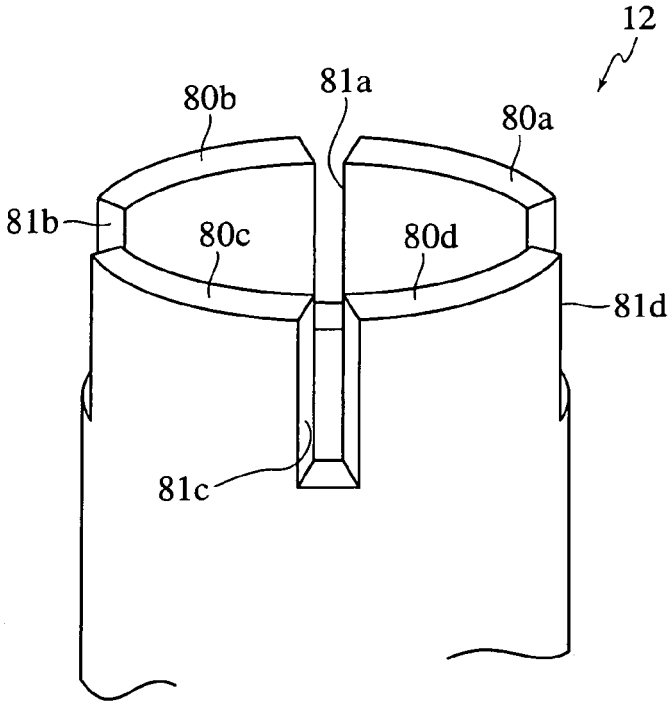
FIG. 4 is an oblique perspective view of a tip part of an exemplary ink extract tube according to the present invention.

Next, the ink extract tube 12 and the air intake tube 13 are explained by referring to FIG. 4. FIG. 4 is an oblique perspective figure that illustrates the configuration of the neighboring area of the tip part on the side of the ink extract tube 12. Furthermore, the ink extract tube 12 and the air intake tube 13 are structured in the same configuration and dimensions, and therefore, the explanations are made about the ink extract tube 12 and the explanations about the air intake tube 13 are omitted.

The edge of the tip of the ink extract tube 12 on the side of the valve member 32 is open, and a contact section with the valve member 32 consists of end sections 80*a*-80*d* formed on the approximate plane. And the communicating passages 81*a*-81*d* are formed in the shape of grooves cut on the external wall of the ink extract tube 12. These communicating passages 81*a*-81*d* are formed at approximately even intervals on the external wall of the ink extract tube 12. Note that in this example, four communicating passages 81*a*-81*d* are formed however, any number can be formed.

The ink extract tube 12 has the end sections 80*a*-80*d* formed on the approximate plane, and can press the contact surface of the valve member 32 approximately evenly when it contacts with the valve member 32. Therefore, tilting of the valve member 32 is avoided and the valve member 32 can constantly maintain the ink passage at a certain level. The communicating passages 81*a*-81*d* are cut and are formed such that even if the ink extract tube 12 is in contact with the valve member 32, the passage of the ink through the communicating passages 81*a*-81*d* can be reliably obtained.

Furthermore, since the tip of the ink extract tube 12 is formed on the approximate plane, even if the ink extract tube 12 is installed in a projected state from the installation unit 3, the user will not be hurt by touching the ink extract tube 12 because the tip is no longer formed in an acuminate shape as before.

The valve device 19, positioned in the second barrel-shaped body 50 on the side of the air intake, uses exactly the same components as the valve device 18 on the side of ink supply mentioned above, fixed in a similar way. Each part of the air intake tube 12 is in a similar dimensional relationship to that of the air intake tube 13, and therefore, detailed explanations are omitted.

Figure 5A:
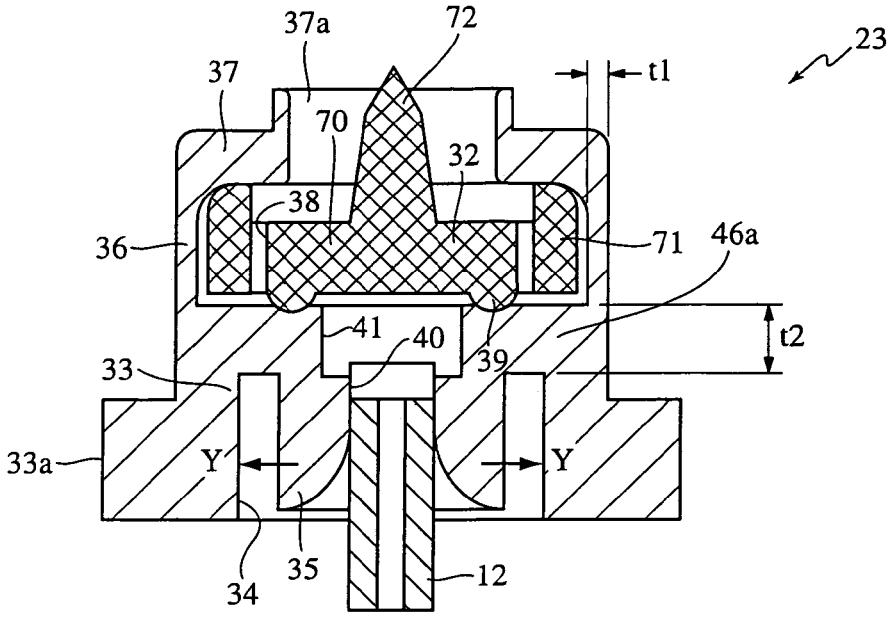
FIG. 5A is a sectional view of an exemplary ink extract tube according to the present invention before the ink extract tube enters into a guide path and contacts an exemplary valve member according to the present invention.
Figure 5B:
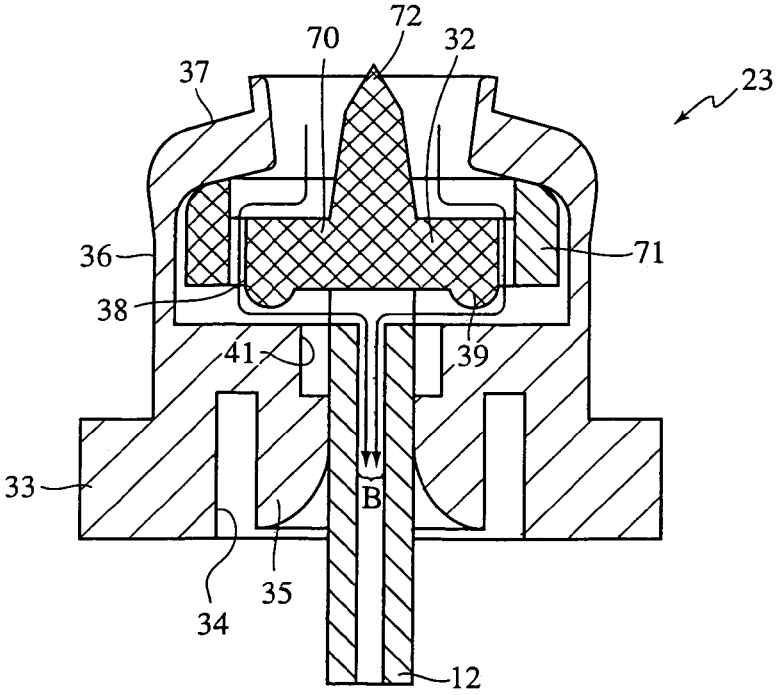
FIG. 5B is a cross-section view of an exemplary ink extract tube according to the present invention contacting an exemplary valve member according to the present invention and pushing the valve member toward an ink chamber.

Here, the motion of the valve device 18, when the ink cartridge 1 is loaded into the inkjet recording apparatus 2, is explained by referring to FIGS. 5A and 5B. When the ink cartridge 1 is loaded into the mounting part 3, the ink extract tube 12 intrudes into the introducing path 40 (FIG. 5A), and closely contacts the inside of the introducing path 40 in a state that blocks the outflow of the ink. When the ink extract tube 12 and the valve member 32 contact each other and the valve member 32 is pushed towards the ink chamber 16 (FIG. 5B), the valve member 32 is separated from the valve seat part 46*a* by resisting the elasticity of the urging part 46*b*. In addition, when the valve member 32 is pushed up, the tip 76 of the pointed part 72 contacts the film member 31 and ruptures the film member 31. As a result, the ink in the ink chamber 16 is supplied to the barrel-shaped body 30, when the ink enters into the opening 37*a* at the top end of the valve device 18, passes through the communication paths 38 of the valve member 32, between the lower surface of the valve member 32 and the upper surface of the valve seat part 46*a*, into the communicating passages 81*a*-81*d* of the ink extract tube 12 (the ink passage B), and is supplied to the recording head 7. As for the motion of the pointed part 72 to rupture the film member 31, further explanations are given below.

At approximately the same time when the ink extract tube 12 mentioned above intrudes, the air intake tube 13 enters into the valve device 19 on the side of second barrel-shaped body 50 and pushes up the valve member 32. Since the space between the film member 51 and the tip 76 of the pointed part 72 is smaller than the space between the film member 31 and the tip 76 of the pointed part 72, the thin film 51 is ruptured first as compared to the film member 31 on the side of the ink extract tube 12. In general, the ink cartridge 1 is packed in a decompressed state in order to keep the ink in the ink cartridge 1 in a deaerated state and the ink chamber 16 under a reduced pressure as well. As mentioned above, by rupturing the film member 51 on the side of the air intake tube 13 quickly, the film member 31 on the side of the ink extract tube 12 is ruptured after the air is led to the upper part of the ink chamber 16 through the barrel member 25. The supply of the ink to the ink extract tube 12 is thus ensured. If the film member 31 on the side of the ink extract tube 12 is ruptured too early, the air enters into the ink passage of the ink extract tube 12 which prevents a smooth supply of the ink.

When the ink cartridge 1 is pulled up from the installation unit 3 in order to remove the loaded ink cartridge 1 from the inkjet recording apparatus 2, the ink extract tube 12 and the air intake tube 13 are separated from each of the corresponding valve members 32. At the same time, each valve member 32 returns to a state of closely contacting with the valve seat part 46*a* due to the biasing operation of the urging part 46*b*. At this point, since the circular projecting component 39 is installed on the surface set up against the valve seat part 46*a*, the ink chamber 16 is reliably sealed in order to prevent ink from leaking. In addition, the ink I remaining near the opening 41 of the valve seat part 46*a* on the side of the ink extract tube 12 is maintained at that position forming a meniscus and does not leak outside since the atmospheric pressure does not apply to the ink on the upper side because the upper part is blocked by the valve member 32 and the diameter of the introducing path 40 is small (approximately 2 mm in diameter).

Next, FIGS. 6A-6F show how the film member 31 is ruptured by the pointed part 72. The film member 51 is ruptured in the same manner as the film member 31, and therefore, such explanations are omitted.

Figure 6F:
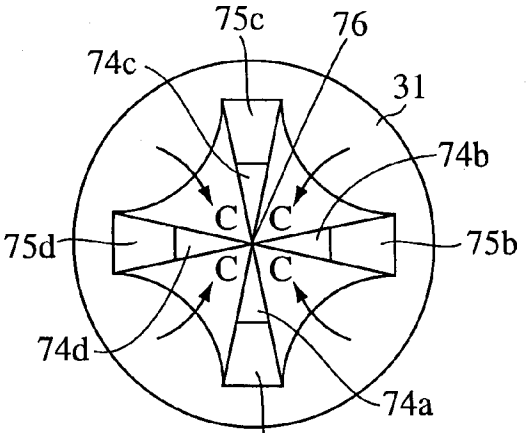
FIGS. 6D, 6E and 6F are tops views corresponding to FIGS. 6A, 6B and 6C, respectively.
Figure 6E:
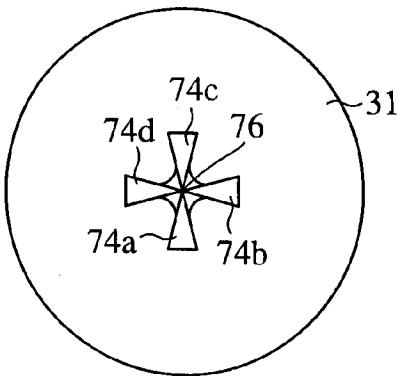
Figure 6D:
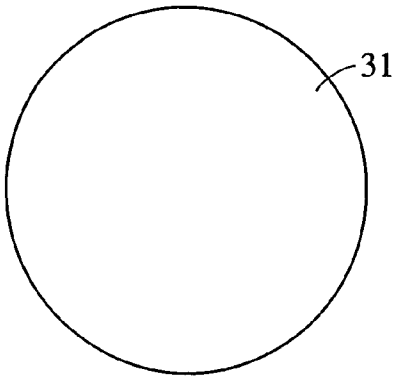
Figure 6C:
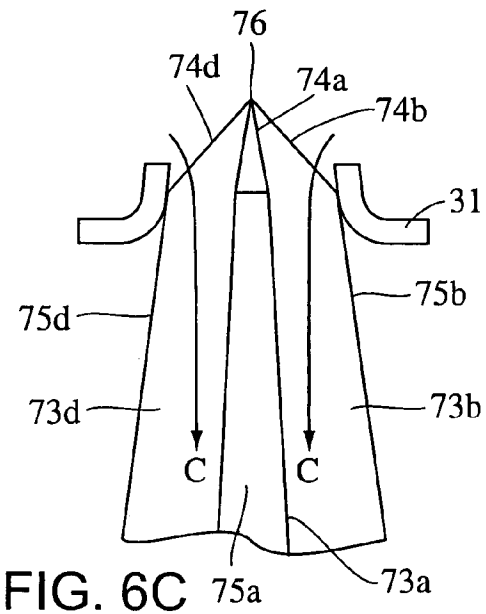
FIGS. 6A, 6B and 6C are side views depicting rupture of a film member by an exemplary valve member according to the present invention.
Figure 6B:
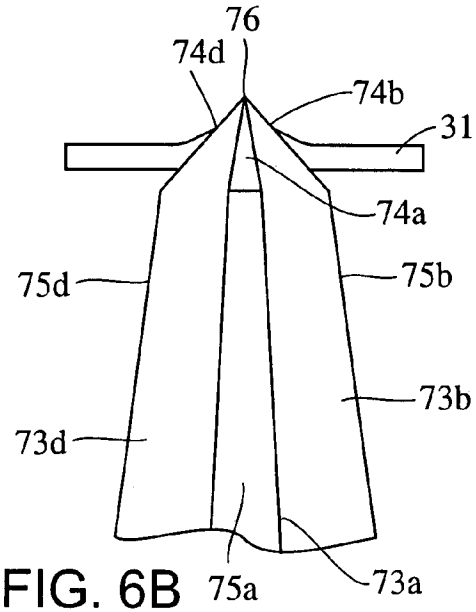
Figure 6A:
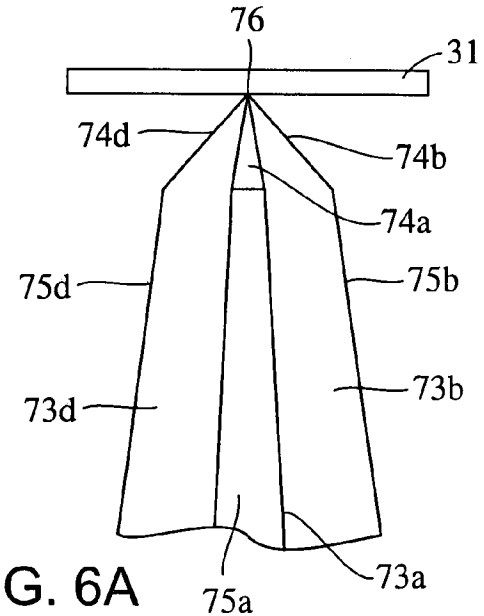

FIG. 6A shows the state where the pointed part 72 is pushed up together with the valve member 32 towards the ink chamber 16 and the tip 76 closely contacts with the film member 31. In this state, the film member 31 is not ruptured yet (the state of FIG. 6D).

FIG. 6B shows the state where the pointed part 72 is pushed up further and the film member 31 is ruptured by the first slope units 74*a*-74*d*. The film member 31 thus only contacts the first slope units 74*a*-74*d* of the pointed part 72. Since the film member 31 contacts the first slope units 74*a*-74*d* along the upper surface thereof, the groove 77 is blocked in this state and the passage of the ink is hardly formed (see FIG. 6E).

FIG. 6C shows the ink cartridge 1 completely loaded into the inkjet recording apparatus 2, and the film member 31 is pushed and widened by the second slope units 75*a*-75*d* of the pointed part 72. Because of this, as shown in FIG. 6F, the groove 77 between each plate component 73*a*-73*d* is released and the ink passage C connecting the ink chamber 16 and the ink extract tube 12 is formed. The ink passage C is also formed at approximately even intervals around the circumference of the pointed part 72. It is thus possible to supply the ink to the ink extract tube 12 almost evenly.

When the film member 31 is pushed and widened by the second slope units 75*a*-75*d* instead of the first slope units 74*a*-74*d*, the curving angle of the ruptured part of the film member 31 changes and the ruptured part is separated from the groove 77 between the plate components 73*a*-73*d*, and the ink passage is formed as mentioned above. Furthermore, since the amount of contact between the film member 31 and the plate components 73*a*-73*d* becomes lower, when the ink cartridge 1 is removed, the pointed part 72 and the film member 31 are reliably separated by the biasing of the urging part 46*b*.

As explained above, based on the ink cartridge mentioned above, the valve member 32 which has a pointed part 72 with the tip formed in an acuminate shape to rupture the film member 31 is retained by the support member 46, and such support member 46 is fixed in the barrel-shaped body 30. Because of this, when the ink cartridge 1 is loaded into the inkjet recording apparatus 2, the valve member 32 is pushed up towards the ink chamber 16 by the ink extract tube 12. At the same time, the film member 31 is ruptured and the ink passages B and C, which connect the ink chamber 16 and the ink extract tube 12, are formed. Therefore, it is not necessary to form the tip of the ink extract tube 12 in an acuminate shape, which can prevent the user from being hurt by the ink extract tube 12 and thus, can further improve the safety.

Furthermore, since it is not necessary to form the tip of the ink extract tube 12 in an acuminate shape, it is also not necessary to newly position a preventative device that covers the ink extract tube 12. It is thus possible to prevent the inkjet recording apparatus from becoming large-scaled and at the same time, since the number of components does not increase, an increase in production cost can be prevented.

This invention has been explained based on the examples as mentioned above. However, this invention is not limited to the examples explained above and it can be easily assumed that various improvements and modifications are possible.

For example, in the above examples, the outside dimensions of the valve devices 18 and 19 are set a little smaller than the inside dimensions of the barrel-shaped bodies 30 and 50, and they are fixed by being pressed by the holding wall 42. However, it is acceptable to make the outside dimensions of the valve devices 18 and 19 a little bigger than the inside dimensions of the barrel-shaped bodies 30 and 50 and fix them by pushing the valve devices 18 and 19 into the barrel-shaped bodies 30,50.

And also, in the examples mentioned above, the communicating passages 81*a*-81*d* are formed by cutting the ink extract tube 12 and the air intake tube 13 including the tip on the side of the ink chamber 16. However, it is acceptable to form the communicating passages 81*a*-81*d* communicating with the inside and the outside on the side wall of the ink extract tube 12 and the air intake tube 13.

Furthermore, in the examples mentioned above, the valve member 32 is formed as a unit with the pointed part 72 with the tip formed in an acuminate shape, the bottom part 70 and the valve side wall part 71. However, it is acceptable to form the breaking unit to rupture the film component and the valve which communicate and block off the ink chamber 16 side and the outer side of the container wall 1*a* separately.

Figure 7:
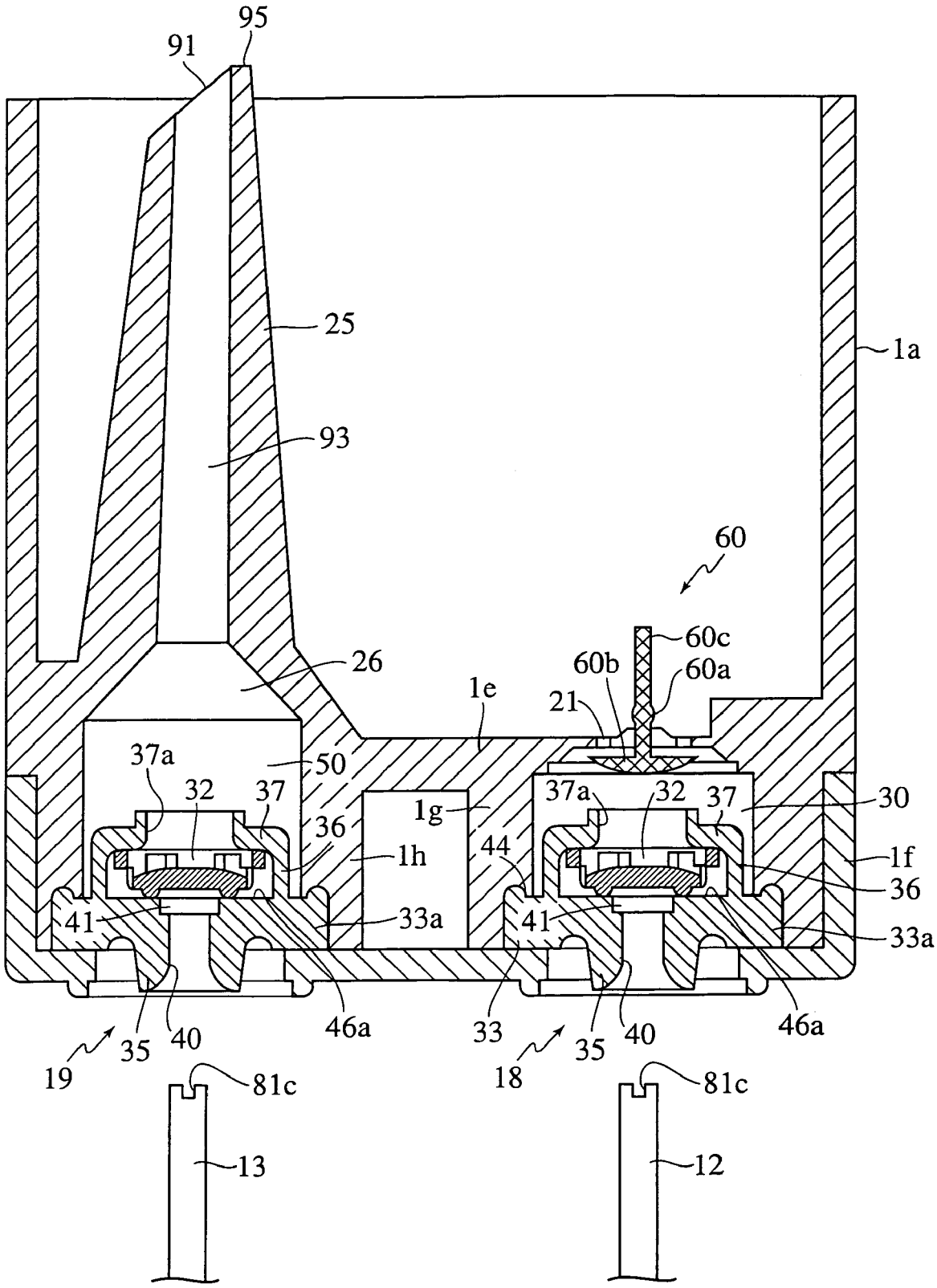
FIG. 7 is a sectional diagram showing the structure of an exemplary ink cartridge according to the present invention before the ink cartridge is loaded into an inkjet recording apparatus.

FIG. 7 illustrates an ink cartridge according to a second embodiment of the invention. It is noted that elements similar to or identical with those in the first embodiment are designated by similar numerals, and thus the description thereof can be omitted for the sake of brevity.

The ink cartridge 1 of the second embodiment includes the ink chamber 16 with an open top, the container wall 1*a*, and a cover 1*f* that covers the floor area 1*e*. The ink cartridge 1 also includes two walls 1*g* and 1*h* that form the barrel-shaped bodies 30 and 50 which are open downward. The valve device 18 is placed in the barrel-shaped body 30 and the valve device 19 is placed in the barrel-shaped body 50. The valve device 18 and the valve device 19 are identical and when they are attached to the inkjet recording device, the ink extracting tube 12 is inserted into the barrel-shaped body 30 and the air intake tube 13 is inserted into the barrel-shaped body 50.

Similar to the first embodiment, the valve device 18 and 19 have the support member 46 made of rubber-like flexible part material and the valve member 32 is made of resin. The support member 46 has basically the same structure as the support member 46 of the first embodiment, but the outer circumferential wall 33 does not extend as far as the cylindrical part 35 in the first embodiment. The outer circumferential wall 33 and positioning part 33*a* are both formed almost at the same level as the valve seat part 46*a*. The positioning part 33*a* is fixed at the lower end of cylinder shape walls 1*g* and 1*h*, between the surface 44 that is formed as a part of the barrel-shaped bodies 30 and 50 and cover 1*f*. With this arrangement, the valve devices 18 and 19 are fixed on the container wall 1*a*.

FIGS. 8A-8E show the details of the valve member 32. The valve member 32 consists of the bottom part 70 and the valve side wall part 71 which extends vertically from the external circumference of the bottom part 70. The communication paths 38 are formed in the external circumference of the bottom part 70 and in the valve side wall part 71 contiguously at a plurality of positions. At one side of each of the communication paths 38, a protruding part 59 with a substantially rectangular shape rises at a right angle out of the bottom part 70 with one side of the protruding part 59 touching the valve side wall part 71. If the opening part of the communications paths 38 has a round shape, the round shape prevents smooth ink flow because the round shape tends to form a meniscus due to the surface tension of the ink. In order to avoid the formation of meniscus, the opening part may not have a round shape. Another effective method is to use multiple surfaces for the opening areas.

Figure 8A:
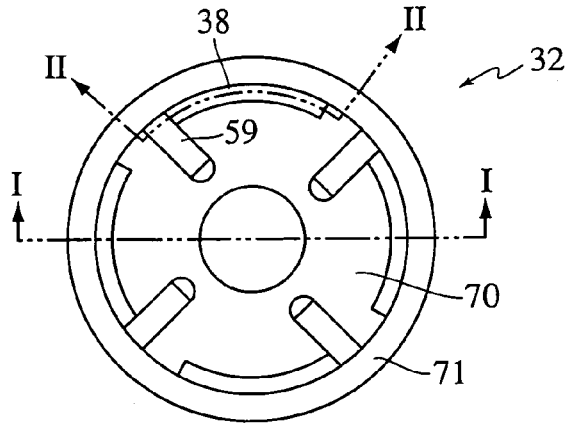
FIGS. 8A-8E depict an exemplary valve member according to the present invention.
Figure 8B:
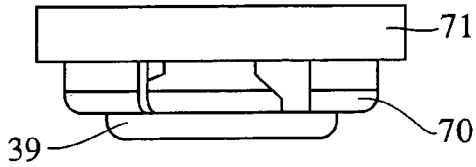
Figure 8C:
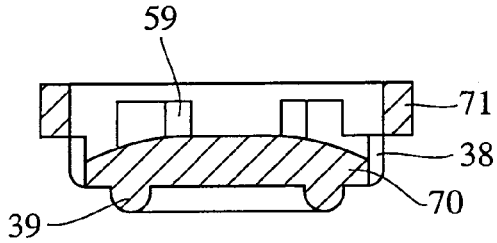
Figure 8D:
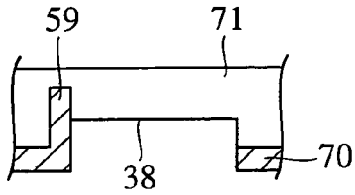
Figure 8E:
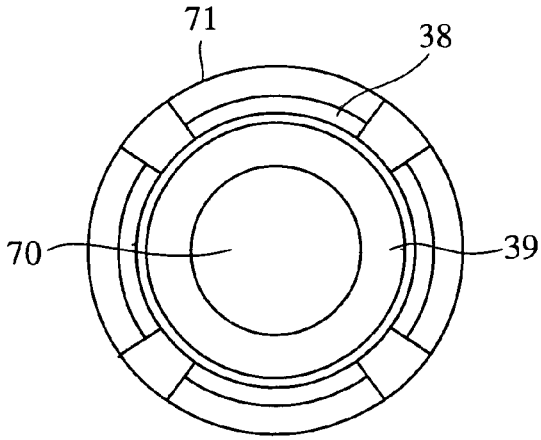

The ridge line of the communication paths 38 as shown in FIG. 8C is formed in an arc shape and also covers two surfaces that cross at a right angle with the bottom part 70 and the valve side wall part 71.

Moreover, the rectangular projection part 59 is formed along one of the ridge lines of the communication paths 38, rising vertically out of the opening part of the linked communication paths 38. Therefore the opening part of the communication paths 38 consists of the surface formed of the protruding part 59, the surface formed by the bottom part 70, and the surface formed by the valve side wall part 71. With this structure, the opening part becomes complex and thus prevents the formation of a meniscus. Where the bottom part 70 touches the valve seat part 46*a*, the projecting component 39 is formed in a ring-shape at an area closer to the center of the bottom part 70 than the communication paths 38 but external to the opening 41. When the valve member 32 is closed, the valve member 32 presses against the valve seat part 46*a*.

In the second embodiment, the air intake opening 26 includes a tapered portion above the barrel-shaped body 50. A barrel member 25 extends from the tapered portion at the floor 1*e* toward an upper end of the cartridge 1. The barrel member 25 includes an opening 91 at an upper end. When the cartridge 1 is filled with ink and situated in an upright alignment, the opening 91 is positioned above the ink surface level in the ink chamber 16. In various exemplary embodiments, an upper face 95 of the barrel member 25, including the opening 91, is inclined or slanted with respect to horizontal. In some such embodiments, the upper face 95 has a stepped configuration, such that the upper face 95 includes multiple surfaces, the surfaces defining at least two different planes. As a result of the slant or inclination of the upper face 95 of the barrel member 25, a cross sectional area of the opening 91 of the barrel member 25 taken at the slanted or inclined upper face 95 is greater than a horizontal cross sectional area of an interior portion 93 of the barrel member 25. In addition, a horizontal diameter of the interior portion 93 of the barrel member 25 is preferably at least about 0.8 mm.

The slanted, inclined or stepped configuration of the opening 91 of the barrel member 25, as well as the diameter of the interior portion 93 of the barrel member 25, prevent an ink meniscus from forming in the event that ink from the ink chamber 16 contacts the opening 91, if, for example, the cartridge 1 is positioned other than in an upright alignment. It is advantageous to prevent formation of such an ink meniscus in the opening 91, because, if an ink meniscus is formed, the process of supplying ink during operation of the image recording apparatus 2 will cause the meniscus to repeatedly break and reform. This breaking and reforming of the meniscus results in a repeating variation of an internal pressure of the cartridge 1. Such variation can adversely affect print quality.

In various exemplary embodiments, the barrel member 25 is formed integrally with the remainder of the ink chamber 16. Such an integral structure obviates the necessity for multiple manufacturing steps to form and join the ink chamber 16 and the barrel member 25. Accordingly, the time and cost necessary to manufacture cartridges, such as disclosed herein, are reduced.

The ink supply port 21 at the ink supply side has the anti-counter flow valve 60. The anti-counter flow valve 60 consists of an umbrella shaped flexible membrane part 60*b* that faces the lower surface of the ink supply port 21 and a spindle part 60*c* that supports one end of the membrane part 60*b*. Both the membrane part 60*b* and the spindle part 60*c* are formed into one shape using synthesized resin material. The spindle part 60*c* is inserted through the ink supply port 21 so that the flow valve 60 can slide up and down. Normally, the membrane part 60*b* is positioned at a distance from the ink supply port 21, and an extended part 60*a* touches the top surface of the floor wall 1*e*. Ink is thus allowed to smoothly flow from the ink chamber 16 toward the valve device 18. When ink starts to flow from the ink extraction tube 12 toward the ink chamber 16, the membrane 60*b* will rise and block the ink supply port 21 and thus stop the flow of ink.

As described earlier, the ink chamber 16 is packaged at reduced pressure. As such, when the ink cartridge 1 is attached to the inkjet recording device 2, if the valve device 18 is opened before the valve device 19, it is possible that ink already present in the ink extract tube 12 will flow from the ink extract tube 12 toward the ink chamber 16. Such flow of ink toward the ink chamber 16 will also draw ink present in the recording head 7, to which the ink extract tube 12 is connected, toward the ink chamber 16. Drawing ink present in the recording head 7 toward the ink chamber 16 can disrupt ink meniscuses present in nozzle holes of the recording head 7. Disruption of the meniscuses can adversely affect print quality. If the valve device 18 is opened before the valve device 19 when air is present in the ink extract tube 12, such air may flow from the ink extract tube 12 toward, and possibly into, the ink chamber 16. Such flow of air into the ink chamber 16 will adversely affect the deaerated state of the ink present therein possibly reducing print quality. To prevent such backflow of air or ink, the anti-counter flow valve 60 is used.

At the time of attachment, when the ink cartridge 1 is mounted on the mounting part 3, the ink extracting tube 12 is inserted into the introducing path 40 and pushes the valve member 32 upward. The valve member 32 in turn pushes the projection part 37 of the urging part 46*b* upward, and subsequently the side wall part 36 extends and the valve member 32 detaches from the valve seat part 46*a*. As a result, the ink in the ink chamber 16 is supplied to the ink extracting tube 12 through the communication paths 38 of the valve member 32 and the communicating passages 81*a*-81*d* of the ink extract tube 12. At the same time, the air intake tube 13 is connected with barrel-shaped body 50, letting the outside air flow into the ink chamber.

Unlike the first embodiment, film members 31,51 are not used and accordingly a pointed part 72 is not used to rupture the film members 31,51. As such, when the valve member 32 is pushed up, ink exists in the barrel shaped bodies 30,50. However, since the circular projecting component 39 is urged against the valve seat part 46*a* by the projection part 37, the ink chamber 16 and the top of the barrel shaped bodies 30,50 are reliably sealed in order to prevent ink from leaking.

Figure 9A:
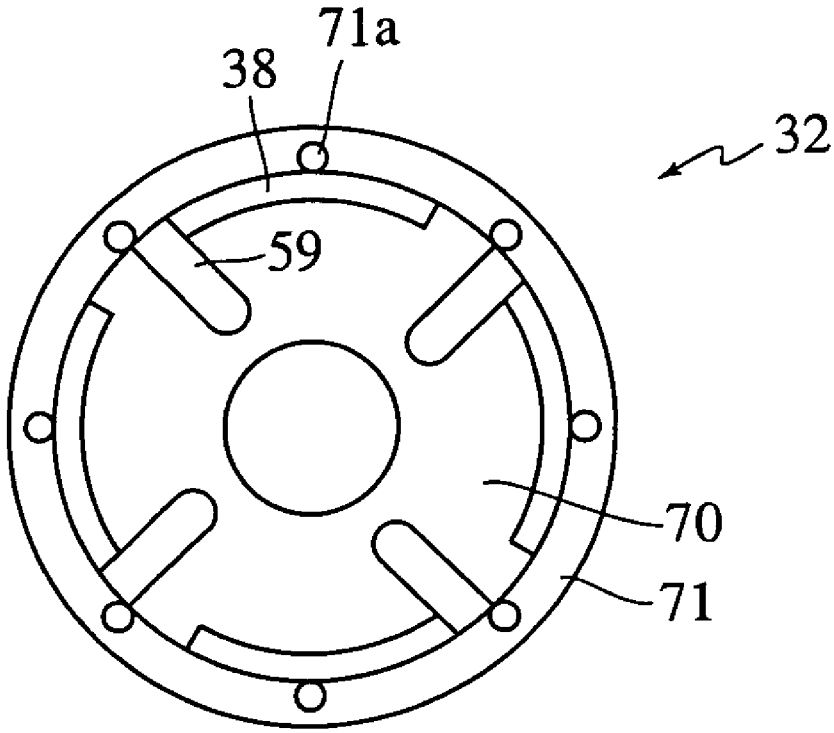
FIGS. 9A and 9B depict an exemplary valve member according to the present invention.
Figure 9B:
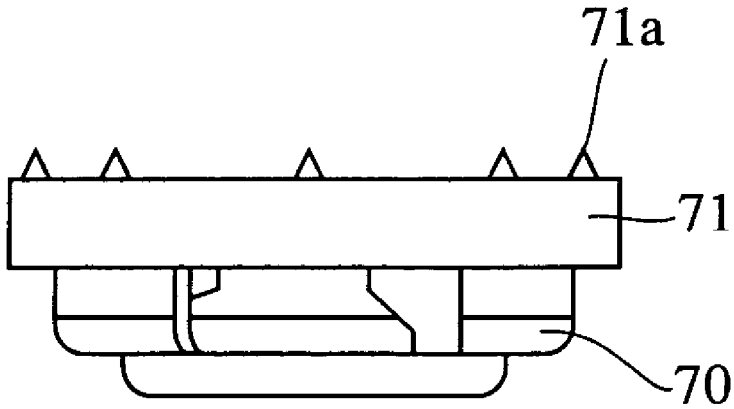

FIGS. 9A and 9B show a variation of the valve member 32 shown in FIG. 8. As noted above, when the ink cartridge 1 is installed on the mounting part 3, the ink extracting tube 12 and air intake tube 13 push the valve member 32 upward, and the valve member 32 in turn pushes the projection part 37 of the urging part 46*b* installed in the support member 46.

On the other hand, because there are disparities in the length of the ink extracting tube 12 and the air intake tube 13, and there are also disparities in distance from the bottom of the ink cartridge 1 to the valve member 32 depending on many other parts. The overall disparity can thus become relatively large. When the disparity is large, and when the ink cartridge 1 is installed to the mounting part 3, the valve member 32 may be pushed up close to the opening 37*a* of the projection part 37 and may be caught by the opening 37*a*. When the ink cartridge 1 is detached from the mounting part 3 at this state, the valve member 32 is not in contact with the valve seat part 46*a*, thus causing the ink to leak.

In order to prevent this, in this variation, several pointed projections 71*a* are attached to the valve side wall 71 of the valve member 32 as shown in the FIG. 9, so that the function between the top of the valve side wall 71 and the projection part 37 is increased and they remain attached even if the urging part 46*b* is extended.

Figure 10:
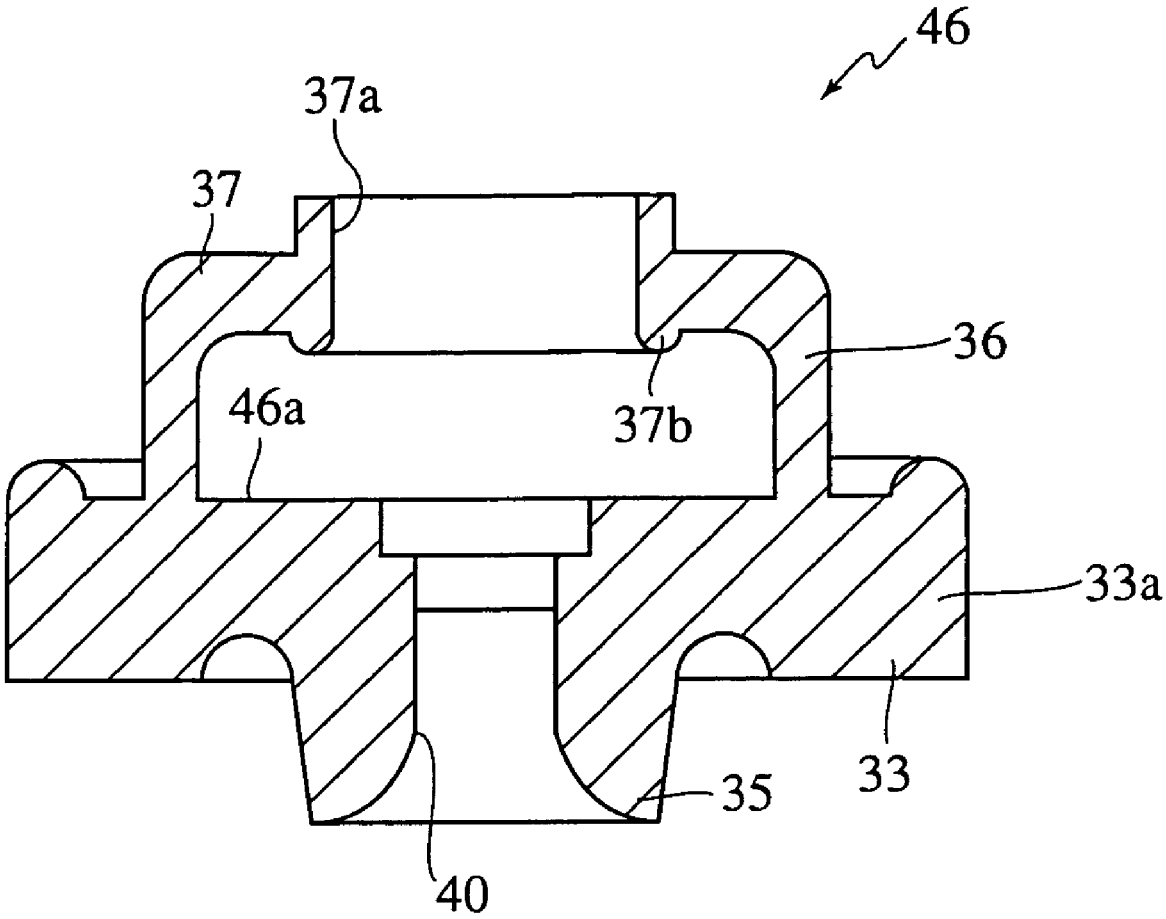
FIG. 10 is a sectional view of a holding member of an exemplary valve member according to the present invention.

FIG. 10 shows a ring-shaped projection 37*b* on the projection part 37 of the support member 46, which is added to achieve the same effect as noted above. This ring-shaped projection 37*b* is attached to circular valve side wall 71 of the valve member 32.

Based on these structures, and by adding the matching concave or convex parts on the valve member 32 and the projection part 37, both parts are prevented from making corresponding circular movements, thus preventing the valve member 32 from not returning to the closed position.

Figure 11A:
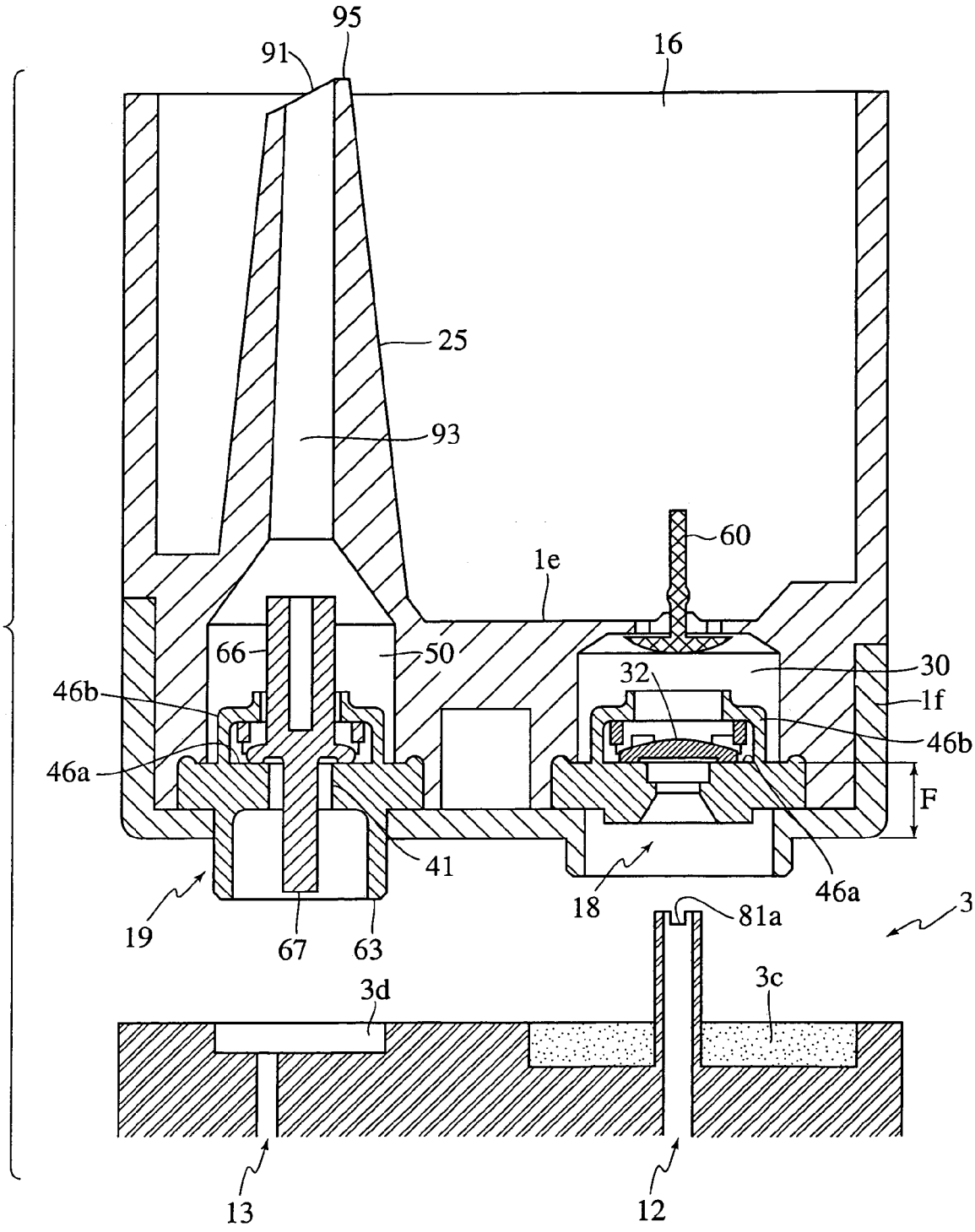
FIGS. 11A and 11B are sectional views of an exemplary ink cartridge according to the present invention.
Figure 11B:
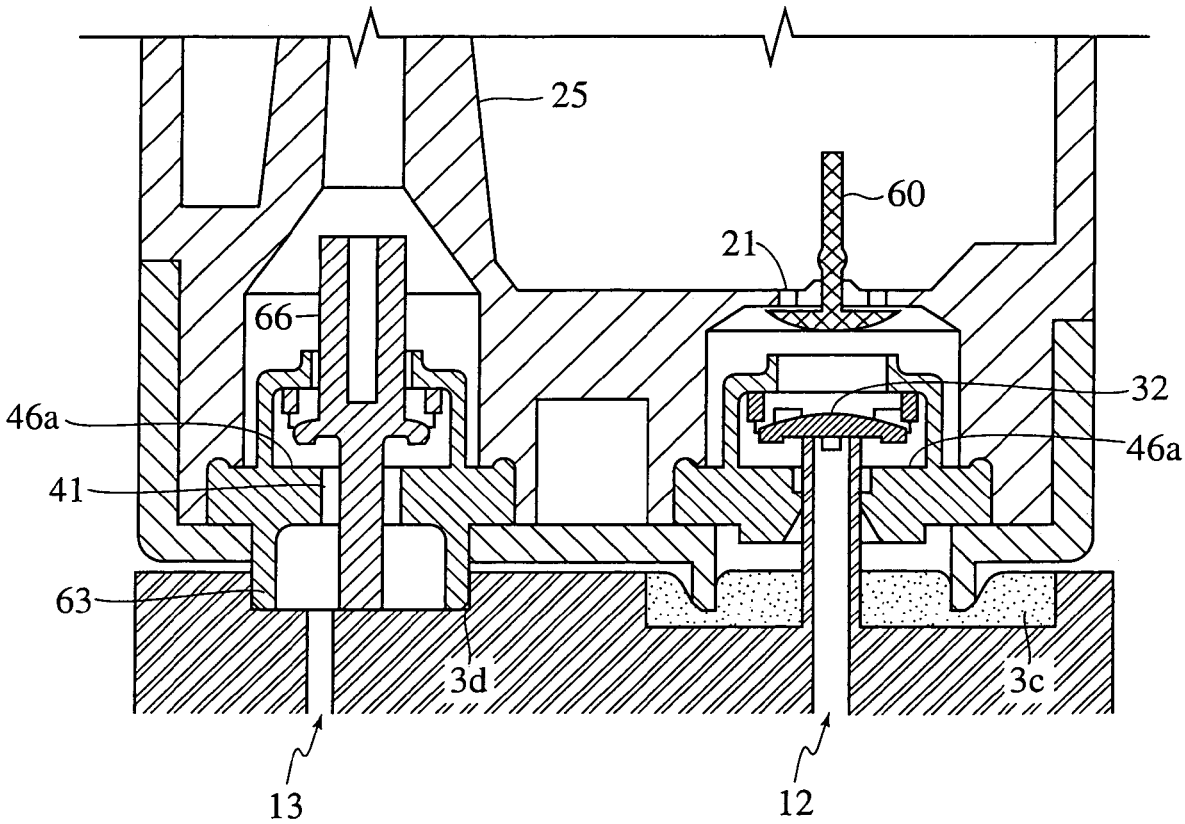

FIGS. 11A and 11B are cross-sections of the ink cartridge 1 and the mounting part 3 of the third embodiment. In this embodiment, the valve device 19 and the mounting part 3 of the ink jet recording device 2 differ from the second embodiment shown in FIG. 7. Since the valve device 18 is the same, the explanation of the valve device 18 is omitted.

The valve device 19 is equipped with the support member 46 and the valve member 32. The support member 46 is assembled using a rubber-like elastic material just as the support member 46 in the first and second embodiments, and is equipped with the valve seat part 46*a* and an urging part 46*b* on the top part. The structures of these parts are identical with the valve seat part 46*a* and the urging part 46*b* of the first and second embodiments.

In the middle of the valve seat part 46*a*, the opening 41 is formed to expose the center of the valve member 32 to the outside and, in the lower portion, a sealing part 63 which surrounds the opening 41 is projected toward the opposite side of the urging part 46*b*.

In the embodiments, the distance F from the bottom wall of the cover 1*f* and a contact point of the valve member 32 and the valve seat part 46*a* is 4.5 mm. In some embodiments, the distance F is less than about 4.5 mm. In some embodiments, the distance F is about 4.5 mm. In further embodiments, the distance F can vary from 4.5 mm by ±0.5 mm or ±1 mm.

Figure 12A:
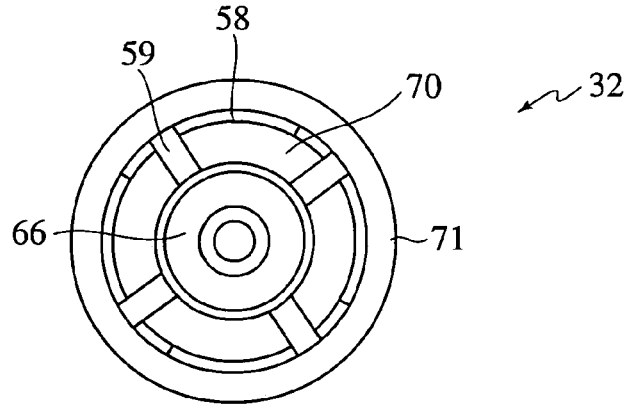
FIGS. 12A-12C depict the valve member of FIGS. 11A and 11B.
Figure 12B:
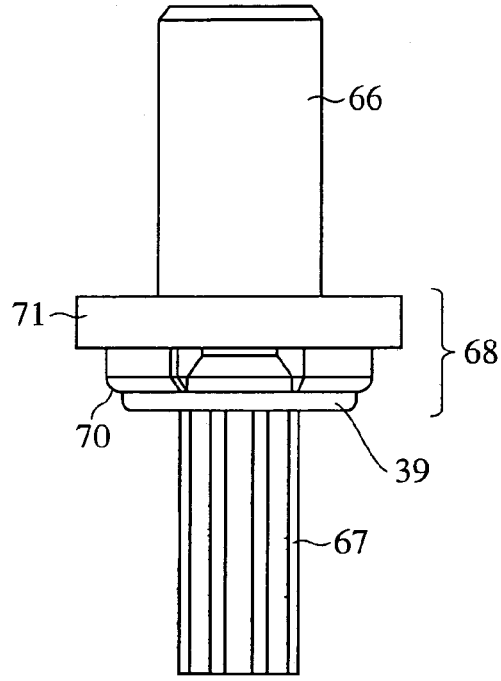
Figure 12C:
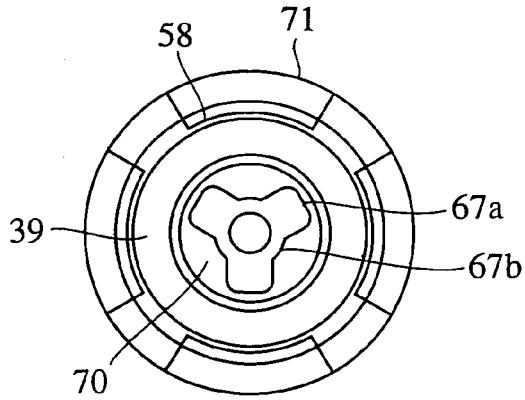

FIG. 12 shows the detail of the valve member 32. Just as the valve member shown in the FIG. 8, the valve member 32 is equipped with a valve 68 consisting of the bottom part 70 and the valve side wall part 71. The explanation of the detailed construction including communication paths 38 and projecting part 59 is omitted since they are explained in reference to FIGS. 8A-8E.

In this example, the bottom part 70 is attached with a cylindrical part 66 which stands vertically from the top surface. When the ink cartridge 1 is installed on the mounting part 3 in a normal manner and the valve member 32 is pushed upward from the valve seat part 46*a*, the top edge of the cylindrical part 66 is positioned apart from the inside surface of the barrel member 25 and thus the through-pass between the ink chamber 16 and the opening 41 of the valve seat part 46*a* is secured.

The bottom part 70 is attached with the operating member 67 which extends vertically from the opening 41 on the side being exposed. Several concave portions 67*a* and convex portions 67*b* are formed on the outer circumference of the operating member 67, which extend along the direction of the axis. This configuration, in which the operating member 67 is attached to, or formed integrally with, the valve member 32, provides distinct advantages over arrangements in which the operating member 67 is separate from the valve member 32. For example, in order for an operating member 32 to operate a valve, the operating member must be positioned in cooperation with the valve member 32. In configurations in which the operating member 67 is separate form the valve member 32, the position of the operating member 67 with respect to the valve member 32 must be carefully controlled because misalignment of the operating member 67 with respect to the valve member 32 could result in leakage and/or damage to the valve member 32. Such control is not necessary in configurations in which the operating member 67 is attached to, or formed integrally with, the valve member 32.

Moreover, in an apparatus including two or more valves (e.g., an ink cartridge with an air valve and an ink valve) that is used with a device (e.g., an image forming device) that communicates with the valves, it may be advantageous to provide valves of different types—that is, one or more valves can be provided having a configuration in which an operating member is attached to a valve member and one or more valves can be provided having a configuration in which an operating member is not attached to a valve member. In the instance in which a valve is provided having a configuration in which an operating member is not attached to a valve member, the operating member could be attached to the device at a specified location. As at least one of the valves includes an attached operating member, that valve would not be able to communicate with the device at the specified location because two operating members would be present. Such an arrangement will ensure that when the apparatus is installed in the device, each valve properly communicates with a respective region of the device.

FIG. 11A shows the state prior to the installation of the ink cartridge 1 onto the mounting part 3 of the ink jet recording device 2, and the lower edge of the operating member 67 is made so that it is positioned slightly above the lower edge of the sealing part 63. In this state, both the valve member 32 of valve device 18 and the valve member 32 of the valve device 19 are pressed against the valve seat part 46*a* of the support member 46 and thus each valve device is not released.

With respect to the mounting part 3 of the ink jet recording device 2, the ink extracting tube 12 is projected in the ink supplier part just as the first and second embodiments, and a porous body 3*c* such as sponge is attached around the ink extracting tube 12 so that the leakage of ink will be absorbed. In the outside air intake part, the convex part 3*d* is formed in such a way that it corresponds to the sealing part 63, and the air intake tube 13 is attached to the bottom surface of the concave part 3*d*.

As shown in FIG. 11B, when the ink cartridge 1 is installed, the tip of the ink extracting tube 12 pushes the valve member 32 of the valve device 18 just as in the first and second embodiments, thus releasing the valve device 18.

In the outside air intake part, the tip of the operating member 67 touches the bottom of the concave part 3*d*, and the valve seat part 46*a* is moved downward while the valve member 32 is fixed, releasing the valve device. At the same time, the bottom edge of the sealing part 63 is attached to the bottom of the concave part 3*d*, and a passage is formed between the air intake tube 13 and the ink chamber 16 through the released valve device 19.

In the third embodiment, the valve member 32 equipped with the operating member 67 is installed only in the valve device 19. However, the valve member 32 equipped with the operating member 67 may also be installed in the ink supply part so that the ink extracting tube 12 does not project to the mounting part 3.

Figure 13:
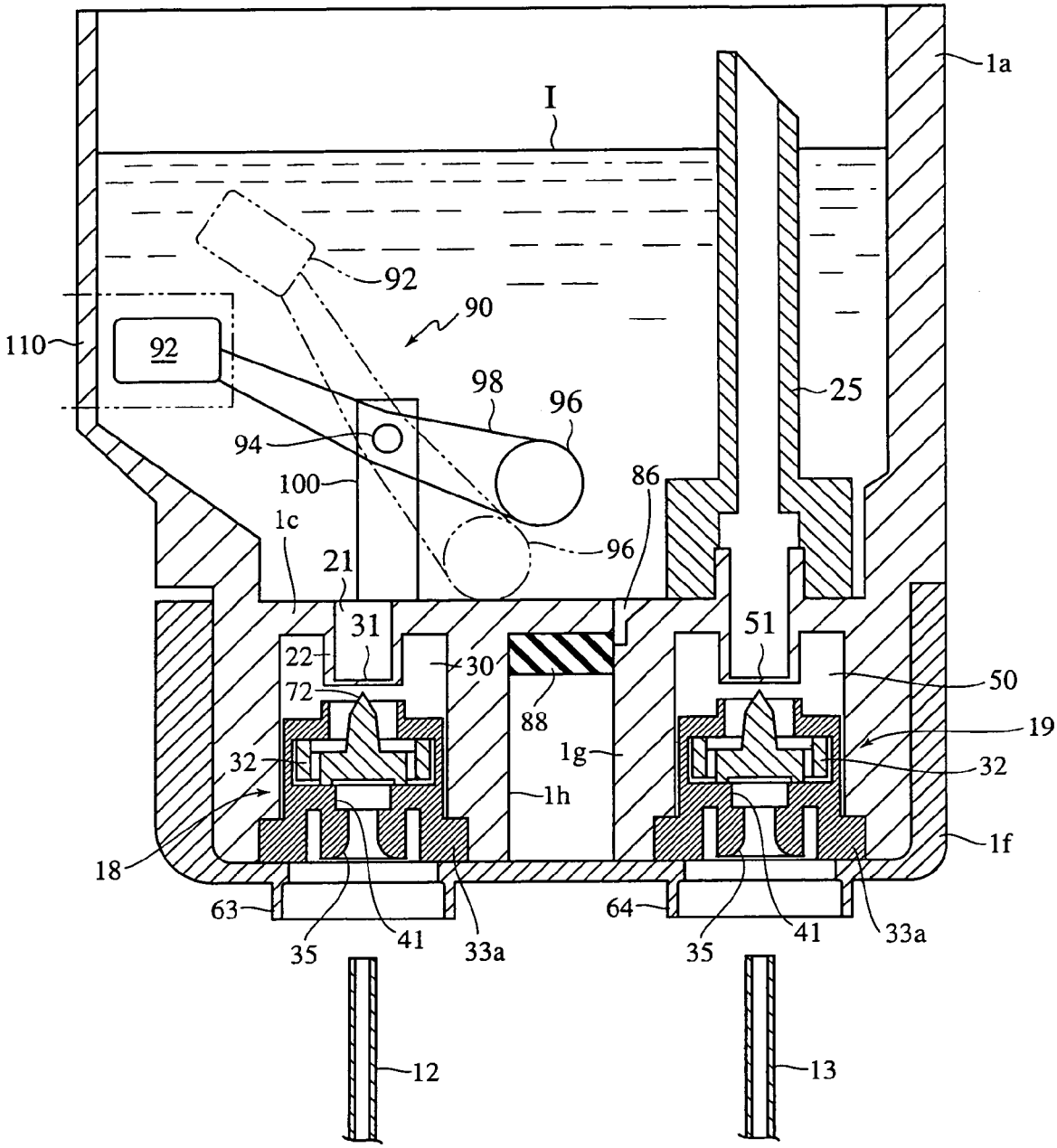
FIG. 13 is a sectional diagram showing the structure of an exemplary ink cartridge according to the present invention before the ink cartridge is loaded into an inkjet recording apparatus.

FIG. 13 is a sectional view of the ink cartridge 1 of a fourth embodiment. In this embodiment, a cover 1*f* covers a bottom area of the container wall 1*a* of the ink cartridge of FIG. 2. The ink cartridge 1 also includes two walls 1*g* and 1*h* similar to the ink cartridge 1 of FIG. 7 that form the barrel-shaped bodies 30 and 50 which are open downward. The valve device 18 is placed in the barrel-shaped body 30 and the valve device 19 is placed in the barrel-shaped body 50. The valve device 18 and the valve device 19 are identical to the valve devices of FIG. 2. Located opposite the positioning parts 33*a* of the valve devices 18 and 19, the cover 1*f* includes the sealing part 63 that covers the valve device 18 and the sealing part 64 that covers the valve device 19.

The ink cartridge 1 also includes an opening 86 that is formed in the partition wall 1*c* that allows ink I to be supplied to the ink chamber 16 during manufacturing. After the ink has been supplied to the ink chamber 16 and before the cover 1*f* is placed on the container wall 1*a*, a stopper 88 is placed against the partition wall 1*c* in order to cover the opening 86.

An ink detection level device 90 is located within the ink chamber 16. The ink detection level device 90 includes a support 100 that extends from the partition wall 1*c*, a blocking member 92 attached to an arm 98, a balance member 96 attached to an opposite end of the arm 98 and a pivot 94 attached to the support 100.

After the ink chamber 16 is filled with ink I, and when the ink cartridge 1 is held in an upright position, the blocking member 92 remains in the projection 110. While the blocking member 92 remains in the projection 110, a sensor (not shown) is able to detect the presence of the blocking member 92 so that a user is informed that the ink chamber 16 is full.

When the ink chamber 16 is emptied, the arm 98 rotates via the pivot 94 such that the balance member 96 eventually rotates toward and contacts the partition wall 1*c*. As such, the blocking member 92 eventually rotates to a position outside the indicated box area. The sensor is thus able to detect the absence of the blocking member 92 and inform the user that the ink chamber 16 is empty.

Figure 14A:
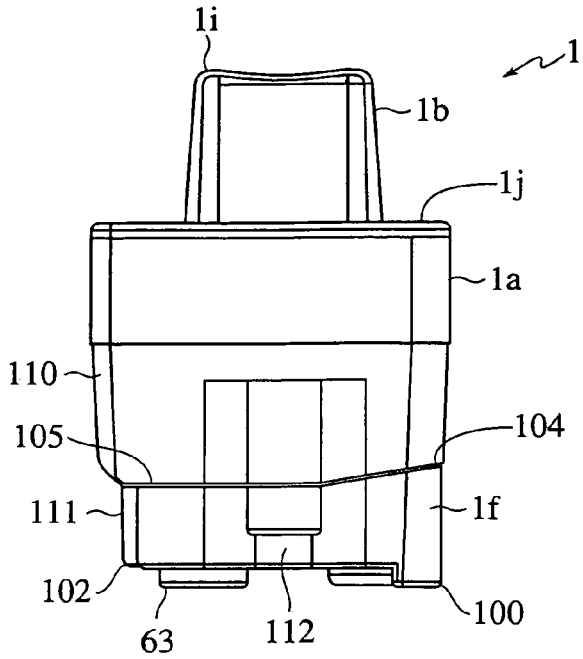
FIGS. 14A-14I depict an exemplary ink cartridge according to the present invention.
Figure 14B:
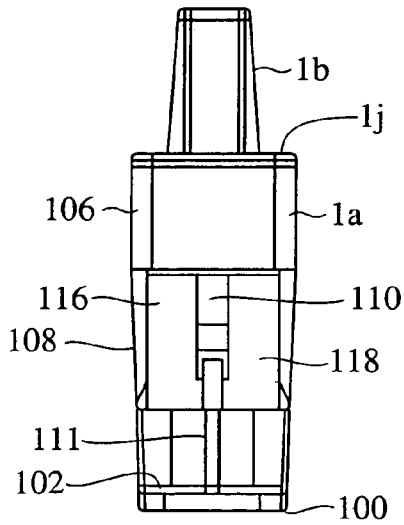
Figure 14C:
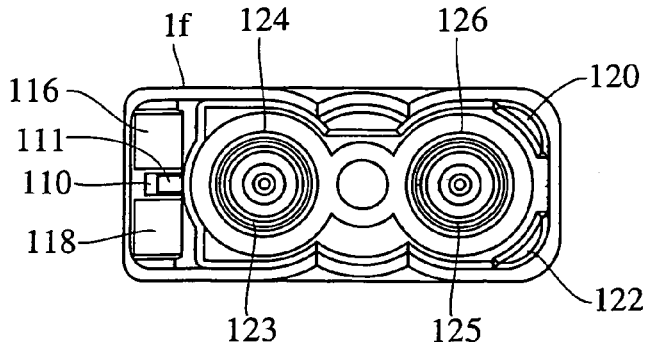

FIGS. 14A-14C are views of an ink cartridge 1 according to a fifth embodiment of the invention. In FIGS. 14A-14C, the exterior structure of the ink cartridge 1 is shown. FIG. 14A illustrates a side view of the ink cartridge 1; FIG. 14B illustrates an end view of the ink cartridge; and FIG. 14C illustrates a bottom view of the ink cartridge. The external structure of the ink cartridge 1 can accommodate the internal features of the various other embodiments of ink cartridges described in the present application, e.g., as shown in FIGS. 2,7,13, etc.

As shown in FIGS. 14A-14C, the ink cartridge 1 includes a container wall 1*a*, a cover 1*b* located on top of the container wall 1*a* and a bottom portion 1*f* located at the bottom of the container wall 1*a*.

The cover 1*b* includes a flat surface 1*j* located on top of the container wall 1*a* and a protrusion 1*i* that extends from the flat surface 1*j* so that a user can easily grasp the ink cartridge 1. The protrusion 1*i* has a tapered shape, such that the length and width of the protrusion is less at its uppermost portion than at its base, which adjoins the flat surface 1*j*.

The bottom portion if includes, at a right end as shown in FIG. 14A, a lip 100. The lip 100 includes a lowermost surface that protrudes from a bottom surface 102 of the bottom portion 1*f* and is flush with the lowermost surfaces of the sealing part 63. The bottom portion 1*f* also includes an inclined portion 104 that inclines upward in relation to an upper flat surface 105 of the bottom portion 1*f*. The bottom portion 1*f* further includes a lip 112 located at the center of the bottom portion 1*f* between the surfaces 102,105.

As shown if FIG. 14B, the container wall 1*a* includes an upper portion 106 and a lower portion 108. The lower portion 108 includes a container protrusion 110 extending vertically along and away from an end surface of the container wall 1*a*. The container protrusion 110 is surrounded on either side by canal portions 116 and 118. As should be appreciated, the protrusion 110 can be located anywhere as long as the protrusion 110 is located between a light-emitting portion and a light receiving portion of a sensor. Adjacent to a bottom end of the container protrusion 110 is a bottom portion protrusion 111, which extends vertically along and away from an end surface of the bottom portion 1*f*.

As shown in FIG. 14C, the bottom portion 1*f* includes engaging protrusions 120 and 122 located at the lip 100 with a space situated between each the engaging protrusions 120 and 122. As also shown in FIG. 14C, the bottom portion if includes an opening 123, in which an ink port 124 is provided. The bottom portion further includes an opening 125, in which an air communication port 126 is provided. As such, the ink cartridge 1 can be securely mounted in an image forming device. The various features shown in FIGS. 14A-14C and described above, and particularly the position, configuration and size of such features, are provided to ensure stability of the ink cartridge 1, when it is installed in an image forming device. Secure installation prevents movement of the cartridge during operation, and thus prevents leakage, introduction of impurities to the cartridge and other events that could ultimately adversely affect print quality.

FIGS. 14D-14I illustrate various dimensions of the ink cartridge 1 of FIGS. 14A-14C, the various dimensions permitting secure installation of the ink cartridge in an image forming device. It should be appreciated that, in some instances, alternative dimensions are provided. The present inventors have contemplated that in a four-color printing system (e.g., a cyan-magenta-yellow-black (CMYK) color printing system), one color may be used in a greater amount than others, necessitating an alternate cartridge design having greater volume. For example, if all cartridges in a CMYK color printing system were provided having identical volumes, it would be necessary to replace the black cartridge more frequently. Accordingly, alternative dimensions are provided, such that a larger volume cartridge can be provided, while maintaining a size and configuration that permit compact installation in an image forming device, and providing features that allow for secure installation in an image forming device.

Figure 14D:
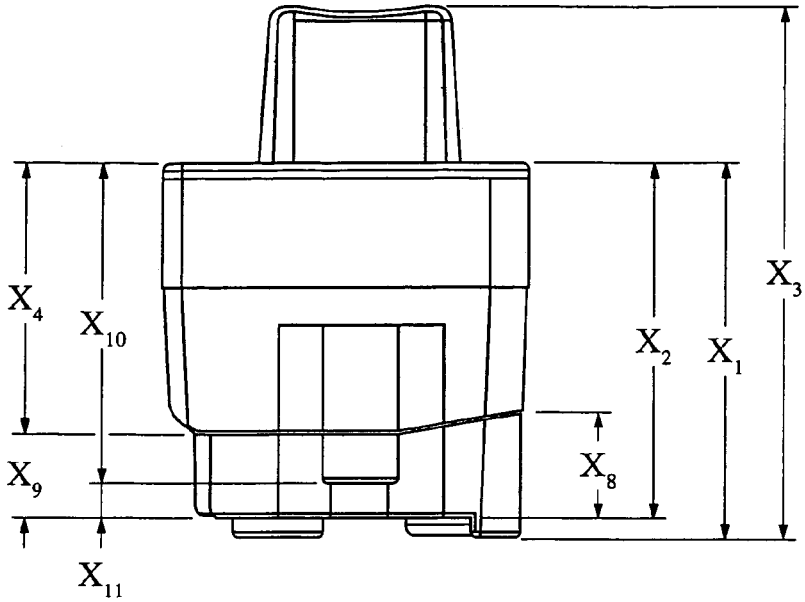
Figure 14E:
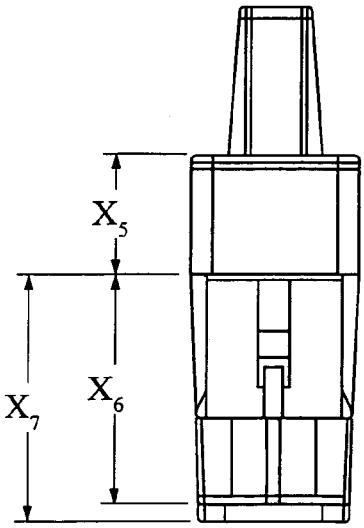

As shown in FIG. 14D, in the embodiments, the distance $X_1$ from the flat surface 1*j* of the cover 1*b* to the bottom of the lip 100 is 50.5 mm. In some embodiments, the distance $X_1$ is less than about 50.5 mm. In some embodiments, the distance $X_1$ is about 50.5 mm. In further embodiments, the distance $X_1$ can vary from 50.5 mm by ±0.5 mm or ±1 mm. By providing the described variants on the distance $X_1$, the inkjet recording apparatus 2 can be made compact and the ink cartridge 1 can be adequately secured within the inkjet recording apparatus 2. In embodiments, the distance $X_2$ from the flat surface 1*j* of the cover 1*b* to the bottom surface 102 of the bottom portion 1*f* is 48 mm. In some embodiments, the distance $X_2$ is less than about 48 mm, for example, 47.7 mm. In some embodiments, the distance $X_2$ is about 48 mm. In further embodiments, the distance $X_2$ can vary from 48 mm by ±0.5 mm or ±1 mm. By providing the described variants on the distance $X_2$, the bottom of the sealing part 63 sufficiently extends from the bottom surface so that the ink cartridge 1 can be adequately secured onto the inkjet recording apparatus 2. In embodiments, the distance $X_3$ from the top of the cover 1*b* to the bottom of the lip 100 is 71.5 mm. In some embodiments, the distance $X_3$ is less than about 71.5 mm. However, in other embodiments, the distance $X_3$ is greater than about 71.5 mm. In some embodiments, the distance $X_3$ is about 71.5 mm. In further embodiments, the distance $X_3$ can vary from 71.5 mm by ±1 mm or ±1.5 mm.

In embodiments, the distance $X_4$ from the flat surface 1*j* to the surface 105 is 36.5 mm. In some embodiments, the distance $X_4$ is less than about 36.5 mm. In some embodiments, the distance $X_4$ is about 36.5 mm. In further embodiments, the distance $X_4$ can vary from 36.5 mm by ±0.5 mm or ±1 mm. By providing the described variants on the distance $X_4$, a sufficient amount of ink can be stored in the ink cartridge 2 while maintaining a secure connection between the ink cartridge 1 and the inkjet recording apparatus 2. In embodiments, the distance $X_5$ from the flat surface 1*j* to the bottom of the top half 106 is 17 mm. In some embodiments, the distance $X_5$ is less than about 17 mm. In some embodiments, the distance $X_5$ is about 17 mm. In further embodiments, the distance $X_5$ can vary from 17 mm by ±0.5 mm or ±1 mm. By providing the described variants on the distance $X_5$, the blocking member 92 can effectively rotate in the projection 110 while maintaining a sufficient amount of ink in the ink cartridge 1. In embodiments, the distance $X_6$ from the bottom of the top half 106 to the surface 102 is 31.5 mm. In some embodiments, the distance $X_6$ is less than about 31.5 mm. In some embodiments, the distance $X_6$ is about 31.5 mm. In further embodiments, the distance $X_6$ can vary from 31.5 mm by ±0.5 mm or ±1 mm. By providing the described variants on the distance $X_6$, a protrusion can be inserted into the canal portions 116,118 in order to rigidly maintain the ink cartridge 1 in the inkjet recording apparatus 2. In embodiments, the distance $X_7$ from the bottom of the top half 106 and the bottom of the lip 100 is 34 mm. In some embodiments, the distance $X_7$ is less than about 34 mm. In some embodiments, the distance $X_7$ is about 34 mm. In further embodiments, the distance $X_7$ can vary from 34 mm by ±0.5 mm or ±1 mm.

In embodiments, the distance $X_8$ from the top of the inclined portion 104 to the surface 102 is 14 mm. In some embodiments, the distance $X_8$ is less than about 14 mm. In some embodiments, the distance $X_8$ is about 14 mm. In further embodiments, the distance $X_8$ can vary from 14 mm by ±0.5 mm or ±1 mm. In embodiments, the distance $X_9$ from the surface 105 to the surface 102 is 11.5 mm. In some embodiments, the distance $X_9$ is less than about 11.5 mm. However, in other embodiments, the distance $X_9$ is greater than about 11.5 mm. In some embodiments, the distance $X_9$ is about 11.5 mm. In further embodiments, the distance $X_9$ can vary from 11.5 mm by ±0.5 mm or ±1 mm. In embodiments, the distance $X_{10}$ between the flat surface 1*j* and the recess 112 is 43.5 mm. In some embodiments, the distance $X_{10}$ is less than about 43.5 mm. In some embodiments, the distance $X_{10}$ is about 43.5 mm. In further embodiments, the distance $X_{10}$ can vary from 43.15 mm by ±0.5 mm or ±1 mm. By providing the described variants on the distance $X_{10}$, a protrusion can be placed in the recess 112 in order to stabilize the ink cartridge 2 relative to the inkjet recording device 2. In embodiments, the distance $X_{11}$ between the recess 112 and the surface 102 is 4.5 mm. In some embodiments, the distance $X_{11}$ is less than about 4.5 mm. However, in other embodiments, the distance $X_{11}$ is greater than about 4.5 mm. In some embodiments, the distance $X_{11}$ is about 4.5 mm. In further embodiments, the distance $X_{11}$ can vary from 4.5 mm by ±0.5 mm or ±1 mm.

Figure 14F:
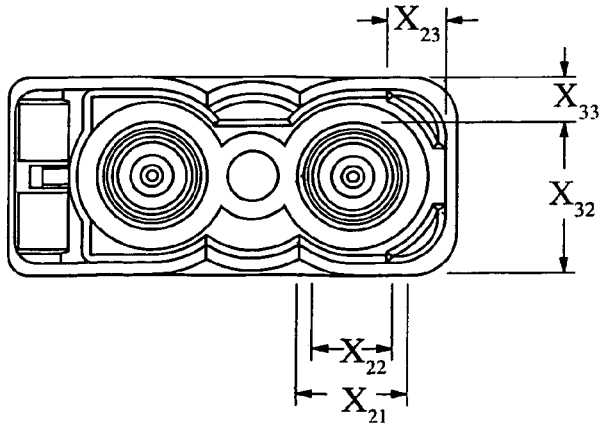
Figure 14G:
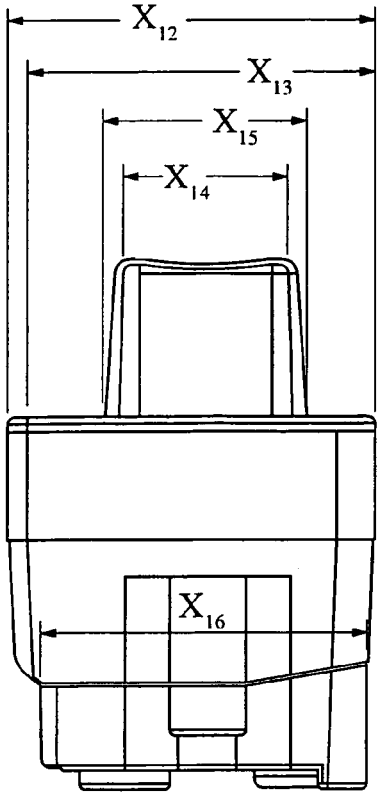

As shown in FIG. 14G, in embodiments, the distance $X_{12}$ between left and right sides of the container wall 1*a* is 48.5 mm. In some embodiments, the distance $X_{12}$ is less than about 48.5 mm. In some embodiments, the distance $X_{12}$ is about 48.5 mm. In further embodiments, the distance $X_{12}$ can vary from 48.5 mm by ±0.5 mm or ±1 mm. By providing the described variants on the distance $X_{12}$, the inkjet recording apparatus 2 can be made compact and the ink cartridge 1 can be adequately secured within the inkjet recording apparatus 2. In embodiments, the distance $X_{13}$ from the right side of the container wall 1*a* to the grooves 116, 118 is 42.5 mm. In some embodiments, the distance $X_{13}$ is less than about 42.5 mm. However, in other embodiments, the distance $X_{13}$ is greater than about 42.5 mm. In some embodiments, the distance $X_{13}$ is about 42.5 mm. In further embodiments, the distance $X_{13}$ can vary from 42.5 mm by ±0.5 mm or ±1 mm.

In embodiments, the distance $X_{14}$ between the left and right sides of the bottom of the protrusion 1*i* is 26.5 mm. In some embodiments, the distance $X_{14}$ is less than about 26.5 mm. However, in other embodiments, the distance $X_{14}$ is greater than about 26.5 mm. In some embodiments, the distance $X_{14}$ is about 26.5 mm. In further embodiments, the distance $X_{14}$ can vary from 26.5 mm by ±0.5 mm or ±1 mm. However, one color may be used in a greater amount than others, necessitating an alternate design for the protrusion 1*i* in order to easily manipulate the ink cartridge 2. In other embodiments, the distance $X_{14}$ is 31.5 mm. In some embodiments, the distance $X_{14}$ is less than about 31.5 mm. However, in other embodiments, the distance $X_{14}$ is greater than about 31.5 mm. In further embodiments, the distance $X_{14}$ is about 31.5 mm. In further embodiments, the distance $X_{14}$ can vary from 31.5 mm by ±0.5 mm or ±1 mm. In embodiments, the distance $X_{15}$ between the left and right sides of the top of the protrusion 1*i* is 24 mm. In some embodiments, the distance $X_{15}$ is less than about 24 mm. However, in other embodiments, the distance $X_{15}$ is greater than about 24 mm. In some embodiments, the distance $X_{15}$ is about 24 mm. In further embodiments, the distance $X_{15}$ can vary from 24 mm by ±0.5 mm or ±1 mm. However, one color may be used in a greater amount than others, necessitating an alternate design for the protrusion 1*i* in order to easily manipulate the ink cartridge 2. In some embodiments, the distance $X_{15}$ is 29 mm. In some embodiments, the distance $X_{15}$ is less than about 29 mm. However, in other embodiments, the distance $X_{15}$ is greater than about 29 mm. In some embodiments, the distance $X_{15}$ is about 29 mm. In further embodiments, the distance $X_{15}$ can vary from 29 mm by ±0.5 mm or ±1 mm. In embodiments, the distance $X_{16}$ between the left and right side of the bottom portion 1*f* is 41 mm. In some embodiments, the distance $X_{16}$ is less than about 41 mm. In some embodiments, the distance $X_{16}$ is about 41 mm. In further embodiments, the distance $X_{16}$ can vary from 41 mm by ±0.5 mm or ±1 mm. By providing the described variants on the distance $X_{16}$, the ink cartridge 1 can be adequately secured within the inkjet recording apparatus 2.

Figure 14H:
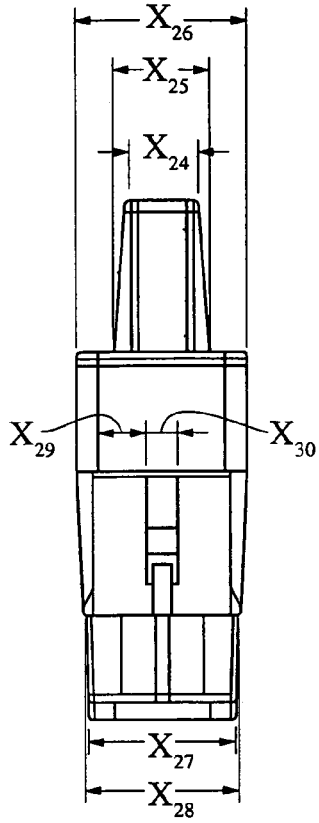
Figure 14I:
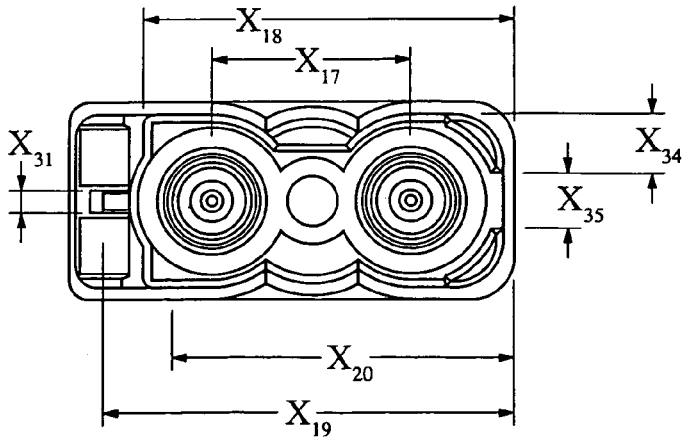

As shown in FIG. 14I, in embodiments, the distance $X_{17}$ between the center of the ink port 124 and the air communication port 126 is 22 mm. In some embodiments, the distance $X_{17}$ is less than about 22 mm. In some embodiments, the distance $X_{17}$ is about 22 mm. In further embodiments, the distance $X_{17}$ can vary from 22 mm by ±0.5 mm or ±1 mm. By providing the described variants on the distance $X_{17}$, the ink cartridge 1 can be made compact by placing the ink port 124 and the air communication port 126 relatively close to each other. In embodiments, the distance $X_{18}$ between the right and left sides of the bottom portion 1*f* is 39.5 mm. In some embodiments, the distance $X_{18}$ is less than about 39.5 mm, for example, 39.4 mm. In some embodiments, the distance $X_{18}$ is about 39.5 mm. In further embodiments, the distance $X_{18}$ can vary from 39.5 mm by ±0.5 mm or ±1 mm. As an alternative, the right and left sides of the bottom portion 1*f* can have two distances. For example, one side of the bottom portion can have the distance $X_{18}$ as shown in FIG. 14*i* and the other side of the bottom portion can have a shorter distance, distance $X_{20}$. The distance $X_{20}$ between the right and left sides of the bottom portion 1*f* is 36.5 mm. In some embodiments, the distance $X_{20}$, is less than about 36.5 mm. In some embodiments, the distance $X_{20}$ can be about 36.5 mm. Again, by providing the above described distances $X_{20}$, the ink cartridge 1 can be made compact and can be stably placed in the inkjet recording apparatus 2. In embodiments, the distance $X_{19}$ between the right side of the bottom portion 1*f* and the center of the grooves 116,118 is 43 mm. In some embodiments, the distance $X_{19}$ is less than 43 mm. In some embodiments, the distance $X_{19}$ is about 43 mm. In further embodiments, the distance $X_{19}$ can vary from 43 mm by ±0.5 mm or ±1 mm.

As shown in FIG. 14F, in embodiments, the outer diameter $X_{21}$ of the sealing part 63 is 12 mm. In some embodiments, the distance $X_{21}$ is less than about 12 mm. In some embodiments, the outer diameter $X_{21}$ is about 12 mm. In further embodiments, the distance $X_{21}$ can vary from 12 mm by ±0.5 mm or ±1 mm. In embodiments, the inner diameter $X_{22}$ of the sealing part 63 is 10 mm. In some embodiments, the distance $X_{22}$ is less than about 10 mm. In some embodiments, the inner diameter $X_{22}$ is about 10 mm. In further embodiments, the distance $X_{22}$ can vary from 10 mm by ±0.5 mm or ±1 mm. By providing the described variants on the distances $X_{21}$ and $X_{22}$, the ink cartridge 1 can reliably supply ink to an inkjet recording apparatus 2. In embodiments, the distance $X_{23}$ between the left and right sides of the engaging protrusion 120 is 7 mm. In some embodiments, the distance $X_{23}$ is less than about 7 mm. In some embodiments, the distance $X_{23}$ is about 7 mm. In further embodiments, the distance $X_{23}$ can vary from 7 mm by ±0.5 mm or ±1 mm. By providing the described variants on the distance $X_{23}$, the ink cartridge 1 can remain upright in the inkjet recording apparatus 2.

As shown in FIG. 14H, in embodiments, the distance $X_{24}$ between the left and right sides of the top of the protrusion 1*i* is 10 mm. In some embodiments, the distance $X_{24}$ is less than about 10 mm. However, in other embodiments, the distance $X_{24}$ is greater than about 10 mm. In some embodiments, the distance $X_{24}$ is about 10 mm. In further embodiments, the distance $X_{24}$ can vary from 10 mm by ±0.5 mm or ±1 mm. In embodiments, the distance $X_{25}$ between the left and right side of the bottom of the protrusion 1*i* is 12.5 mm. In some embodiments, the distance $X_{25}$ is less than about 12.5 mm. However, in other embodiments, the distance $X_{25}$ is greater than about 12.5 mm. In some embodiments, the distance $X_{25}$ is about 12.5 mm. In embodiments, the distance $X_{26}$ between the left and right sides of the top of the container wall 1*a* is 22 mm. In some embodiments, the distance $X_{26}$ is less than about 22 mm. In some embodiments, the distance $X_{26}$ is about 22 mm. In further embodiments, the distance $X_{26}$ can vary from 22 mm by ±0.5 mm or ±1 mm. However, one color may be used in a greater amount than others, necessitating an alternate design for the container wall 1*a* in order to store more ink. Accordingly, in other embodiments, the distance $X_{26}$ is 31 mm. In some embodiments, the distance $X_{26}$ is less than about 31 mm. In further embodiments, the distance $X_{26}$ is about 31 mm. In further embodiments, the distance $X_{26}$ can vary from 31 mm by ±0.5 mm or ±1 mm. By providing the described variants on the distance $X_{26}$, an adequate supply of ink can be stored in the ink cartridge 1 while maintaining a compact design for the inkjet recording apparatus 2.

In embodiments, the distance $X_{27}$ between the left and right sides of the bottom of the bottom portion 1*f* is 19.5 mm. In some embodiments, the distance $X_{27}$ is less than about 19.5 mm, for example, 19.4 mm. In some embodiments, the distance $X_{27}$ is about 19.5 mm. In further embodiments, the distance $X_{27}$ can vary from 19.5 mm by ±0.5 mm or ±1 mm. However, one color may be used in a greater amount than others, necessitating an alternate design in order to store more ink. In other embodiments, the distance $X_{27}$ is 28.5 mm. Accordingly, in some embodiments, the distance $X_{27}$ is less than about 28.5 mm, for example, 28.2 mm. In further embodiments, the distance $X_{27}$ is about 28.5 mm. In further embodiments, the distance $X_{27}$ can vary from 28.5 mm by ±0.5 mm or ±1 mm. By providing distances $X_{16}$ and $X_{27}$ as described above, a slender, compact ink cartridge 1 can be produced. In embodiments, the distance $X_{28}$ between the left and right sides of the bottom of the container wall 1*a* is 20 mm. In some embodiments, the distance $X_{28}$, is less than about 20 mm. In some embodiments, the distance $X_{28}$ is about 20 mm. In further embodiments, the distance $X_{28}$ can vary from 20 mm±0.5 mm or ±1 mm. However, one color may be used in a greater amount than others, necessitating an alternate design in order to store more ink. Accordingly, in other embodiments, the distance $X_{28}$ is 29 mm. In some embodiments, the distance $X_{28}$ is less than about 29 mm. In further embodiments, the distance $X_{28}$ is about 29 mm. In further embodiments, the distance $X_{28}$ can vary from 29 mm by ±0.5 mm or ±1 mm.

In embodiments, the distance $X_{29}$ between the left and right side of the groove 116 is 6.5 mm. In some embodiments, the distance $X_{29}$ is less than about 6.5 mm. However, in other embodiments, the distance $X_{29}$ is greater than about 6.5 mm. In some embodiments, the distance $X_{29}$ is about 6.5 mm. In further embodiments, the distance $X_{29}$ can vary from 6.5 mm by ±0.5 mm or ±1 mm. However, one color may be used in a greater amount than others, necessitating an alternate design in order to store more ink. Accordingly, in other embodiments, the distance $X_{29}$ is 1 mm. In some embodiments, the distance $X_{29}$ is less than about 11 mm. In further embodiments, the distance $X_{29}$ is about 11 mm. In further embodiments, the distance $X_{29}$ can vary from 11 mm by ±0.5 mm or ±1 mm. In embodiments, the distance $X_{30}$ between the left and right side of the protrusion 110 is 4.5 mm. In some embodiments, the distance $X_{30}$ is less than about 4.5 mm, for example, 4.2 mm. In some embodiments, the distance $X_{30}$ is about 4.5 mm. In further embodiments, the distance $X_{30}$ can vary from 4.5 mm by ±0.5 mm or ±1 mm. By providing the described variants on the distance $X_{30}$, the blocking member 92 can effectively rotate in the projection 110 while maintaining a sufficient amount of ink in the ink cartridge 1.

As shown in FIGS. 14I and 14F, in embodiments, the distance $X_{31}$ between both sides of the protrusion 110 is 1.5 mm. In some embodiments, the distance $X_{31}$ is less than about 1.5 mm. In some embodiments, the distance $X_{31}$ is about 1.5 mm. In further embodiments, the distance $X_{31}$ can vary from 1.5 mm by ±0.5 mm or ±1 mm. In embodiments, the distance $X_{32}$ between a center side portion of the container wall 1*a* and the recess 112 is 16 mm. In some embodiments, the distance $X_{32}$ less than 16 mm. In some embodiments, the distance $X_{32}$ is about 16 mm. In further embodiments, the distance $X_{32}$ can vary from 16 mm by ±0.5 mm or ±1 mm. However, one color may be used in a greater amount than others, necessitating an alternate design in order to store more ink. Accordingly, in other embodiments, the distance $X_{32}$ is 24.5 mm. In some embodiments, the distance $X_{32}$ is less than about 24.5 mm. In further embodiments, the distance $X_{32}$ is about 24.5 mm. In further embodiments, the distance $X_{32}$ can vary from 24.5 mm by ±0.5 mm or ±1 mm. In embodiments, the distance $X_{33}$ between a center side portion of the container wall 1*a* and the recess 112 is 3 mm. In some embodiments, the distance $X_{33}$ is less than about 3 mm, for example, 2.6 mm. In some embodiments, the distance $X_{33}$ is about 3 mm. In further embodiments, the distance $X_{33}$ is about 3 mm. In further embodiments, the distance $X_{33}$ can vary from 3 mm by ±0.5 mm or ±1 mm. By providing the distances $X_{11}$ and $X_{33}$, the lip 112 can prevent the ink cartridge 1 from being incorrectly installed.

In embodiments, the distance $X_{34}$ between the sides of the engaging protrusion 120 is 7.5 mm. In some embodiments, the distance $X_{34}$ is less than about 7.5 mm. In some embodiments, the distance $X_{34}$ is about 7.5 mm. In further embodiments, the distance $X_{34}$ can vary from 7.5 mm by ±0.5 mm or ±1 mm. However, one color may be used in a greater amount than others, necessitating an alternate design in order to store more ink. Accordingly, in other embodiments, the distance $X_{34}$ is 11.5 mm. In some embodiments, the distance $X_{34}$ is less than about 11.5 mm. In further embodiments, the distance $X_{34}$ is about 11.5 mm. In further embodiments, the distance $X_{34}$ can vary from 11.5 mm by ±0.5 mm or ±1 mm. In embodiments, the distance $X_{35}$ between the engaging protrusions 120,122 is 5.5 mm. In some embodiments, the distance $X_{35}$ is less than about 5.5 mm. However, in other embodiments, the distance $X_{35}$ is greater than about 5.5 mm. In some embodiments, the distance $X_{35}$ is about 5.5 mm. In further embodiments, the distance $X_{35}$ can vary from 5.5 mm by ±0.5 mm or ±1 mm. By providing the described variants on the distances $X_{34}$, $X_{35}$, the ink cartridge 1 can remain stably upright in the inkjet recording apparatus 2.

An image-recording apparatus disclosed in Japanese Laid Open Patent Application No. 2003-298790 includes an inkjet printer and a scanner provided above the inkjet printer. A sheet supply tray is provided on a rear side of the inkjet printer and a sheet discharge portion is provided in front of the inkjet printer. A sheet is supplied from the sheet supply tray into the inkjet printer. After an image is printed on the sheet, the sheet is discharged onto the sheet discharge portion. The image-recording apparatus includes an inkjet head that reciprocates in a direction perpendicular to a direction that the sheet is fed. Ink cartridges are detachably provided below the sheet discharge portion.

In the image-recording apparatus described above, the sheet supply tray is provided on the rear side of the inkjet printer and the sheet discharge portion and the ink cartridges are provided in front of the inkjet printer. Therefore, the image-recording apparatus is enlarged in its front to back direction. In addition, the inkjet head moves beyond both side edges of the sheet during printing. Space located on both sides of the sheet-feeding path are thus wasted. An image-recording apparatus can thus be miniaturized by laying out components of the image-recording apparatus more efficiently.

Preferred embodiments of a multifunction device whose components are laid out efficiently will be described below. The ink cartridge 1 of the fifth embodiment whose dimensions were described above and were illustrated in FIGS. 14D-14I is attachable to the multifunction device described below.

In the preferred embodiments, the present invention is applied to a multifunction device including a printer function, a facsimile function, a copier function, and a scanner function. For the following description, the near side of a multifunction device 201 in FIG. 15 is defined as the front, and left and right directions when viewing from the front of the multifunction device 201 are defined as the left and right directions.

First, an exemplary multifunction device 201 according to the present invention will be described with reference to FIGS. 15 to 27.

Figure 15:
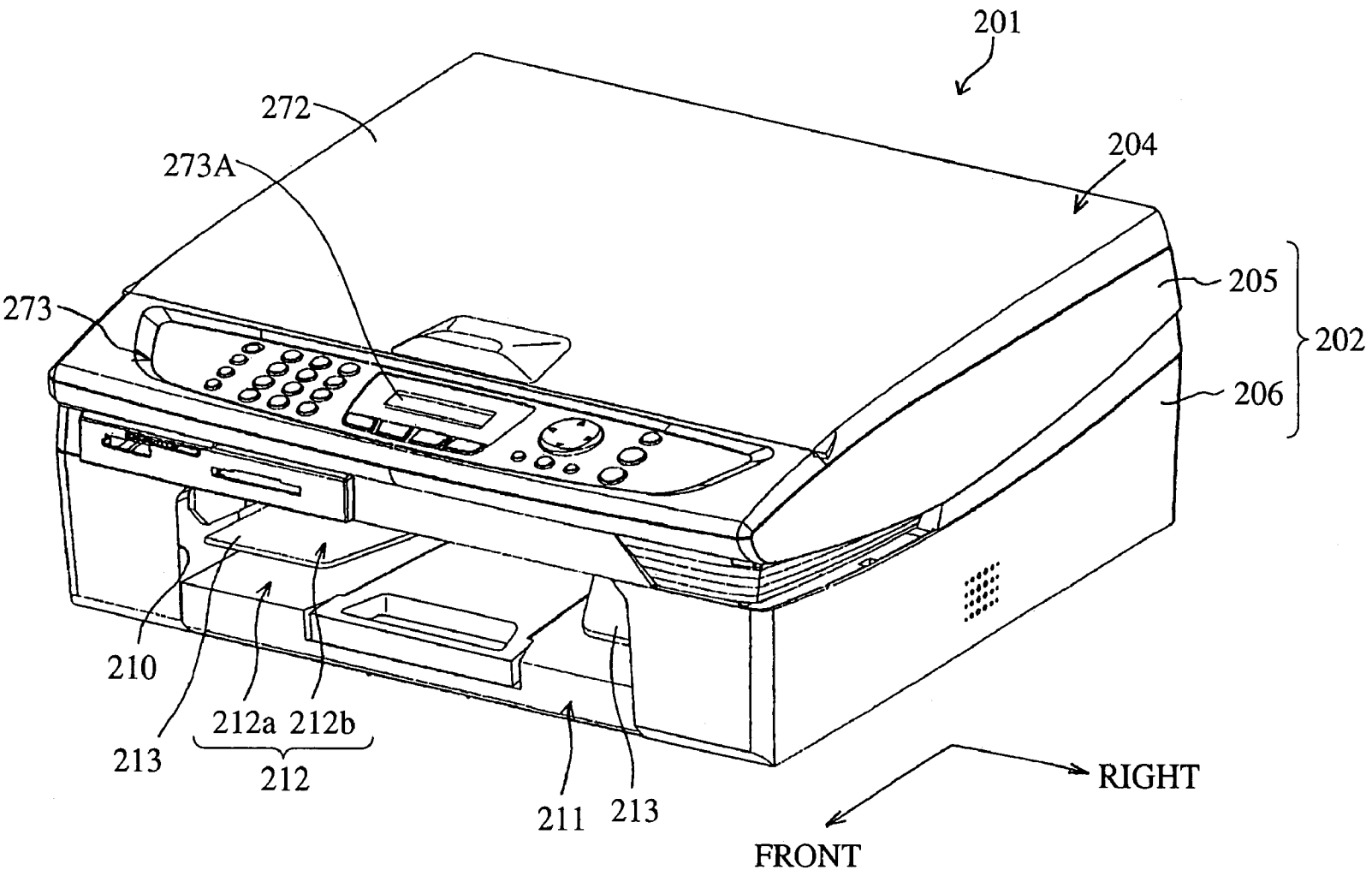
FIG. 15 is a perspective view of an exemplary multifunction device according to the present invention.

As shown in FIG. 15, the multifunction device 201 includes a main casing 202 having an upper frame 205 and a lower frame 206. The lower frame 206 is formed in a substantially square shape in a plan view. A sheet accommodating section 210 is formed as a recess in the front bottom portion of the lower frame 206 and centered left-to-right, providing an arch-like front appearance to the lower frame 206. A conveying space 212 is defined inside the sheet accommodating section 210 for conveying a recording sheet P (see FIG. 16) in the front-to-rear direction.

A sheet supply tray 211 for holding the recording sheets P is detachably inserted into the sheet accommodating section 210 and is capable of moving in the front-to-rear direction within the conveying space 212. When accommodated in the sheet accommodating section 210, the sheet supply tray 211 blocks the bottom of the sheet accommodating section 210. In other words, by eliminating a bottom surface of the sheet accommodating section 210 and by configuring the sheet supply tray 211 to serve as the bottom surface, it is possible to reduce the height of the lower frame 206. This construction also facilitates maintenance work for paper jams and the like since the bottom of the lower frame 206 can be opened simply by removing the sheet supply tray 211 from the sheet accommodating section 210.

Guide pieces 213 formed in arch shapes are disposed near the front part of the sheet supply tray 211 to extend from the left and right edges of the sheet accommodating section 210 to cover the top of the recording sheet P loaded in the sheet supply tray 211. The guide pieces 213 determine the left-to-right position of the recording sheet P on the sheet supply tray 211. The guide pieces 213 also function as a discharge tray. After an image is formed on the recording sheet P in a recording unit 221 described later, the recording sheet P is discharged forward onto the top surfaces of the guide pieces 213. Hence, the guide pieces 213 divide the conveying space 212 into a lower supply space 212*a* for supplying the recording sheet P and an upper discharge space 212*b* for discharging the recording sheet P. Note that the guide pieces 213 have been omitted from FIGS. 16-18.

Figure 20:
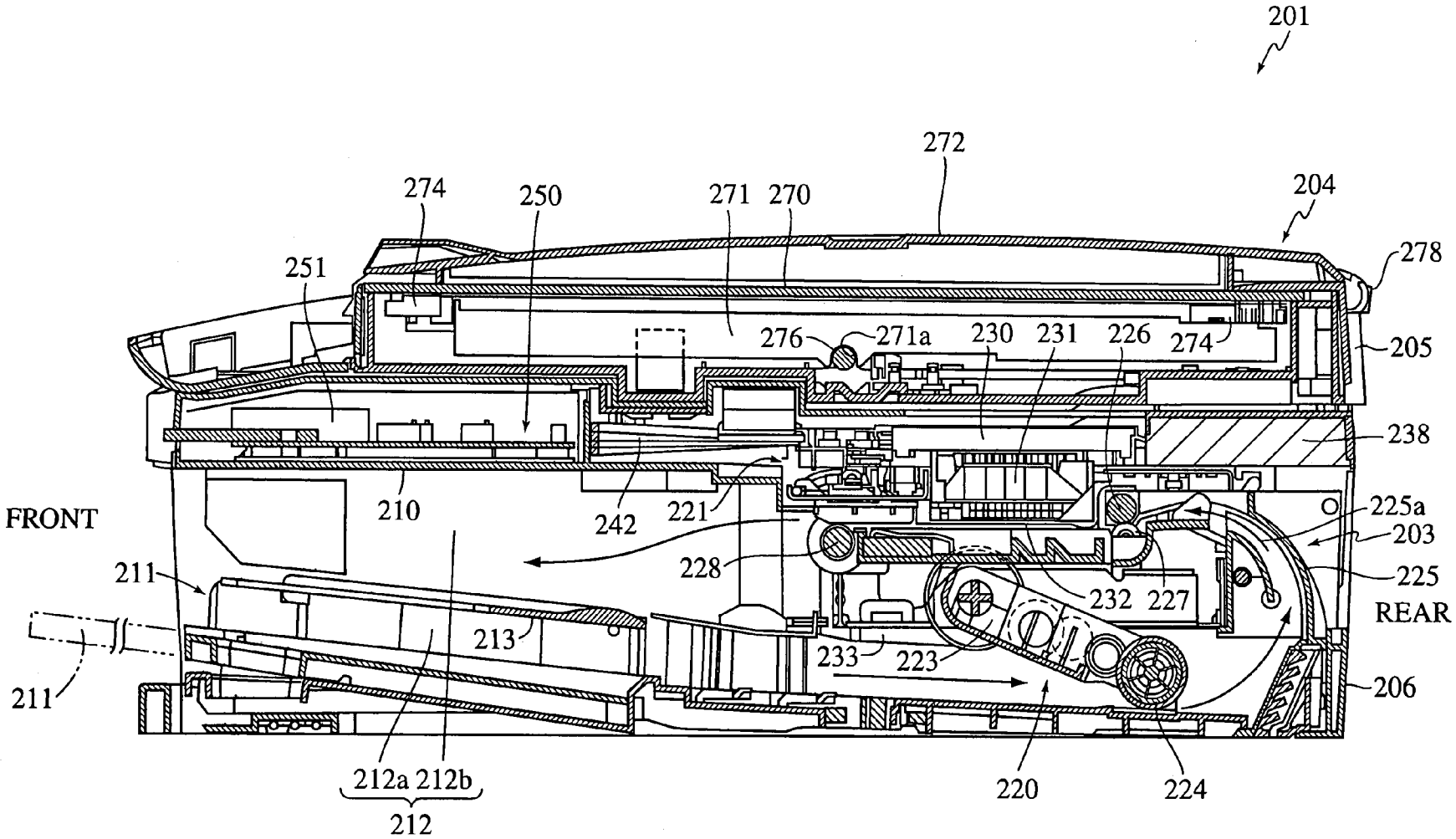
FIG. 20 is a cross-sectional view of the multifunction device taken along a line VI-VI of FIG. 16.
Figure 21:
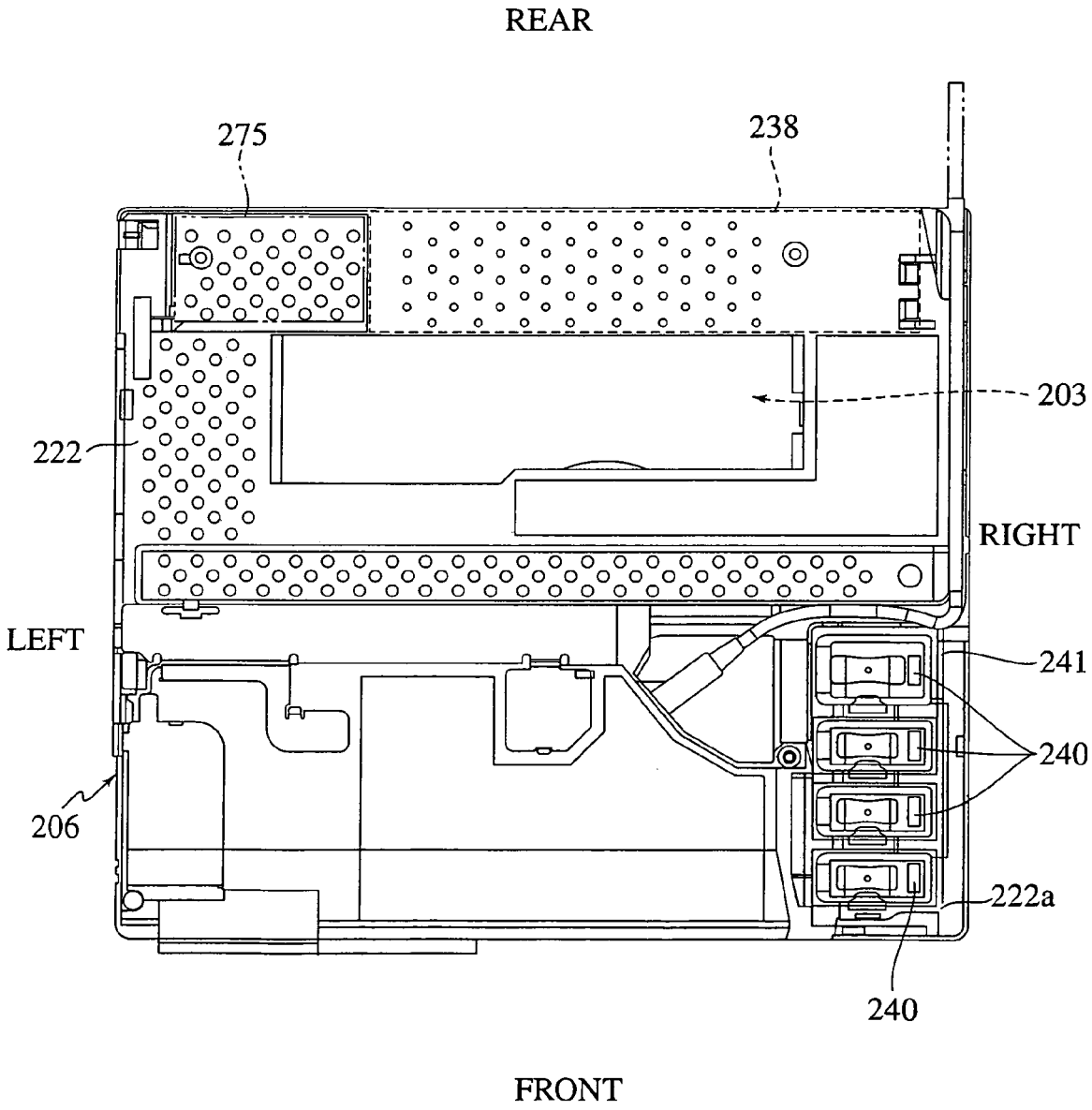
FIG. 21 is a plan view of the multifunction device taken along a line VII-VII of FIG. 16.

As shown in FIG. 20, a printing unit 203 is accommodated in the lower frame 206. The printing unit 203 includes a conveying mechanism 220 for conveying the recording sheets P accommodated in the sheet supply tray 211 in the front-to-rear direction, and the recording unit 221 disposed in the rear section of the lower frame 206 for recording images on the recording sheets P. A cover 222 (FIG. 24) formed of a synthetic resin is mounted on the lower frame 206 for covering the conveying mechanism 220 and the recording unit 221.

As shown in FIG. 20, the conveying mechanism 220 includes an arm 223, a supply roller 224, a plate 225, a registration roller 226, a follow roller 227, and a discharge roller 228. The arm 223 is disposed above the rear end of the sheet supply tray 211 and extends downward from an engine frame 233 of the recording unit 221. The supply roller 224 is rotatably supported on the lower end of the arm 223. The plate 225 is disposed in a space in the rear of the sheet accommodating section 210 and has a U-shaped conveying part 225*a*. The registration roller 226 is disposed at a position farther forward than the plate 225 and farther rearward than the recording unit 221. The follow roller 227 is disposed in opposition to the registration roller 226. The discharge roller 228 is disposed in the front section of the recording unit 221. A motor (not shown) drives each of the supply roller 224, the registration roller 226, and the discharge roller 228 to rotate.

Operations of the conveying mechanism 220 for conveying a recording sheet P will be described. First, the supply roller 224 picks up a recording sheet P from the sheet supply tray 211 one sheet at a time and conveys the recording sheet P to the U-shaped conveying part 225*a* formed in the plate 225. The recording sheet P is flipped over in the U-shaped conveying part 225*a* so as to be moving forward and is conveyed to the recording unit 221 by the registration roller 226 and the follow roller 227. After the recording unit 221 records an image on the recording sheet P, the recording sheet P is discharged into the upper discharge space 212*b* by the discharge roller 228. Since the recording sheet P supplied from the front is inverted by the U-shaped conveying part 225*a* and discharged toward the front, the front-to-rear dimension of the multifunction device 201 can be made shorter than a multifunction device configured to feed a recording sheet P from the rear and discharge the recording sheet P toward the front.

Figure 22:
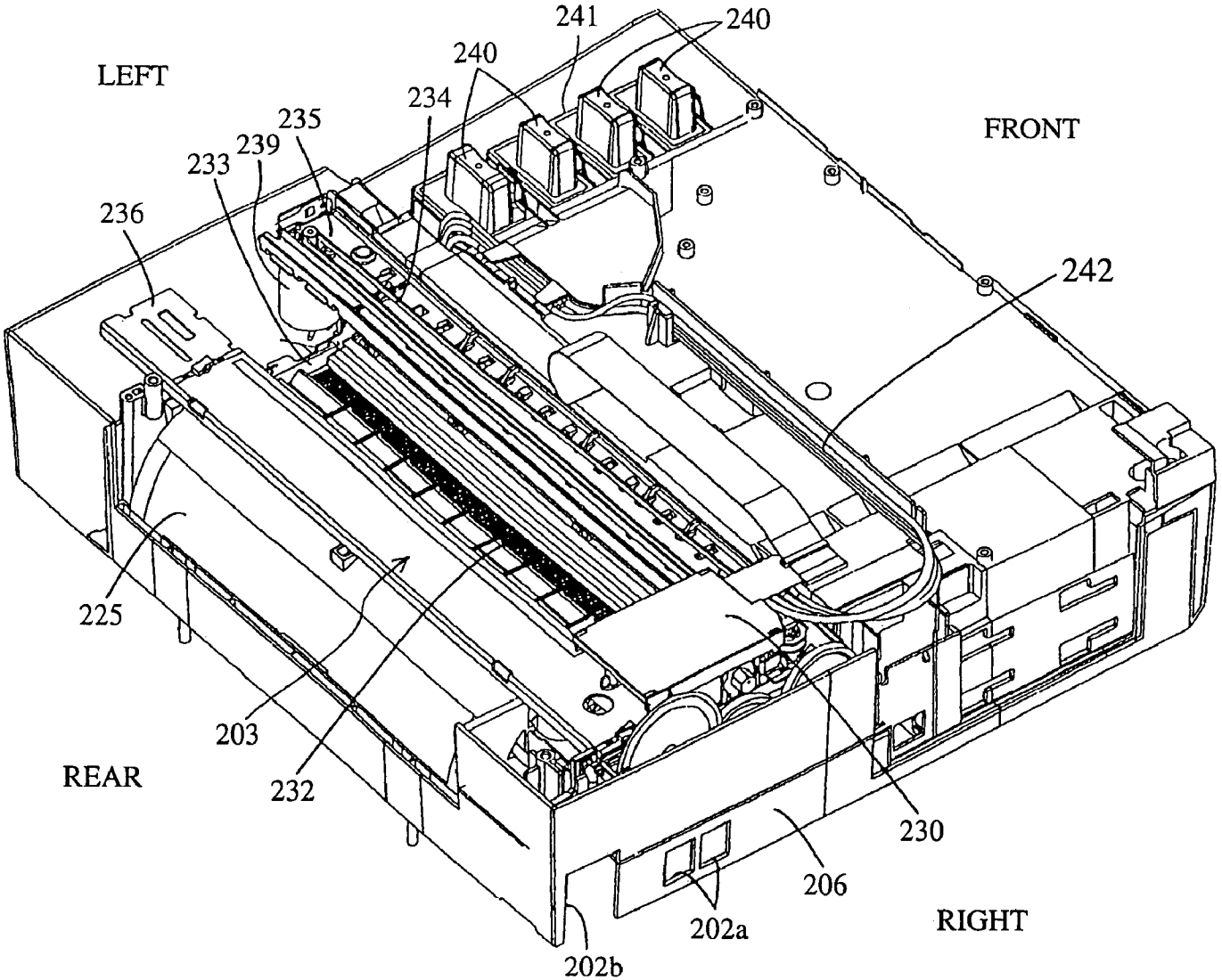
FIG. 22 is a perspective view showing the internal components of the main casing.

As shown in FIGS. 20 and 22, the recording unit 221 includes a carriage 230, an inkjet head 231, a platen 232, the engine frame 233, a timing belt 234, and a motor 239. The inkjet head 231 is attached to the bottom section of the carriage 230. The platen 232 is disposed below the carriage 230. The engine frame 233 supports the carriage 230 and the platen 232. A pair of front and rear guide plates 235 and 236, extending left-to-right, is disposed above the engine frame 233. The carriage 230 is coupled with the motor 239 via the timing belt 234 and can be moved reciprocally left and right over the guide plates 235 and 236 to positions beyond both widthwise edges of the recording sheet P.

With this construction, the motor 239 moves the carriage 230 reciprocally left and right along the pair of guide plates 235 and 236, while ink is ejected from the inkjet head 231 disposed on the carriage 230 onto the recording sheet P being conveyed forward in the space below the inkjet head 231. In this manner, an image is formed on the recording sheet P.

Figure 26:
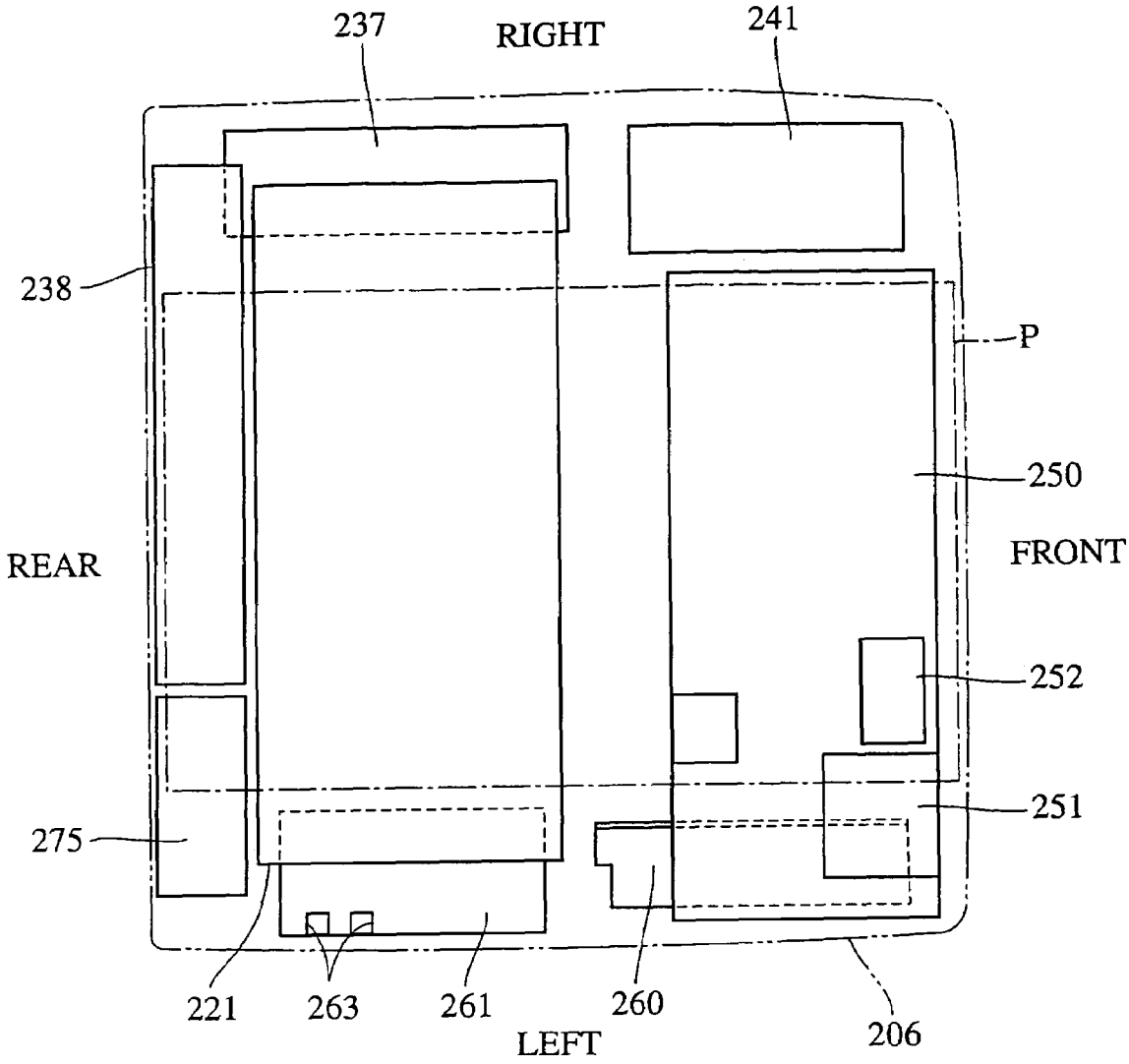
FIG. 26 is a schematic plan view of the multifunction device.

As shown in FIG. 26, a maintenance unit 237 for cleaning the inkjet head 231 is provided below the right edge of the recording unit 221.

Since a U-shaped conveying path through which a recording sheet P is conveyed from the lower supply space 212*a* to the upper discharge space 212*b* is disposed below the inkjet head 231, unused space exists above the plate 225 that forms the U-shaped conveying part 225*a* of the U-shaped conveying path, and behind the carriage 230 mounted with the inkjet head 231. Therefore, as shown in FIGS. 20 and 26, a waste liquid absorbing member 238 is disposed in the space above the plate 225 and behind the carriage 230, occupying approximately the right two-thirds of the space. The waste liquid absorbing member 238 is for absorbing waste ink discharged from nozzles in the inkjet head 231 when the maintenance unit 237 performs maintenance operations. This makes effective use of the space in the lower frame 206.

Figure 25:
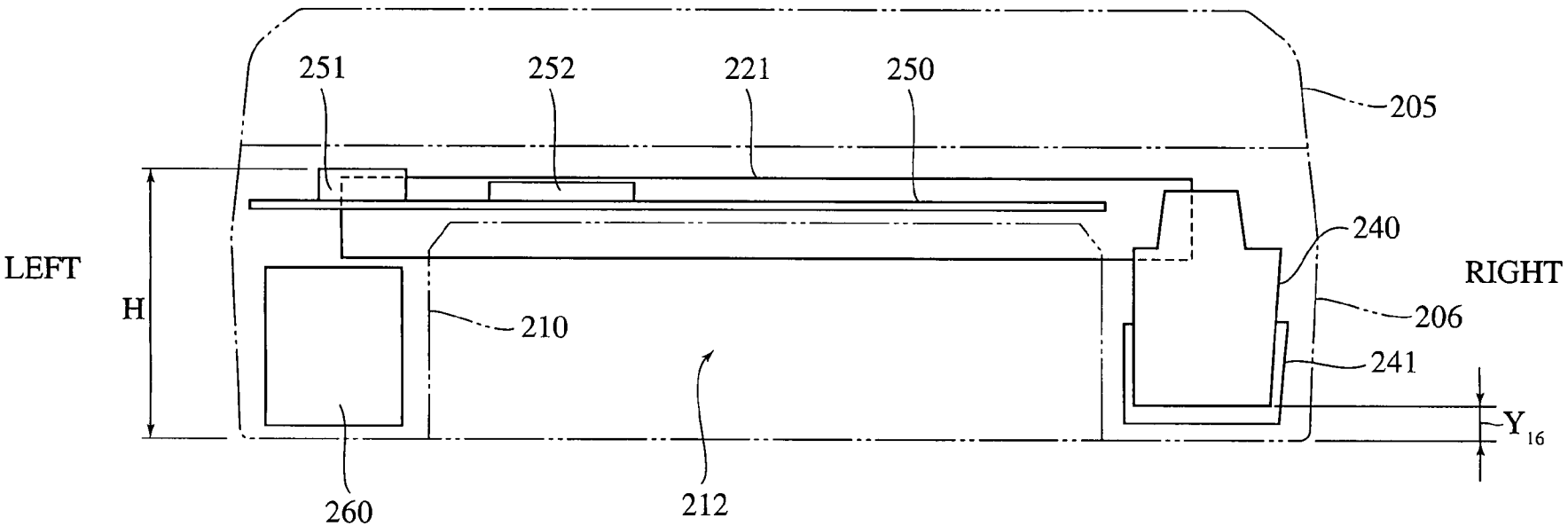
FIG. 25 is a schematic front view of the multifunction device showing the arrangement of the primary components.

As described above, the inkjet head 231 is a serial head capable of moving beyond both widthwise edges of the recording sheet P. Hence, as shown in FIG. 25, the recording unit 221 extends further in the left and right directions than the sheet accommodating section 210, thereby forming spaces on the left and right sides of the sheet accommodating section 210. Therefore, in the present embodiment, a cartridge holder 241 for holding ink cartridges 240 (for example, the ink cartridge 1 of FIGS. 14A-14I) is disposed on the right side of the sheet accommodating section 210, and a power supply unit 260 is disposed on the left side of the sheet accommodating section 210, thereby making effective use of the spaces on both sides of the sheet accommodating section 210.

In order to discharge the recording sheet P into the upper discharge space 212*b* as shown in FIG. 20, the ceiling of the upper discharge space 212*b* (sheet accommodating section 210) need only be higher than the position at which the recording sheet P is discharged from the recording unit 221 (the top point of the discharge roller 228). Hence, the upper discharge space 212*b* need not be formed unnecessarily high. Therefore, as shown in FIG. 20, a main control board 250 for controlling operations of the multifunction device 201 is disposed horizontally in a space above the sheet accommodating section 210. Also, the recording unit 221 is disposed behind the sheet accommodating section 210 such that the top portion of the recording unit 221 is substantially the same height as the main control board 250. In other words, the top of the main control board 250 and the top of the recording unit 221 are positioned in approximately the same plane as shown in FIG. 25. Accordingly, the space above the sheet accommodating section 210 is effectively used, while not increasing the height of the multifunction device 201. Further, as shown in FIG. 25, the cartridge holder 241, the ink cartridges 240, and the power supply unit 260 fit vertically between the top of the main control board 250 (a connector 251 disposed on the main control board 250) and the bottom of the sheet accommodating section 10, indicated by "H" in FIG. 25. Hence, the height of the multifunction device 201 can be made small, enabling the multifunction device 201 to be made even more compact.

The cartridge holder 241, the main control board 250, and the power supply unit 260 will be described further.

Figure 17:
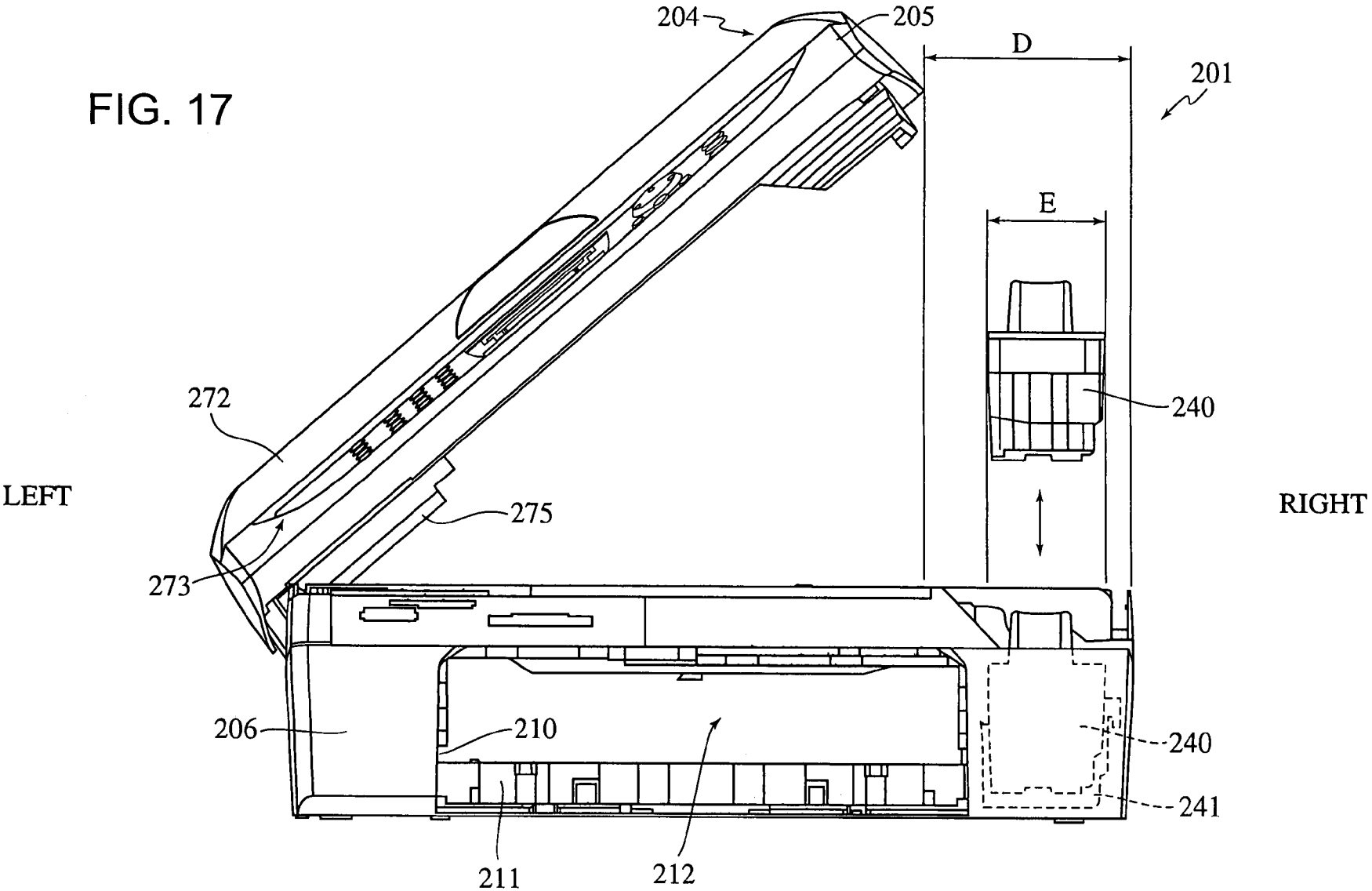
FIG. 17 is a front view of the multifunction device of FIG. 15 with an upper frame in an open state.
Figure 24:
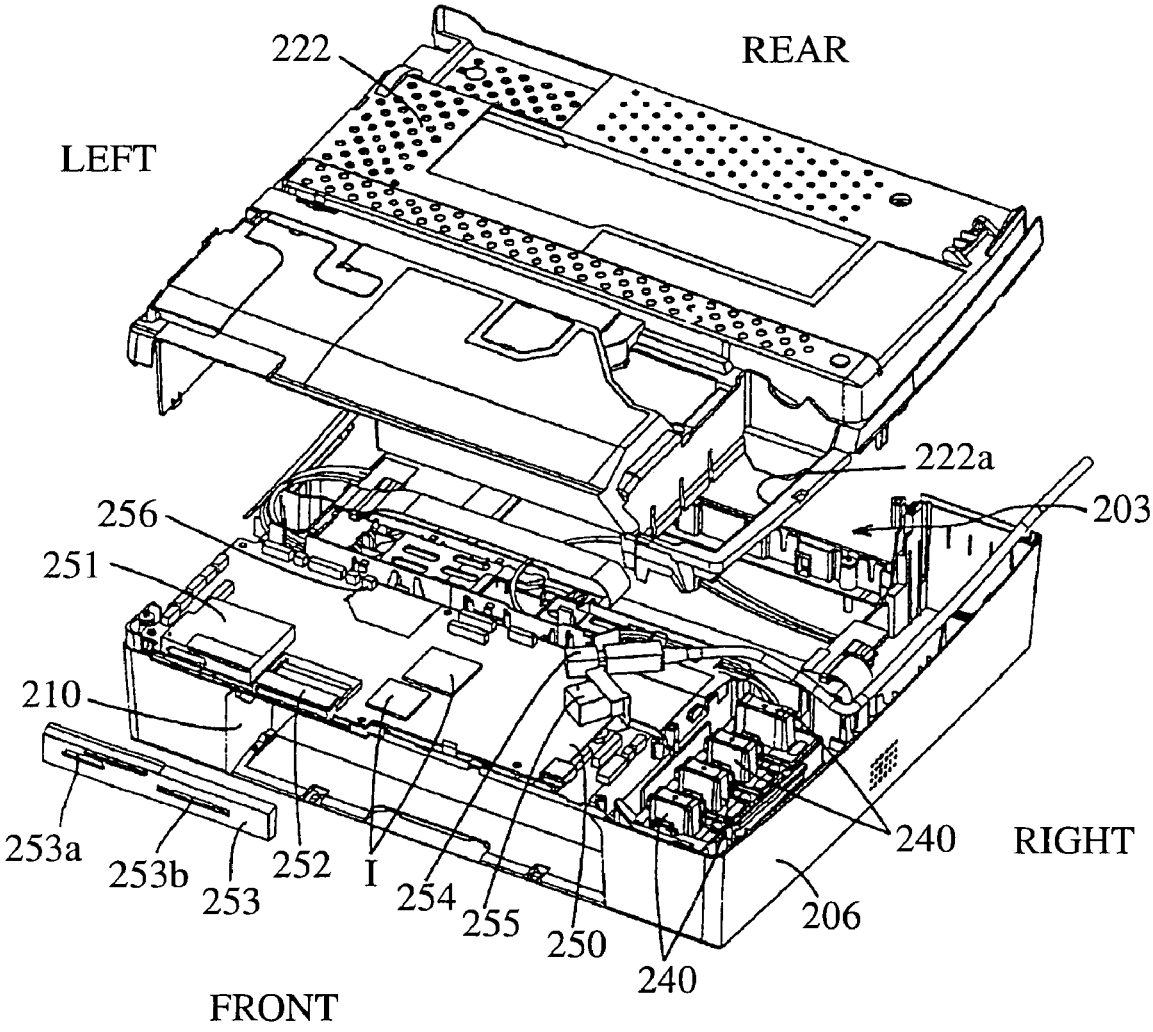
FIG. 24 is an exploded perspective view showing the main casing and a cover.

As illustrated in FIGS. 17 and 24, four ink cartridges 240, each accommodating ink for one of four colors (yellow, magenta, cyan, and black), are inserted into the cartridge holder 241 from the top of the cover 222 via an insertion hole 222*a* formed in the cover 222 and are aligned in the front-to-rear direction. The ink cartridges 240 are connected to the inkjet head 231 via flexible tubes 242 shown in FIG. 22. When ink is ejected from the inkjet head 231, ink is supplied to the inkjet head 231 from the ink cartridges 240 via the flexible tubes 242. Note that while the ink cartridges 240 in this embodiment accommodate ink of the four colors black, cyan, magenta, and yellow, the ink cartridges 240 may accommodate ink for more colors.

Figure 18:
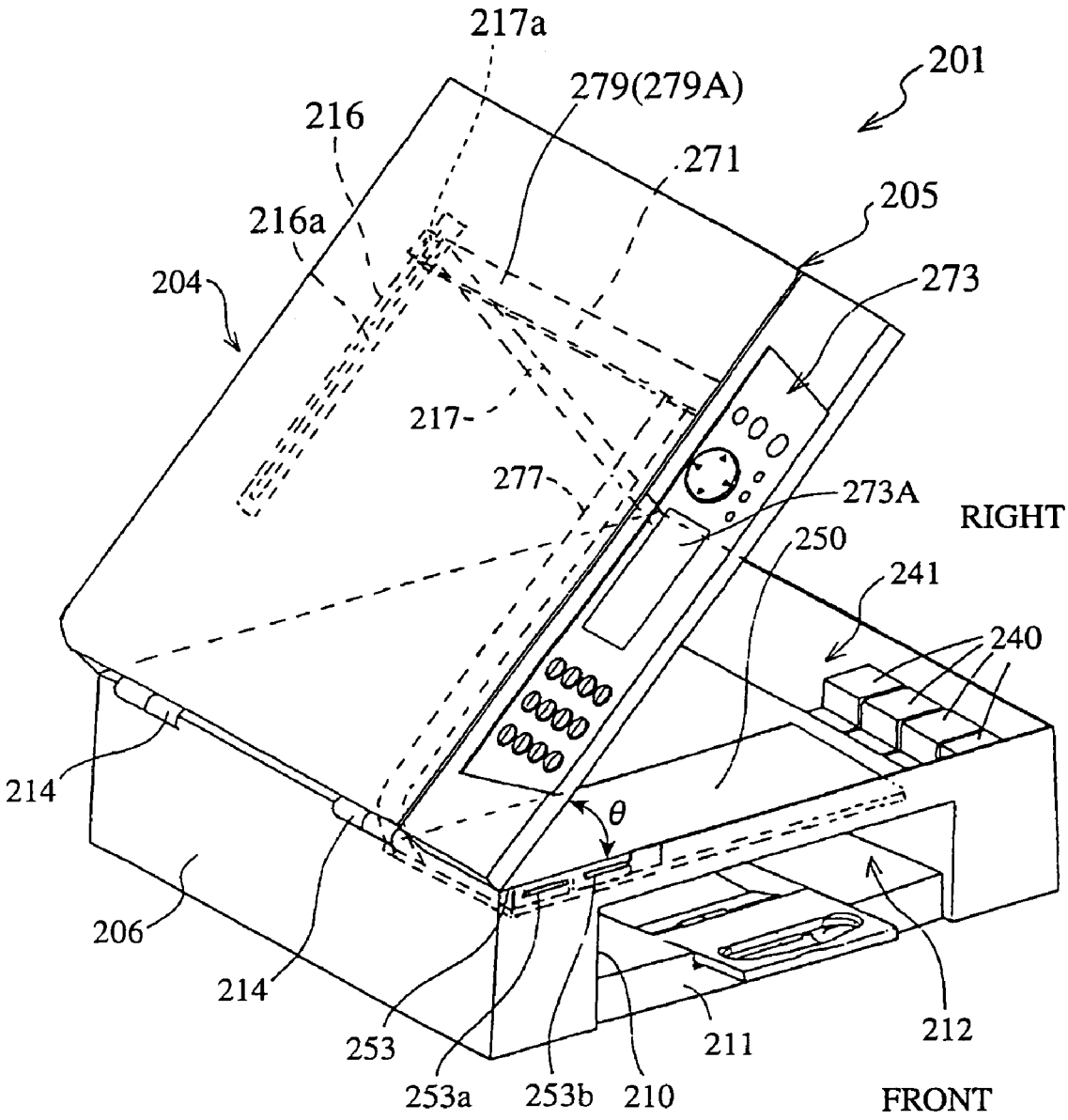
FIG. 18 is a perspective view of the multifunction device of FIG. 15 with the upper frame in an open state.

As shown in FIG. 18, the upper frame 205 is pivotably supported on the left edge of the lower frame 206 via shafts 214, such as hinges. In other words, when viewed from the front of the multifunction device 201, the upper frame 205 can pivot open sideways about the side edge opposite the position of the cartridge holder 241. Pivoting the upper frame 205 in this way reliably reveals the top of the cartridge holder 241, enabling ink cartridges 240 to be easily mounted into the cartridge holder 241 from above.

A guide rail 216 extending in the left-to-right direction is fixed to the bottom surface in the rear portion of the upper frame 205. The guide rail 216 is formed with a guide groove 216*a* extending left-to-right. A support rod 217 is pivotably attached to the lower frame 206 so as to be able to pivot about its lower right end. A guide pin 217*a* is provided on the free end of the support rod 217. The guide pin 217*a* is slidably engaged with the guide groove 216*a*. By sliding the guide pin 217*a* in the guide groove 216*a* until the guide pin 217*a* is fitted into an engaging part (not shown) formed in the right end of the guide groove 216*a* (the end opposite the pivotal axis of the upper frame 205, which extends in the front-to-rear direction), the support rod 217 supports the upper frame 205 in an open state. With this construction, the upper frame 205 can be maintained in an open state with respect to the lower frame 206 at a large angle θ.

The device for holding the upper frame 205 at a large angle θ with respect to the lower frame 206 may include arced guard rails disposed near the shafts 214 and guide pins that are guided by these rails. In addition to this, urging means may be provided for urging the upper frame 205 upward in order to maintain the upper frame 205 in the open state.

With this construction, the top surface of the lower frame 206 can be opened wide, improving visibility and facilitating such operations as maintenance of the inkjet head 231 and the like, clearing of paper jams along the conveying path, and replacing of the ink cartridges 240. As shown in FIG. 17, if a distance D between the right edge of the upper frame 205 in its uppermost position and the right edge of the lower frame 206 when viewed from the front is set either equal to or greater than a width dimension E of the ink cartridges 240, then the ink cartridges 240 can be almost vertically lifted out of or inserted into the cartridge holder 241 on the side of the lower frame 206, improving visibility and facilitating mounting and removal operations of the ink cartridges 240.

As shown in FIG. 25, the main control board 250 has a flat substantially rectangular shape and extends to the left side above the power supply unit 260. Accordingly, even when a main control board 250 having a relatively large surface area is required due to a large number of electronic parts or terminals mounted thereon, for example, the main control board 250 can still be disposed above the sheet accommodating section 210 by extending the main control board 250 over the power supply unit 260. Hence, the multifunction device 201 can be made compact by effectively using the space above the sheet accommodating section 210. Also, because the power supply unit 260 is positioned nearly directly below the main control board 250, a wire connecting the main control board 250 and the power board 262 can be very short.

On the other hand, the main control board 250 does not extend to the right above the cartridge holder 241 so that the main control board 250 does not hinder operations for mounting the ink cartridges 240 into the cartridge holder 241 from above.

As shown in FIG. 24, electronic parts 257 and various connectors are provided on the main control board 250. Specifically, two connectors 251 and 252 for connecting to a media card are disposed in the front left region of the main control board 250. A front cover 253 is disposed on the front surface of the lower frame 206. The front cover 253 is formed with two slots 253*a* and 253*b* through which media cards are inserted. The media cards inserted into the slots 253*a* and 253*b* form an electrical connection with the respective connectors 251 and 252 on the main control board 250. Since the main control board 250 is disposed above the sheet accommodating section 210 as shown in FIG. 25, the slots 253*a* and 253*b* (and the connectors 251 and 252) are disposed at a relatively high position, facilitating insertion of the media cards in the slots 253*a* and 253*b*.

As shown in FIG. 24, a connector 254 for connecting to a personal computer or other external device and a LAN connector 255 for connecting to a LAN are disposed on the rear right region of the main control board 250. Further, a connector 256 for connecting to a network board 261 described later is mounted on the rear left region of the main control board 250. A plurality of other connectors is also provided along the peripheral edge of the main control board 250.

Figure 23:
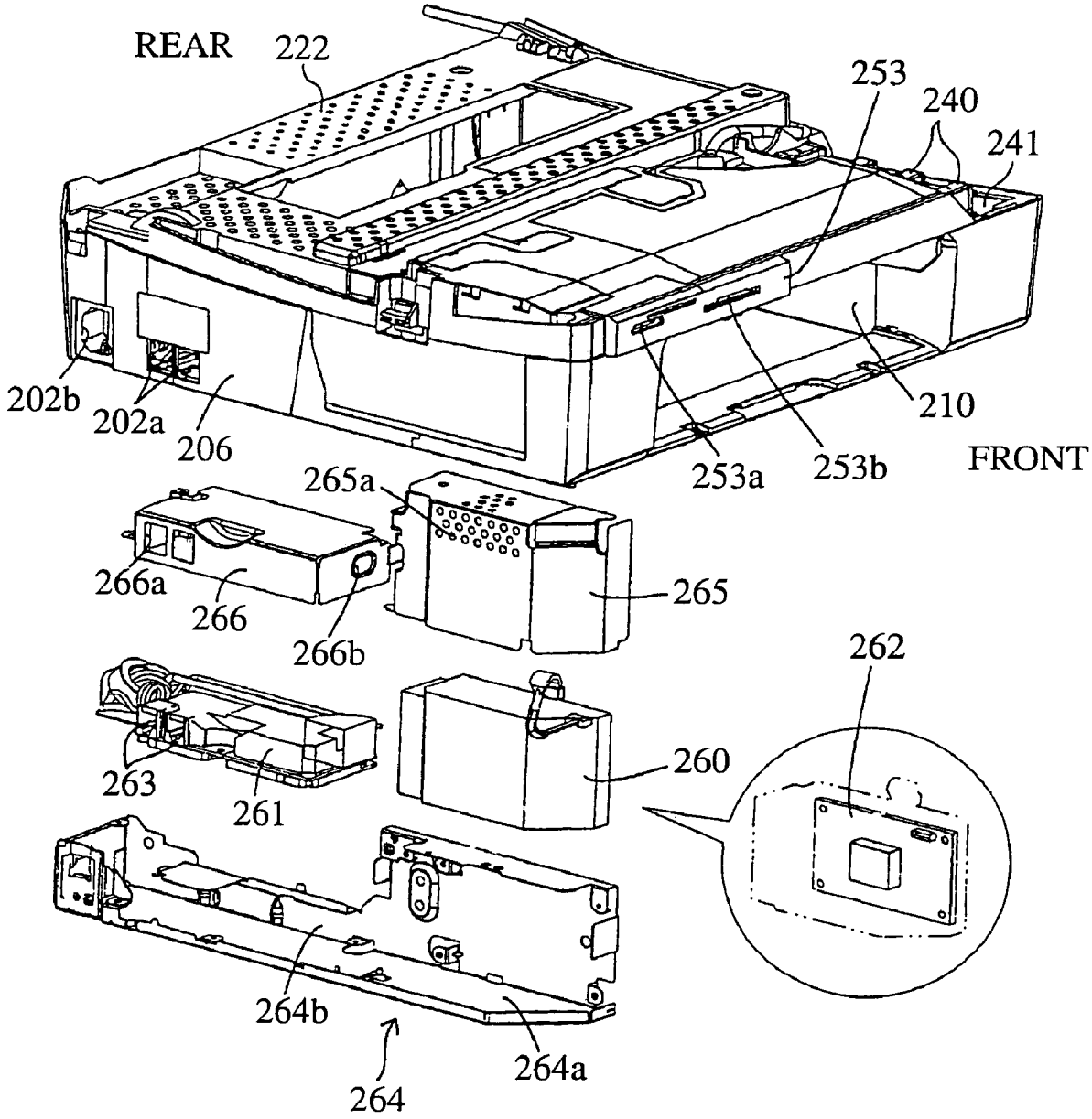
FIG. 23 is an exploded perspective view showing the main casing, a power supply unit, and a network board.

As shown in FIG. 23, the power supply unit 260 has a block shape elongated in the front-to-rear direction. The power supply unit 260 houses a power board 262 that uses commercial AC power sources to generate 5 volt DC power used to power a CPU, a memory, and the like, and 30 volt DC power for operating motors and other actuators. Wiring materials (not shown) connect the power board 262 to the main control board 250 or the power board 262 to various motors so that voltages generated by the power board 262 can be applied to the main control board 250 and the motors.

Figure 27:
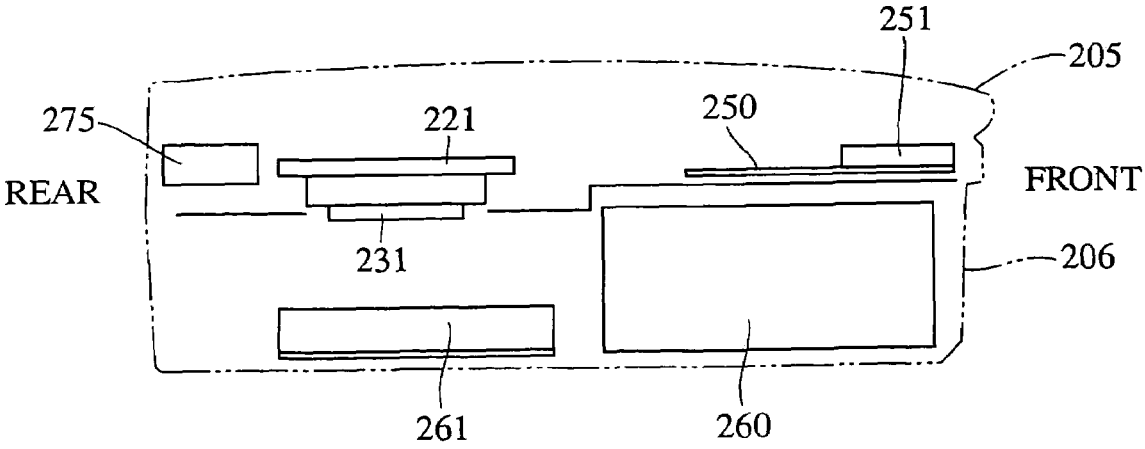
FIG. 27 is a schematic left side view of the multifunction device.

As shown in FIGS. 26 and 27, the network board 261 is disposed in a space behind the power supply unit 260 and below the left edge of the recording unit 221. The network board 261 is a circuit board functioning to perform wired communications via a telephone line. As shown in FIG. 23, two modular connectors 263 are provided on the network board 261 for connecting to a telephone line and an external handset. Hence, the network board 261 enables data communications with another facsimile device and a phone call using the external handset (not shown).

The power supply unit 260 and the network board 261 are both mounted on a metal plate fixture 264 and attached to the lower frame 206 as an integral unit. The plate fixture 264 has a flat base 264*a* extending in the front-to-rear direction, and a side wall 264*b* disposed along rear and right edges of the flat base 264*a*. The power supply unit 260 is mounted in the front area of the plate fixture 264, while the network board 261 is mounted in the rear area. Special protective covers 265 and 266 are mounted over the power supply unit 260 and the network board 261, respectively. A plurality of holes 265*a* are formed in the protective cover 265 in order to release heat generated by the power supply unit 260. Escape holes 266*a* are formed in the protective cover 266 at positions opposing the modular connectors 263. An opening 266*b* is formed in the protective cover 266 at a position facing the power supply unit 260, enabling the passage of the electric wires used to connect the main control board 250.

An opening (not shown) is formed in the bottom surface of the lower frame 206 on the left side of the sheet accommodating section 210, and the integrated power supply unit 260 and the network board 261 are mounted in the lower frame 206 through the opening. Hence, it is possible to remove the power supply unit 260 and the network board 261 from the lower frame 206 alone, facilitating maintenance. Insertion slots 202*a* are formed in the left wall of the lower frame 206 at points opposing the modular connectors 263 of the network board 261 for inserting modular jacks. A cord outlet 202*b* is formed in the same side of the lower frame 206 rearward of the insertion slots 202*a* for running a power cord out of the device.

As shown in FIG. 18, a control panel 273 is disposed in the front area on top of the upper frame 205, and a scanner 204 is disposed in the area behind the control panel 273. The control panel 273 includes various buttons, such as the numerical buttons 0-9, a Start button, and function buttons that can be pressed to perform various operations. The control panel 273 is also provided with a display portion 273A, such as a liquid crystal display, for displaying settings for the multifunction device 201, messages, or the like according to need.

The scanner 204 functions to scan images from a facsimile original to be transmitted to another facsimile device when using the facsimile function, or images of an original to be copied when using the copier function. As shown in FIG. 20, the scanner 204 includes a glass plate 270 mounted on the upper frame 205 to support original documents, a scanning unit 271 for scanning images of documents placed on the glass plate 270, and a document cover 272 for covering the glass plate 270. The scanning unit 271 is disposed directly below the glass plate 270 so that the glass plate 270 is interposed between the scanning unit 271 and an original document placed on the top surface of the glass plate 270.

Figure 19A:
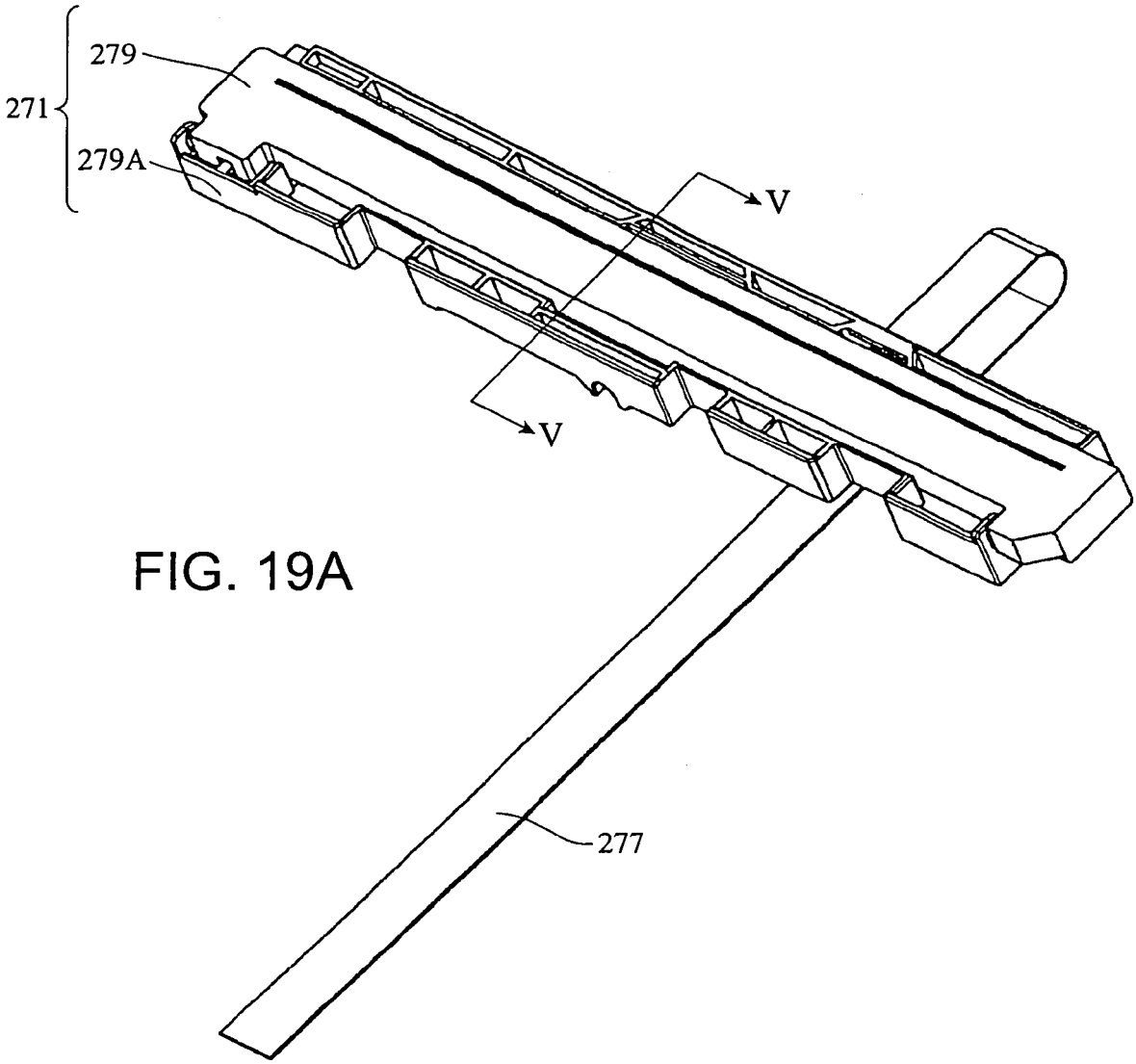
FIG. 19A is a perspective view of main components of a scanning unit of the multifunction device of FIG. 15.
Figure 19B:
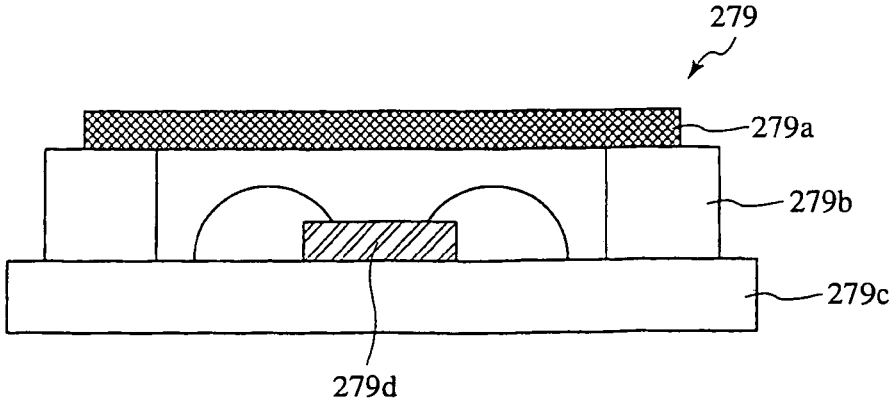
FIG. 19B is a cross-sectional view of an image sensor taken along a line V-V of FIG. 19A.

As shown in FIG. 19A, the scanning unit 271 includes a line-type contact image sensor (CIS) 279 and a frame 279A on which the contact image sensor 279 is supported. The frame 279A and the contact image sensor 279 extend in the front-to-rear direction parallel to the shafts 214. As shown in FIG. 19B, the contact image sensor 279 has a cover glass 279*a*, a frame 279*b*, a substrate 279*c*, and a plurality of photoelectric conversion elements 279*d* (only one photoelectric conversion element 279*d* is shown in FIG. 19B). The photoelectric conversion elements 279*d* are for reading images from the surface of the document on the glass plate 270. The photoelectric conversion elements 279*d* are aligned in the longitudinal direction of the contact image sensor 279, that is, in the front-to-rear direction of the multifunction device 201.

As shown in FIG. 20, sliders 274 are disposed on the front and rear ends of the scanning unit 271. The scanning unit 271 is coupled with a drive motor 275 shown in FIG. 26 and scans images of a document on the glass plate 270 while the drive motor 275 and a timing belt (not shown) move the scanning unit 271 reciprocally left and right with respect to the upper frame 205 via the sliders 274. Also, as shown in FIG. 20, a depression 271*a* is formed on the bottom of and in the front-to-rear center portion of the scanning unit 271. A guide shaft 276 extending in the left-to-right direction is fitted into the depression 271*a* for guiding the scanning unit 271 left and right. In other words, the frame 279A with the contact image sensor 279 mounted thereon is capable of moving reciprocally in a direction perpendicular to the shafts 214.

As shown in FIG. 18, a flexible wiring member 277, such as a flexible flat cable, connects the contact image sensor 279 to the main control board 250. Here, the main control board 250 extends to a point near the pivotal axis of the upper frame 205 (the left edge of the lower frame 206), while the wiring member 277 extends from a portion of the main control board 250 near the pivotal axis of the upper frame 205 to the scanning unit 271.

Specifically, one end of the wiring member 277 is connected to a mid-portion of the contact image sensor 279 in the longitudinal direction, while the other end is connected to the left edge of the main control board 250 parallel to the shafts 214. The wiring member 277 runs around the periphery of the shaft 214 so that the flat surface (widthwise surface) of the wiring member 277 confronts the pivotal axis of the upper frame 205 and so that the longitudinal direction of the wiring member 277 is orthogonal to the pivotal axis of the upper frame 205 and parallel to the direction in which the contact image sensor 279 moves. The edges at both connecting ends of the wiring member 277 are arranged parallel to the pivotal axis of the upper frame 205.

With the wiring member 277 configured in this way, the widthwise surface of the wiring member 277 includes a large curved section near the shaft 214 that is not twisted when the upper frame 205 is closed over the lower frame 206 or when the upper frame 205 is opened wide. Hence, the widthwise surface of the wiring member 277 at a midpoint in the longitudinal direction does not twist, even when the contact image sensor 279 is in a standby position, that is, near the shafts 214. Accordingly, an unreasonable force is not applied to the wiring member 277, making it possible to minimize the potential for damage to the wiring member 277, even when the multifunction device 201 is used over a long period of time and the upper frame 205 is repeatedly opened and closed. There is also no repeated bending of the wiring member 277 that can cause the wiring member 277 to wear out and break (fractures in the conducting portions). Further, the length of the wiring member 277 can be shortened greatly.

As shown in FIG. 20, the document cover 272 is pivotably attached to the rear end of the upper frame 205 via hinges 278. Hence, in a plan view, the pivotal axis of the upper frame 205 with respect to the lower frame 206 is orthogonal to the pivotal axis of the document cover 272 with respect to the upper frame 205. Therefore, when the upper frame 205 is pivoted open on the lower frame 206, the document cover 272 is prevented from opening simultaneously.

Figure 16:
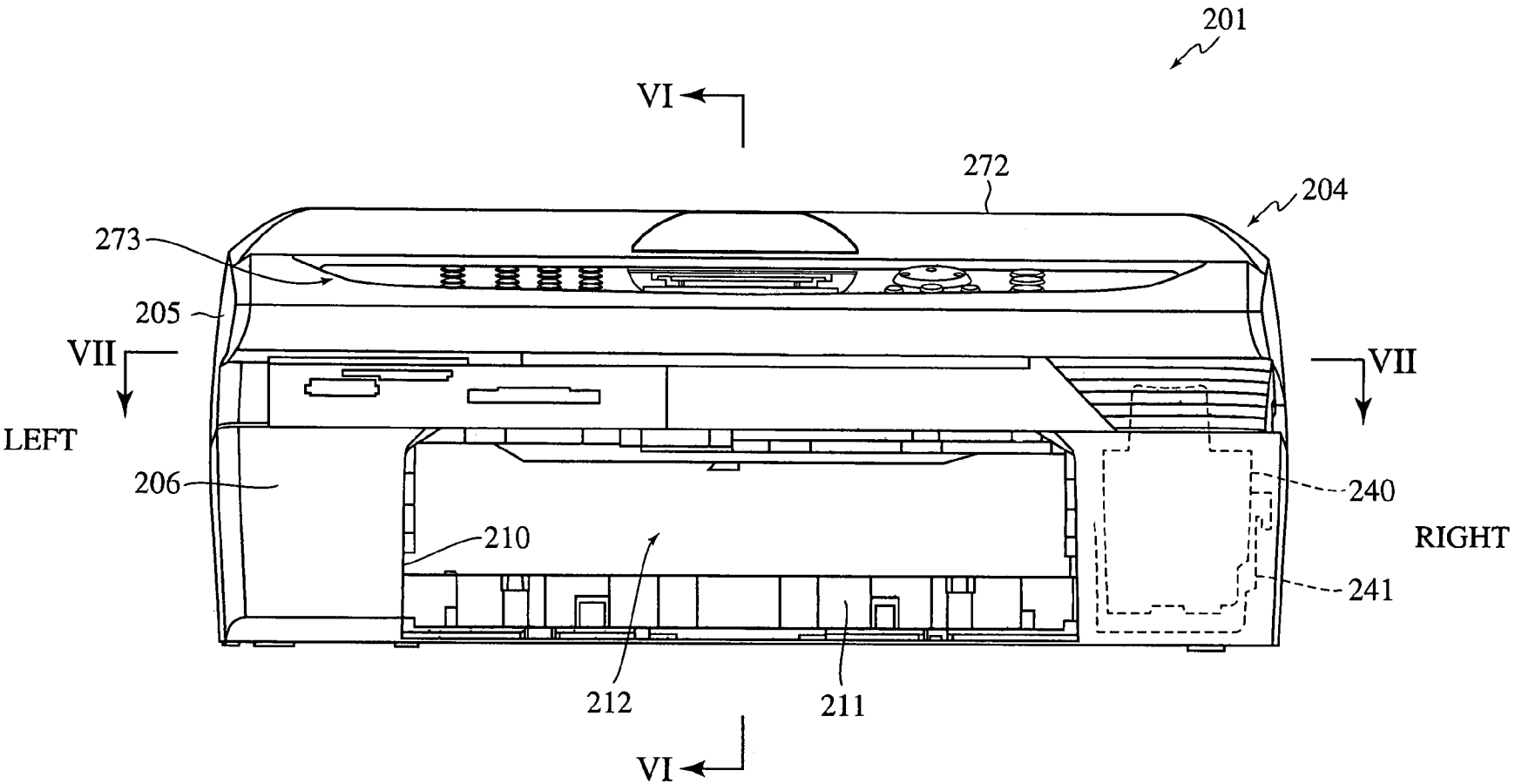
FIG. 16 is a front view of the multifunction device of FIG. 15.

As shown in FIG. 17, the drive motor 275 is accommodated in a portion protruding downward from the left rear of the upper frame 205, so the drive motor 275 protrudes downward from the bottom of the upper frame 205. When the upper frame 205 is in the closed state as shown in FIG. 16, the drive motor 275 occupies approximately one-third of the space on the left side above the plate 225 (the recessed portion adjacent to the waste liquid absorbing member 238) as shown in FIG. 20, thereby effectively using the space behind the recording unit 221. Since the main control board 250 is disposed in the front of the main casing 202 while the drive motor 275 is disposed in the rear, adverse effects of noise generated when operating the drive motor 275 on the main control board 250 can be minimized.

Next, a multifunction device 201A according to a modification of the first embodiment will be described with reference to FIGS. 28 to 30, wherein like parts and components have been given the same reference numerals to avoid duplicating description.

Figure 28:
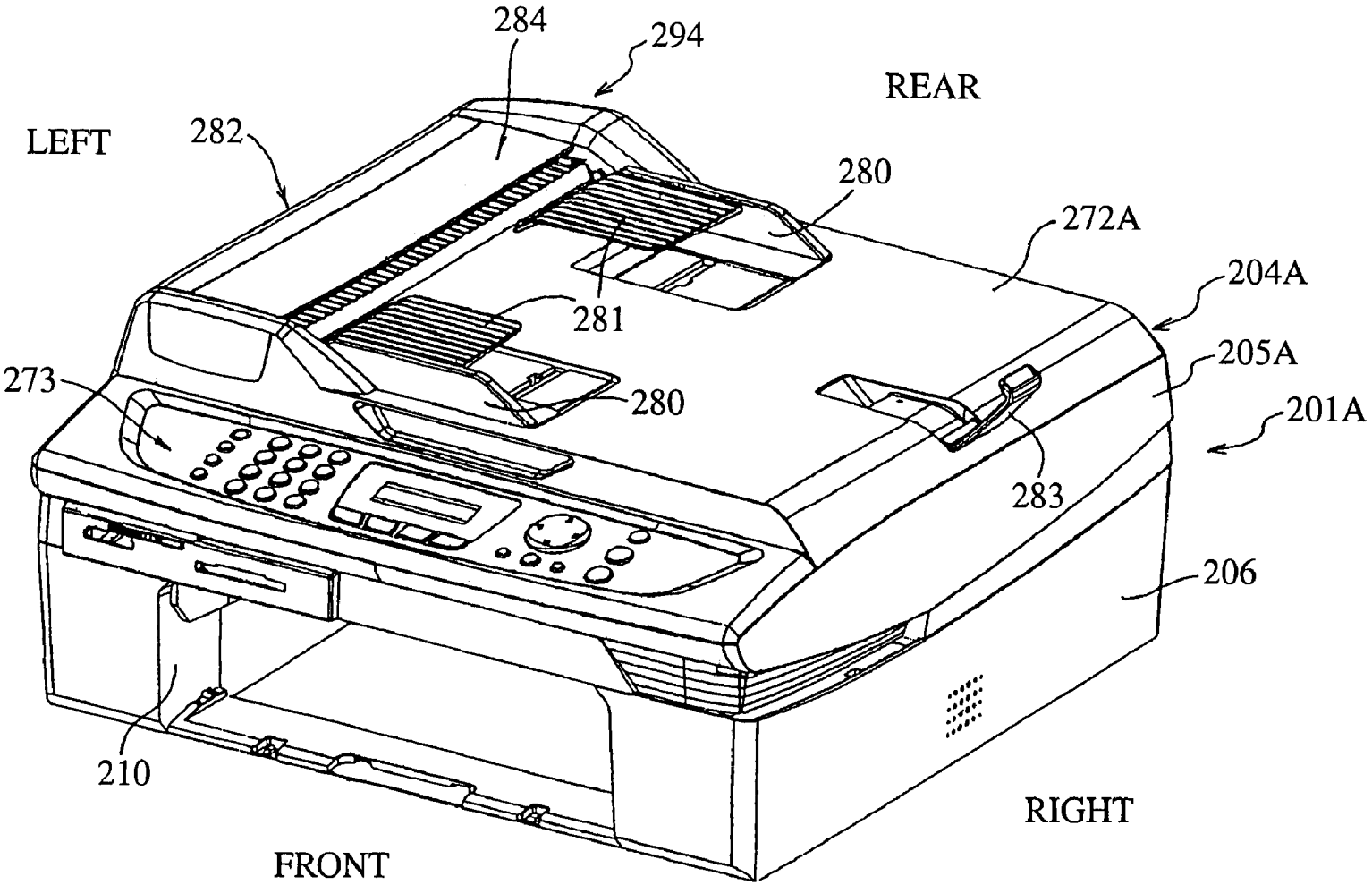
FIG. 28 is a perspective view of a modified multifunction device.

As shown in FIG. 28, the multifunction device 201A includes an upper frame 205A and a scanner 204A. The upper frame 205A is pivotably supported on the left end of the lower frame 206 in the same manner as the upper frame 205 of the first embodiment. The scanner 204A includes a document cover 272A, a document supply tray 280, a discharge tray 281, and an automatic document feeder 282.

The document cover 272A is pivotably attached to the rear edge of the upper frame 205A. The document supply tray 280 is disposed on the top surface of the document cover 272A, and the discharge tray 281 is disposed above the document supply tray 280. The document supply tray 280 guides an original document into the automatic document feeder 282 on the left.

The automatic document feeder 282 automatically conveys an original document from the document supply tray 280 to a scanning position to be scanned by the scanning unit 271. After the scanning unit 271 scans an image from the document, the document is discharged onto the discharge tray 281, and the discharge tray 281 guides the original document toward the right. A document stopper 283 is disposed on the right edge of the document cover 272A for receiving the discharged documents.

Figure 29:
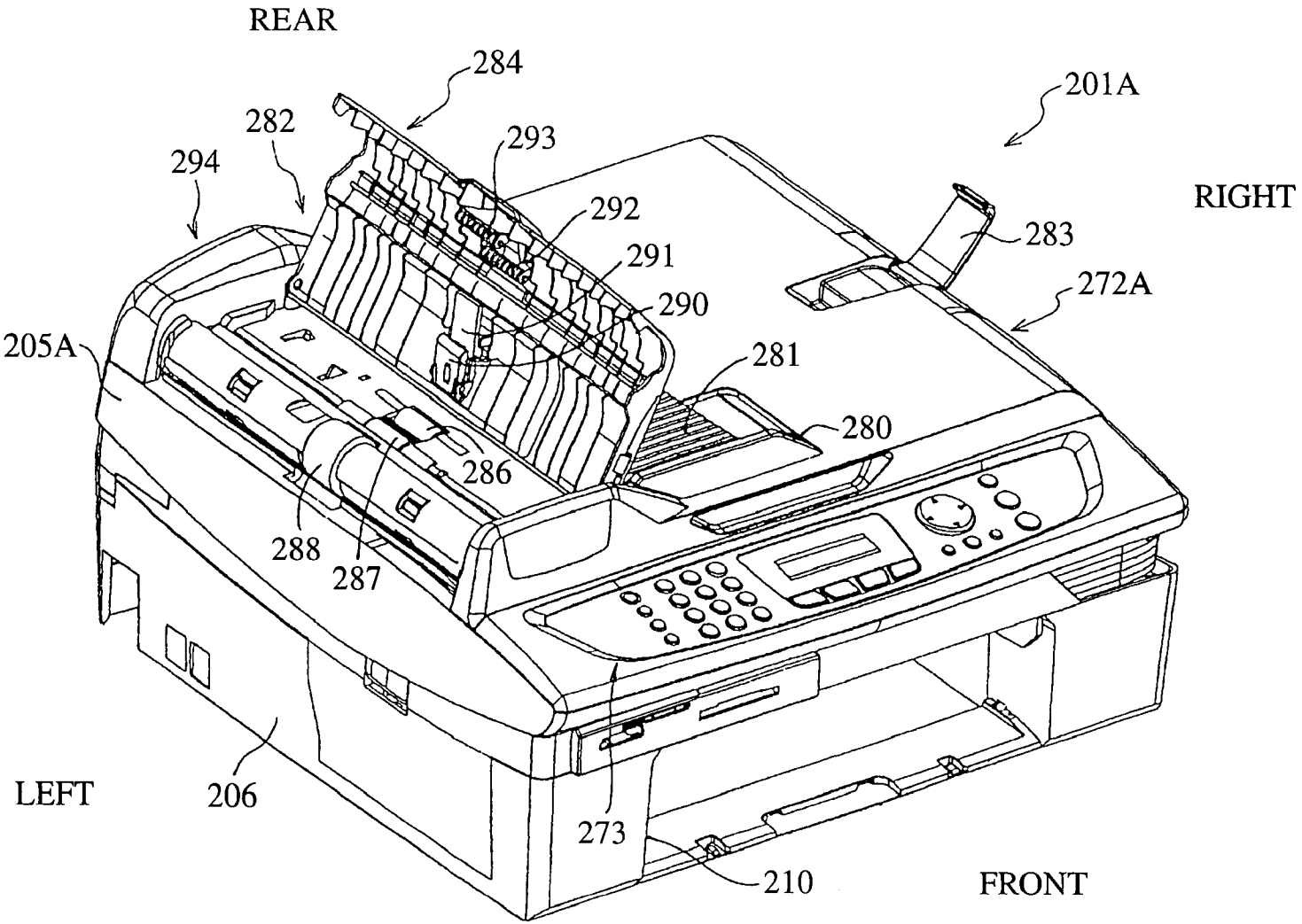
FIG. 29 is a perspective view of the multifunction device of FIG. 28 in which a cover is in an open state.
Figure 30:
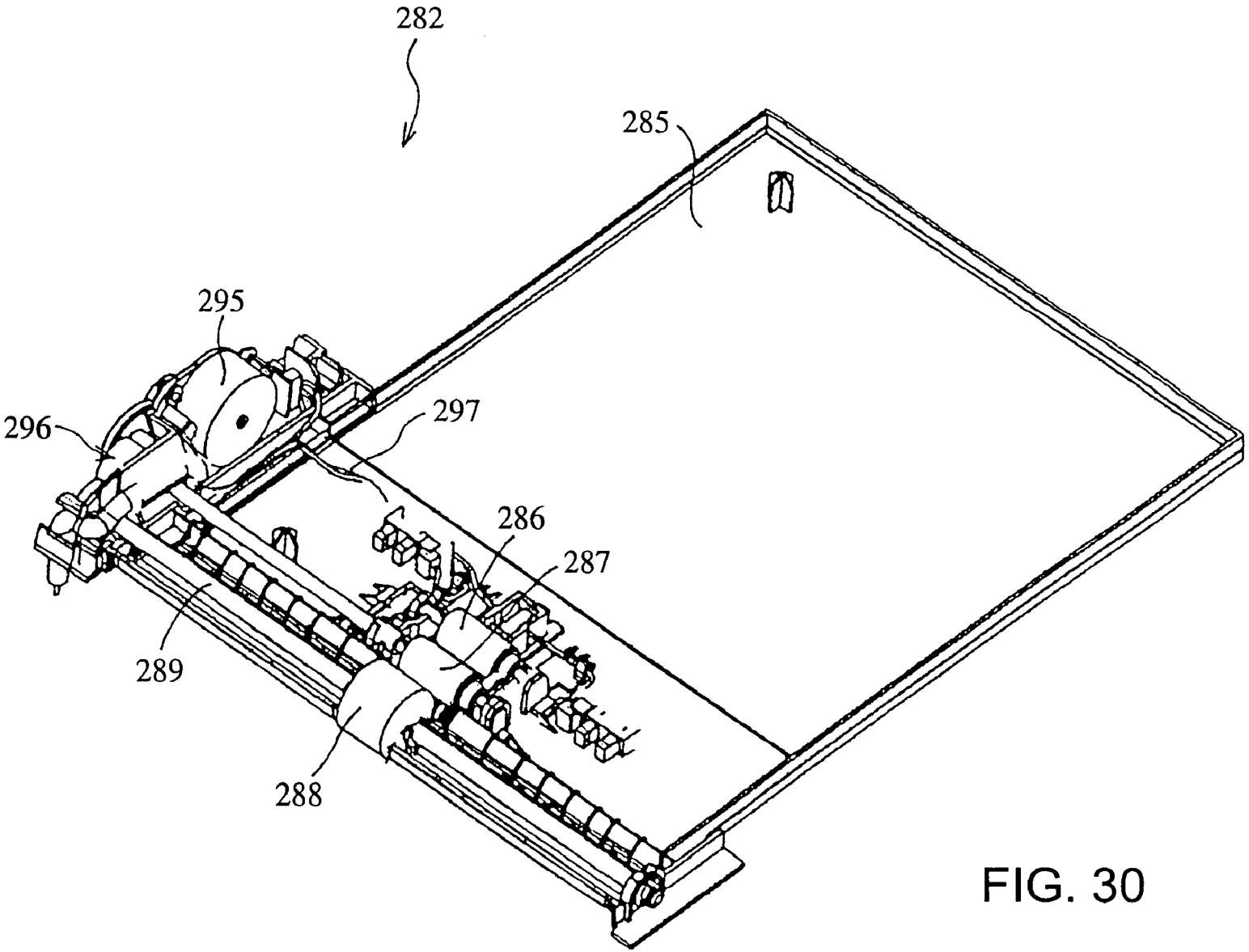
FIG. 30 is a perspective view showing the relevant parts of an automatic feeding mechanism of the multifunction device of FIG. 28.

More specifically, as shown in FIGS. 29 and 30, the automatic document feeder 282 includes a cover 284, a pressing plate 285, a pickup roller 286, a separation roller 287, and a reversing roller 288. The cover 284 is disposed at the left end of the document cover 272A to be freely opened and closed. The pressing plate 285 is disposed above the glass plate 270 (see FIG. 20) for pressing an original document against the glass plate 270. The pickup roller 286 and the separation roller 287 are rotatably supported on the pressing plate 285 for feeding original documents one at a time inside the cover 284. The reversing roller 288 is for reversing the feeding direction of original documents fed inside the cover 284, and is rotatably supported on the cover 272A via a drive shaft 289.

As shown in FIG. 29, provided on the inner surface of the cover 284 are pad members 290 and 291 capable of resiliently contacting the pickup roller 286 and the separation roller 287, respectively, and follow rollers 292 and 293 capable of resiliently contacting the reversing roller 288.

A casing 294 is disposed behind the cover 284. As shown in FIG. 30, the casing 294 houses a document feeding motor 295 and a gear mechanism 296. The document feeding motor 295 is connected to the main control board 250 via a cable 297. The gear mechanism 296 is for transferring the rotational drive force of the document feeding motor 295 to the pickup roller 286, the separation roller 287, and the drive shaft 289. The rotational driving force transferred from the document feeding motor 295 drives the pickup roller 286 and the separation roller 287 to rotate and feed an original document from the document supply tray 280 into the cover 284 one sheet at a time. The document feeding motor 295 also drives the reversing roller 288 to rotate. The reversing roller 288 inverts the document fed by the pickup roller 286 and the separation roller 287 and changes the direction in which the document is conveyed from a leftward direction to a rightward direction. The scanning unit 271 disposed at a scanning position below the reversing roller 288 scans the image on the original document. After being scanned, the document is discharged onto the discharge tray 281.

Since the document feeding motor 295 is disposed near the pivotal axis of the upper frame 205A at the left end of the upper frame 205A, an unreasonable force is not applied to a wiring member (not shown) connecting the document feeding motor 295 and the main control board 250 (FIG. 20) and the cable 297 connecting the document feeding motor 295 to the power supply unit 260 (see FIG. 23) when the upper frame 205A is pivoted on the lower frame 206, thereby minimizing the potential for damage to the wiring member and the cable 297. Further, since the document feeding motor 295 is disposed on the rear edge of the multifunction device 201A, opposite the side on which the main control board 250 is disposed, adverse effects of noise generated by the document feeding motor 295 on the main control board 250 can be minimized.

Note that in the multifunction devices 201 and 201A described above, the sheet supply tray 211 mounted on the sheet accommodating section 210 also functions as a discharge tray, wherein the recording sheet P supplied from the lower supply space 212*a* on the front is reversed in the lower fame 206 and discharged into the upper discharge space 212*b* on the front. However, the sheet supply tray 211 may also be configured of only the upper discharge space 212*b* in the sheet accommodating section 210, such that the recording sheet P is supplied from the rear and discharged into the upper discharge space 212*b* on the front, for example.

Further, it is not necessary to omit the bottom surface of the sheet accommodating section 210 to form an opening in the bottom.

Further, the positions of the cartridge holder 241 and the power supply unit 260 on the right and left sides of the sheet accommodating section 210 may be switched. However, when the cartridge holder 241 is configured so that the ink cartridges 240 are mounted and removed through the top thereof, as in the multifunction device 201 of the preferred embodiment described above, the cartridge holder 241 is preferably disposed on the side opposite the pivotal axis of the upper frame 205 in order to facilitate this replacement operation. However, if the ink cartridges 240 are mounted and removed through the front or rear side, the cartridge holder 241 may be disposed on either the left or right side of the sheet accommodating section 210.

If a multifunction device 201 includes a sheet supply tray on a rear side, the size of the multifunction device 201 is enlarged in the front and back direction. As such, the sheet supply tray 211 is detachably inserted into the sheet accommodating section 212 in order to miniaturize the multifunction device. However, if the ink cartridges 240 are also placed within the multifunction device 201, the location and the size of the ink cartridges 240 are taken into consideration in order to maintain the miniaturized size of the multifunction device 201.

In the meantime, the inkjet head 231 of the multifunction device 201 moves beyond both side edges of the recording sheet P in order to print an image on the entire area of the recording sheet P. Therefore, as discussed above, the ink cartridges 240 are disposed on the right side of the sheet accommodating section 210 so that the size of the multifunction device 201 can be made smaller without increasing of the height of the multifunction device 201.

The largest most commonly-used recording sheet P in the multifunction device 201 is A4. The size of the multifunction device 201 will thus be dimensioned in order to print an image on an A4 sheet or on a smaller sheet. Furthermore, various dimensions of the ink cartridge 240, which is similar to the ink cartridge 1 of FIGS. 14A-14I that is attachable to the multifunction device 201, will be described.

Figure 31:
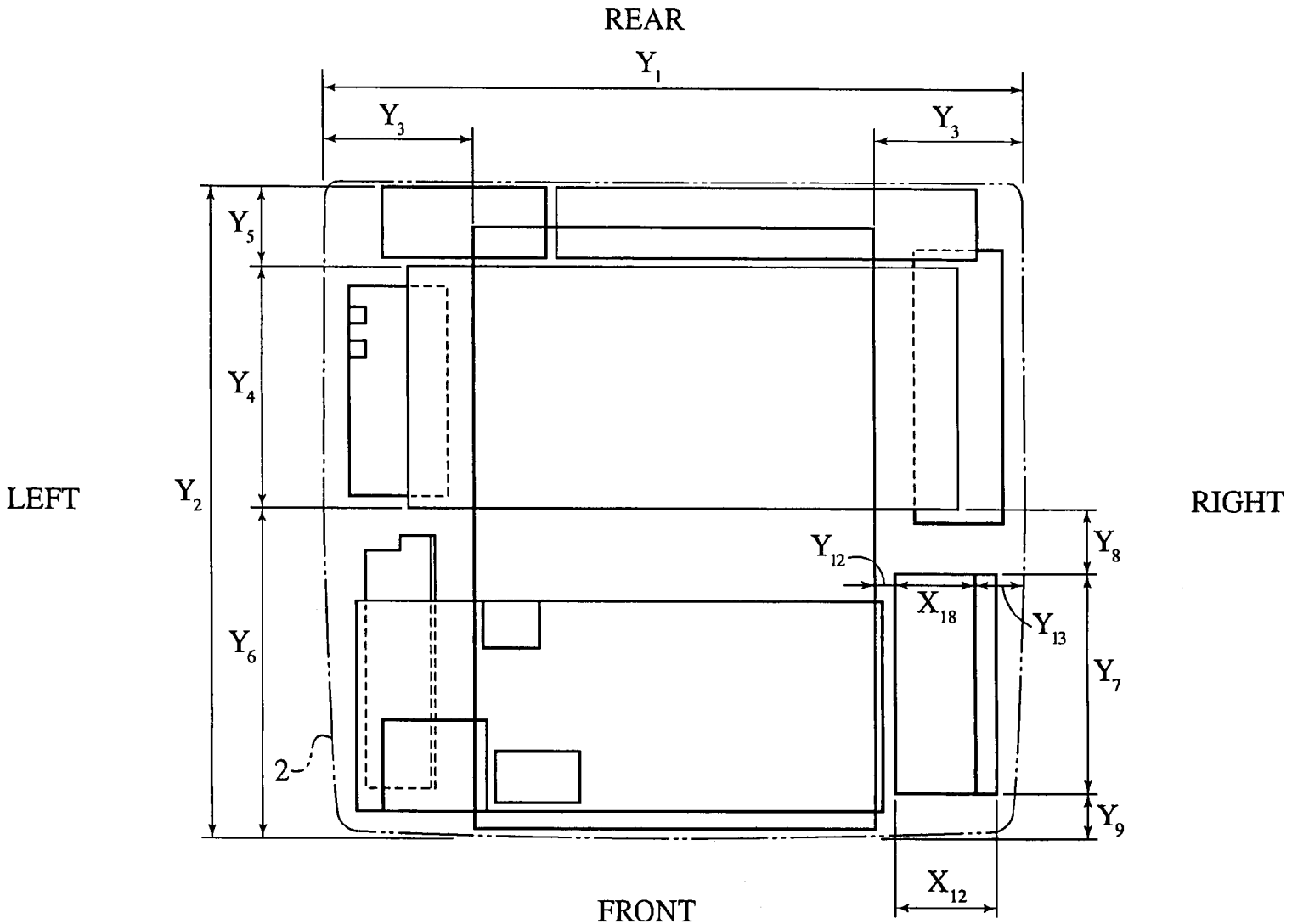
FIG. 31 illustrates various dimensions of the multifunction device of FIG. 26.

As should be appreciated, the width of the A4 sheet is 210 mm and the length of the A4 sheet is 297 mm. As shown in FIG. 31, in the embodiments, the distance $Y_1$ from the left outer surface to the right outer surface of the multifunction device 201 is 304 mm. In some embodiments, the distance $Y_1$ is less than about 304 mm. In some embodiments, the distance $Y_1$ is about 304 mm. In further embodiments, the distance $Y_1$ can vary from 304 mm by ±5 mm or ±10 mm. In some embodiments, the distance $Y_1$ is set for a carriage 230 whose width in a main scanning direction is 47 mm. Thus, in order to print an image on the entire area of the recording sheet P (210 mm for the width of the A4 sheet+47 mm×2 for the dimension on both sides of the recording sheet P in order to accommodate the movement of the carriage 230=304 mm), the distance $Y_1$ is set as discussed above.

In order to accommodate gears located on both sides of the A4 sheet in order to drive the carriage 230, additional space is required. In the embodiments, the distance $Y_3$ from the left outer surface of the multifunction device 201 to the left surface of the recording sheet P when the recording sheet P is placed in the multifunction device 201 is 75.5 mm. In some embodiments, the distance $Y_3$ is less than about 75.5 mm. In some embodiments, the distance $Y_3$ is about 75.5 mm. In further embodiments, the distance $Y_3$ can vary from 75.5 mm by ±5 mm or ±10 mm. As should be appreciated, the distance $Y_3$ also applies from the right outer surface of the multifunction device 201 to the right surface of the recording sheet P when the recording sheet P is placed in the multifunction device 201.

With the distance $Y_3$, in some embodiments, the distance $Y_1$ is 361 mm (210 mm for the width of the A4 sheet+75.5 mm×2 for the distance on both sides of the recording sheet P in order to accommodate the movement of the carriage 230 and other gears=361 mm).

As discussed above, the length of the A4 sheet is 297 mm. In the embodiments, the distance $Y_2$ from the front outer surface of the multifunction device 201 to the rear outer surface of the multifunction device 201 is 322 mm. In some embodiments, the distance $Y_2$ is less than about 322 mm. In some embodiments, the distance $Y_2$ is about 322 mm. In further embodiments, the distance $Y_2$ can vary from 322 mm by ±5 mm or ±10 mm. By providing the described variants on the distance $Y_2$, a sufficient amount of space is available for the recording sheet P to turn within the multifunction device 201.

At both sides of the recording sheet P, two spaces are created. One of the two spaces is used for disposing the power supply unit 260 and the network board 261. The ink cartridges 240 are disposed in the other one of the two spaces. The space on the left side of the recording sheet P will be described. The space between the left side and the right side of the recording sheet P will also be described for storing the waste liquid absorbing member 238 and the drive motor 275. As shown in FIG. 31, the space from the rear outer surface of the multifunction device 201 has a distance $Y_5$ and a distance $Y_1$ for disposing of the waste liquid absorbing member 238 and the drive motor 275. In the embodiments, the distance $Y_5$ from the rear outer surface of the multifunction device 201 is 25 mm. In some embodiments, the distance $Y_5$ is less than about 25 mm. In some embodiments, the distance $Y_5$ is about 25 mm. In further embodiments, the distance $Y_5$ can vary from 25 mm by ±0.5 mm or ±1 mm.

The space from the front outer surface of the multifunction device 201 has a distance $Y_6$ and a distance $Y_3$ for disposing of the power supply unit 260. In the embodiments, the distance $Y_6$ from the front outer surface of the multifunction device 201 is 178 mm. In some embodiments, the distance $Y_6$ is less than about 178 mm. In some embodiments, the distance $Y_6$ is about 178 mm. In further embodiments, the distance $Y_6$ can vary from 178 mm by ±5 mm or ±10 mm. The resultant space from the distance $Y_5$ and the distance $Y_6$ is $Y_4$ for storing the network board 261. In the embodiments, the distance $Y_4$ is 119 mm. In some embodiments, the distance $Y_4$ is less than about 119 mm. In some embodiments, the distance $Y_4$ is about 119 mm. In further embodiments, the distance $Y_4$ can vary from 119 mm by ±5 mm or ±10 mm.

As discussed above, the ink cartridges 240 are disposed in one of the two spaces. In the example of FIG. 31, the ink cartridges are disposed on the right. In the embodiments, a distance $Y_8$ is provided for disposing of the flexible tubes 242 and a distance $Y_9$ is provided for disposing of wires in order to connect the control board 250 to each of the electrical components in the multifunction device 201. Therefore, in the embodiments, the distance $Y_7$ remains for disposing of the ink cartridges 240. In the embodiments, the distance $Y_7$ is 123 mm. In some embodiments, the distance $Y_7$ is less than about 123 mm. In some embodiments, the distance $Y_7$ is about 123 mm. In further embodiments, the distance $Y_7$ can vary from 123 mm by ±5 mm or ±10 mm.

In the embodiments, a distance $Y_{12}$ is provided for disposing wires that are used to connect the control board 250 to each of the electric components of the multifunction device 201 and a distance $Y_{13}$ is provided for disposing an ink-amount detecting sensor and wires. Thus, a remaining length $X_{12}$ and $X_{18}$ remains for the ink cartridge 240 which has dimensions similar to the ink cartridge 1 as discussed above for FIGS. 14A-14I.

An ink cartridge for cyan ink, a cartridge for magenta ink, a cartridge for yellow ink and a cartridge for black ink are arranged in the lengthwise direction of the multifunction device 201. Even though the distance $Y_7$ is provided as discussed above, spaces for disposing locking arms are needed. One locking arm occupies a distance of about 9 mm, therefore four locking arms occupy a distance of about 9 mm×4=36 mm. As a result, ink cartridges can occupy a distance of about 123 mm−36 mm=87 mm.

Generally, black ink tends to be more consumed than the other color inks. Therefore, a distance of the black cartridge is set 1.5 times as long as a length of each one of the color cartridges. If about 87 mm is divided at ratios of 1.5:1:1:1, it is divided into about 29 mm: 19.5 mm, 19.5 mm, 19.5 mm. As such, the distances $X_{27}$, are provided as discussed above.

The ink cartridges 240 are disposed so as to be located within a base surface of the multifunction device 201 and a top of the control board 250. As shown in FIG. 25, in the embodiments, the distance H is 79.5 mm. In some embodiments, the distance H is less than about 79.5 mm. In some embodiments, the distance H is about 79.5 mm. In further embodiments, the distance H can vary from 79.5 mm by ±5 mm or ±10 mm. The distance H is defined by the height of the sheet supply tray 211, the height of sheet discharge portion, and the height of the control board 250. The sheet supply tray can accommodate 100 sheets and the sheet discharge portion can accommodate 100 discharged sheets. In the embodiments, the distance $Y_{16}$ needed below the attached ink cartridge 240 for disposing ink tubes is 11.5 mm. In some embodiments, the distance $Y_{16}$ is less than about 11.5 mm. In some embodiments, the distance $Y_{16}$ is about 11.5 mm. In further embodiments, the distance $Y_{16}$ can vary from 11.5 mm by ±0.5 mm or ±1 mm. Therefore, the distances $X_1$, $X_2$ and $X_3$ of the ink cartridge 1 (corresponding to a similar distance for the ink cartridge 240) is set as discussed above.

In order to remove the ink cartridge 240 from the multifunction device, it is preferable to provide a protrusion (i.e., protrusion 1*i* of FIGS. 14A-14C) as a gripping part in order to facilitate removal of the ink cartridge 240 from the multifunction device 201. In order to grip the protrusion with the user's fingers, the protrusion needs to be about 21 mm or more (i.e., $X_3-X_1=71.5-50.5)=21$ mm. By providing the ink cartridge 240 and the multifunction device 201 with the above dimensions, the size of the multifunction device 201 can be miniaturized.

While this invention has been described in conjunction with the exemplary embodiments and examples outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. An ink cartridge, comprising:
an ink chamber capable of storing ink;
an opening in a bottom surface of the ink cartridge, through which the ink is supplied from the ink chamber to an image forming device;
a first side wall;
a second side wall opposite from the first side wall;
a front wall; and
a back wall opposite the front wall;
wherein:
a first distance between the first side wall and the second side wall is greater than a second distance between the front wall and the back wall;
the front wall includes a recess having a bottom end and a top end, the bottom end being located at a bottom edge of the front wall;
a third distance from the bottom end of the recess to the top end is at least about 4.5 mm; and
a depth of the recess into the front wall at the top end is less than about 3 mm.

2. The ink cartridge of claim 1, wherein the third distance is from about 4.5 mm to about 5.5 mm.

3. The ink cartridge of claim 1, wherein the third distance is about 4.5 mm.

4. The ink cartridge of claim 1, wherein the depth is from about 2 mm to about 3 mm.

5. The ink cartridge of claim 1, wherein the depth is about 3 mm.

6. The ink cartridge of claim 1, wherein the depth is about 2.6 mm.

7. An ink cartridge, comprising:
an ink chamber capable of storing ink;
an opening in a bottom surface of the ink cartridge, through which the ink is supplied from the ink chamber to an image forming device;
an upper surface opposite from the bottom surface;
a first side wall;
a second side wall opposite from the first side wall;
a front wall; and
a back wall opposite the front wall;
wherein:
a first distance between the first side wall and the second side wall is greater than a second distance between the front wall and the back wall;
a bottom portion of the first side wall is closer to the second side wall than an upper portion of the first side wall;
a third distance from the bottom portion of the first side wall to the second side wall is less than about 39.5 mm;
the front wall includes a first bottom edge and the back wall includes a second bottom edge;
a fourth distance from the first bottom edge to the second bottom edge is less than about 19.5 mm; and
a fifth distance from the upper surface to the bottom surface is less than about 48 mm.

8. The ink cartridge of claim 7, wherein the third distance is from about 38.5 mm to about 39.5 mm.

9. The ink cartridge of claim 7, wherein the third distance is about 39.5 mm.

10. The ink cartridge of claim 7, wherein the third distance is about 39.4 mm.

11. The ink cartridge of claim 7, wherein the fourth distance is from about 18.5 mm to about 19.5 mm.

12. The ink cartridge of claim 7, wherein the fourth distance is about 19.5 mm.

13. The ink cartridge of claim 7, wherein the fourth distance is about 19.4 mm.

14. The ink cartridge of claim 7, wherein the first distance is less than about 48.5 mm.

15. The ink cartridge of claim 7, wherein the fifth distance is from about 47 mm and to about 48 mm.

16. The ink cartridge of claim 7, wherein the fifth distance is about 48 mm.

17. The ink cartridge of claim 7, wherein the fifth distance is about 47.7 mm.

18. An ink cartridge, comprising:
an ink chamber capable of storing ink;
an opening in a bottom surface of the ink cartridge, through which the ink is supplied from the ink chamber to an image forming device;
an upper surface opposite from the bottom surface;
a first side wall;
a second side wall opposite from the first side wall;
a front wall; and
a back wall opposite the front wall;
wherein:
a first distance between the first side wall and the second side wall is greater than a second distance between the front wall and the back wall;
a bottom portion of the first side wall is closer to the second side wall than an upper portion of the first side wall;

a third distance from the bottom portion of the first side wall to the second side wall is less than about 39.5 mm;

the front wall includes a first bottom edge and the back wall includes a second bottom edge;

a fourth distance from the first bottom edge to the second bottom edge is less than about 28.5 mm; and a fifth distance from the upper surface to the bottom surface is less than about 48 mm.

19. The ink cartridge of claim 18, wherein the third distance is from about 38.5 mm to about 39.5 mm.

20. The ink cartridge of claim 18, wherein the third distance is about 39.5 mm.

21. The ink cartridge of claim 18, wherein the third distance is about 39.4 mm.

22. The ink cartridge of claim 18, wherein the fourth distance is from about 27.5 mm to about 28.5 mm.

23. The ink cartridge of claim 18, wherein the fourth distance is about 28.5 mm.

24. The ink cartridge of claim 18, wherein the fourth distance is about 28.2 mm.

25. The ink cartridge of claim 18, wherein the first distance is less than about 48.5 mm.

26. The ink cartridge of claim 18, wherein the fifth distance is from about 47 mm to about 48 mm.

27. The ink cartridge of claim 18, wherein the fifth distance is about 48 mm.

28. The ink cartridge of claim 18, wherein the fifth distance is about 47.7 mm.

29. An ink cartridge, comprising:

an ink chamber capable of storing ink;

an opening in a bottom surface of the ink cartridge, through which the ink is supplied from the ink chamber to an image forming device;

a first side wall;

a second side wall opposite from the first side wall;

a front wall; and a back wall opposite the front wall;

wherein:

the first side wall includes a protruding region, which protrudes outwardly with respect to adjacent regions of the first side wall;

the protruding region has a first edge and a second edge, the first edge being closer to the front wall than to the back wall and the second edge being closer a back wall than to the first wall; and a first distance from the first edge to the second edge is less than about 4.5 mm.

30. The ink cartridge of claim 29, wherein the first distance is from about 3.5 mm to about 4.5 mm.

31. The ink cartridge of claim 29, wherein the first distance is about 4.5 mm.

32. The ink cartridge of claim 29, wherein the first distance is about 4.2 mm.

33. The ink cartridge of claim 29, comprising:

a blocking member that is positioned between the bottom surface and the ink chamber, the blocking member blocking communication between the ink chamber and an outside of the ink cartridge, the blocking member being capable of allowing the communication between the ink chamber and the outside of the ink chamber when an extract component of the image forming device is moved into the ink cartridge from the opening, wherein a second distance from the bottom surface and a bottom of the blocking member is less than about 4.5 mm.

34. The ink cartridge of claim 33, wherein the second distance is from about 3.5 mm to about 4.5 mm.

35. The ink cartridge of claim 33, wherein the second distance is about 4.5 mm.

* * * * *